US005652647A

United States Patent [19]

Yashiro et al.

[11] Patent Number: 5,652,647

[45] Date of Patent: Jul. 29, 1997

[54] PROCESS CARTRIDGE, METHOD FOR ASSEMBLING PROCESS CARTRIDGE AND IMAGE FORMING APPARATUS

[75] Inventors: Masahiko Yashiro, Yokohama; Toshiyuki Karakama, Tokyo; Atsushi Numagami, Hadano, all of Japan

[73] Assignee: Canon Kabushiki Kaisha, Tokyo, Japan

[21] Appl. No.: 603,190

[22] Filed: Feb. 20, 1996

Related U.S. Application Data

[63] Continuation of Ser. No. 328,389, Oct. 24, 1994, abandoned, which is a continuation of Ser. No. 182,689, Jan. 18, 1994, abandoned, which is a continuation of Ser. No. 70,688, Jun. 2, 1993, abandoned.

[30] Foreign Application Priority Data

Sep. 4, 1992 [JP] Japan ..... 4-260613

[51] Int. Cl.[6] ..... G03G 21/16; G03G 15/22

[52] U.S. Cl. ..... 399/111; 399/130

[58] Field of Search ..... 355/200, 210, 355/211

[56] References Cited

U.S. PATENT DOCUMENTS

| | | | |
|---|---|---|---|
| 3,985,436 | 10/1976 | Tanaka et al. . | |
| 4,500,195 | 2/1985 | Hosono . | |
| 4,540,268 | 9/1985 | Toyono et al. . | |
| 4,627,701 | 12/1986 | Onoda et al. | 355/3 CH |
| 4,714,337 | 12/1987 | Nishino et al. | 355/3 DR |
| 4,975,744 | 12/1990 | Ebata et al. | 355/200 X |
| 5,023,660 | 6/1991 | Ebata et al. | 355/200 |
| 5,164,779 | 11/1992 | Araya et al. | 355/219 |
| 5,331,372 | 7/1994 | Tsuda et al. | 355/200 |
| 5,345,294 | 9/1994 | Nomura et al. | 355/200 |

FOREIGN PATENT DOCUMENTS

| | | | |
|---|---|---|---|
| 0276910A1 | 8/1988 | European Pat. Off. . | |
| 0285139 | 10/1988 | European Pat. Off. . | |
| 0466173A2 | 1/1992 | European Pat. Off. . | |
| 0485271 | 5/1992 | European Pat. Off. | 355/210 A |
| 60-189774 | 9/1985 | Japan . | |
| 61-249061 | 11/1986 | Japan . | |
| 63-4253 | 1/1988 | Japan . | |
| 63-149669 | 6/1988 | Japan . | |
| 64-576 | 1/1989 | Japan | 355/210 A |
| 1-221765 | 9/1989 | Japan | 355/210 A |
| 2-64656 | 3/1990 | Japan | 355/210 A |
| 2-163761 | 6/1990 | Japan | 355/210 A |
| 2-181164 | 7/1990 | Japan | 355/210 A |

OTHER PUBLICATIONS

Yuji Murata, "Surface Polymer and Electrostatics", Surface Film Molecule Design Series, vol. 5 (Japan Surface Science Associates, ©1988), pp. 13–16 (§4.1) (Japanese document; with English translation of cited section).

*Primary Examiner*—R. L. Moses

*Attorney, Agent, or Firm*—Fitzpatrick, Cella, Harper & Scinto

[57] ABSTRACT

The present invention provides a process cartridge mountable to an image forming apparatus, comprising an image bearing member, charger device for charging the image bearing member, a first conductive member for electrically earthing the image bearing member, and a second conductive member for applying an AC voltage to the charger device. The first and second conductive members are arranged at positions near both axial ends of the image bearing member, respectively.

135 Claims, 45 Drawing Sheets

PROCESS CARTRIDGE, METHOD FOR ASSEMBLING PROCESS CARTRIDGE AND IMAGE FORMING APPARATUS

This application is a continuation of application Ser. No. 08/328,389, filed Oct. 24, 1994, which is a continuation of application Ser. No. 08/182,689, filed Jan. 18, 1994, which is a continuation of application Ser. No. 07/070,688, filed Jun. 2, 1993, all now abandoned.

BACKGROUND OF THE INVENTION

1. Field of the Invention

The present invention relates to a process cartridge, a method for assembling a process cartridge and an image forming apparatus having the cartridge. The image forming apparatus may be, for example, a laser beam printer, an electrophotographic copying machine, a facsimile machine, a word processor or the like.

2. Related Background Art

In the past, a so-called process cartridge wherein a photosensitive drum, a charger, a developing device, a cleaning device and the like are integrally contained in a cartridge housing, which can be removably mounted to an image forming apparatus, has been put into practical use (for example, as disclosed in U.S. Pat. Nos. 3,985,436, 4,500,195, 4,540,268 and 4,627,701).

Generally, a photosensitive drum is electrically earthed at keep the charging charge on a surface of the drum to a predetermined constant value. Further, a charger means is supplied with a voltage to uniformly charge the photosensitive drum and a developing device is also supplied with a voltage to form a toner image on the photosensitive drum. Accordingly, when an image forming station is constituted by a process cartridge, the cartridge must have electric contacts for electrical connection to an image forming apparatus.

However, for example, when an electric contact for electrically earthing the photosensitive drum is positioned near an electric contact for applying an AC voltage, and particularly, an electric contact for applying a charging voltage, the following disadvantages are apt to occur. That is to say, when the process cartridge is mounted to the image forming apparatus, the electric contact of the cartridge for applying the AC voltage is electrically connected to the electric contact of the apparatus for applying the AC voltage.

On the other hand, the electric contact of the cartridge for applying the AC voltage is connected to a power source via wiring. Accordingly, if the electric contact for electrically earthing the photo-sensitive drum is positioned near the electric contact for applying the charging voltage, the earthing contact will be disposed near the AC wiring of the apparatus, thus generating a stray capacity between the earthing contact and the AC wiring. The stray capacity causes the escape of current that was to be applied to the charger, from the AC wiring to the earthing contact, thereby worsening the ability of the charger.

Further, in an apparatus wherein AC voltages are applied to both a developing device and a charger, if the AC voltage applying contacts are arranged near each other, interference will occur between the contacts. That is to say, generally, since the charging voltage has a frequency lower than that of the developing voltage, the value of the charging voltage is changed by such interference, thus causing a charging discrepancy.

SUMMARY OF THE INVENTION

An object of the present invention is to provide a process cartridge, a method for assembling a process cartridge and an image forming apparatus, which can obtain a high quality image.

Another object of the present invention is to provide a process cartridge, a method for assembling a process cartridge and an image forming apparatus, wherein the electrical connection between the process cartridge and the image forming apparatus can be achieved surely and effectively.

A further object of the present invention is to provide a process cartridge, a method for assembling a process cartridge and an image forming apparatus, which can prevent the occurrence of a charging discrepancy.

A still further object of the present invention is to provide a process cartridge, a method for assembling a process cartridge and an image forming apparatus, wherein a conductive member for earthing an image bearing member and a charging conductive member are spaced apart from each other on both sides of an axis of the image bearing member so that there is no interference between the conductive members, thereby preventing the occurrence of stray capacity.

The other object of the present invention is to provide a process cartridge, a method for assembling a process cartridge and an image forming apparatus, wherein the electrical connection between the process cartridge and the image forming apparatus can be effected reasonably.

DETAILED DESCRIPTION OF THE PREFERRED EMBODIMENTS

First of all, a process cartridge and an image forming apparatus using such process cartridge, according to a first embodiment, will be explained with reference to the accompanying drawings.

{General Explanation of Process Cartridge and Image Forming Apparatus Having Such Process Cartridge Mounted thereto}

Figure 1:
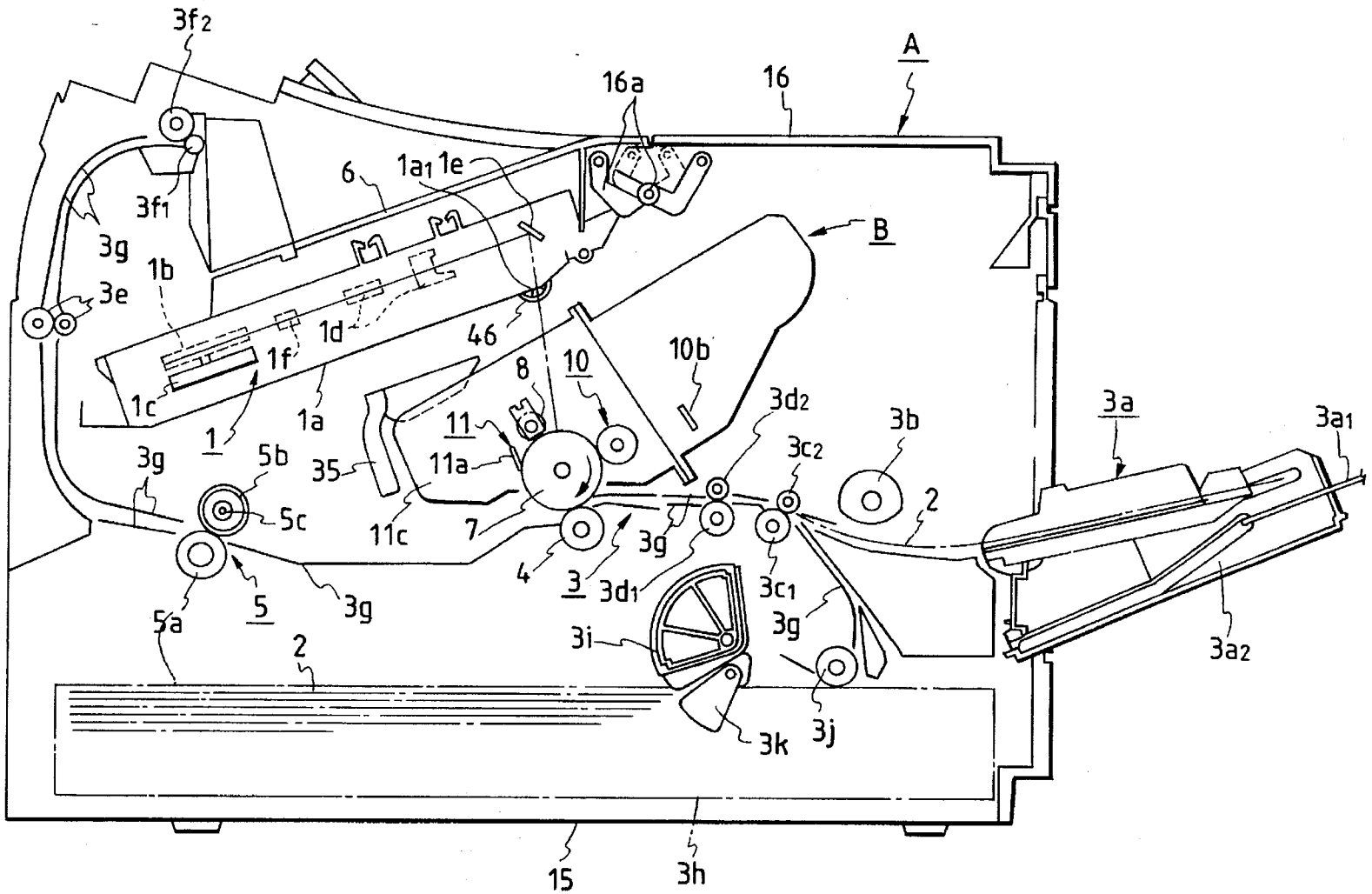
FIG. 1 is an elevational sectional view of an image forming apparatus to which a process cartridge is mounted.
Figure 2:
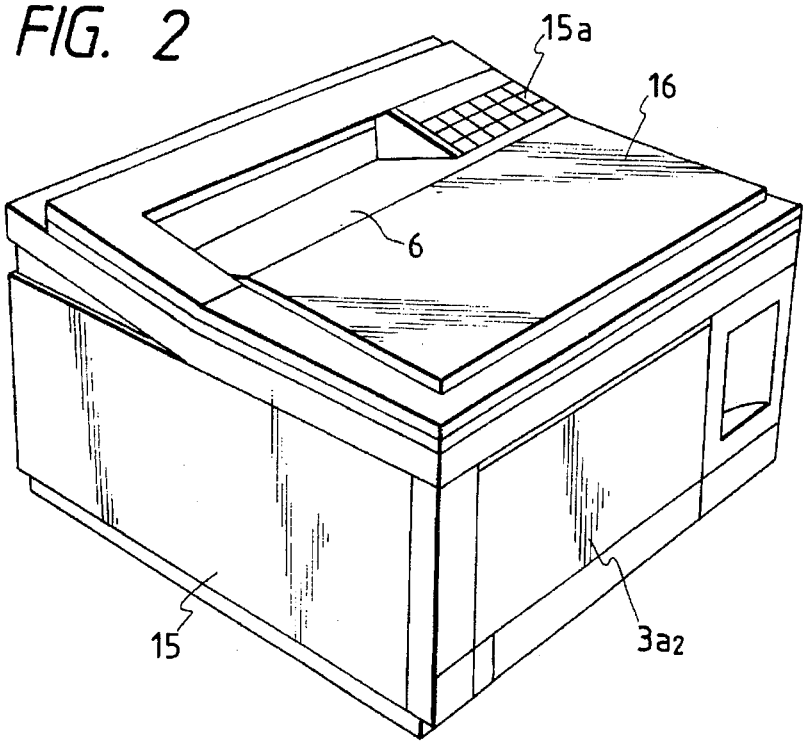
FIG. 2 is a perspective view of the image forming apparatus.

The whole construction of an image forming apparatus is explained first. Incidentally, FIG. 1 is an elevational sectional view of a laser beam printer having a process cartridge mounted thereto, according to one aspect of the present invention. FIG. 2 is a perspective view of the laser beam printer, FIG. 3 is a cross-sectional view of the process cartridge, and FIG. 4 is a perspective view of the process cartridge.

As shown in FIG. 1, the image forming apparatus A is so designed that a latent image is formed on a photosensitive drum (as an example of an image bearing member) by illuminating a light image from an optical system 1 onto the drum in response to image information, and the latent image is developed with a developer (referred to as "toner" hereinafter) to form a toner image. In synchronous with the formation of the toner image, a recording medium 2 is fed by a convey means 3 to an image forming station of a process cartridge B, and, in the image forming station, the toner image formed on the photosensitive drum is transferred onto the recording medium 2 by a transfer means 4. Then, the recording medium 2 is sent to a fixing means 5, where the transferred toner image is fixed to the recording medium. Thereafter, the recording medium is discharged to a discharge portion 6.

Figure 3:
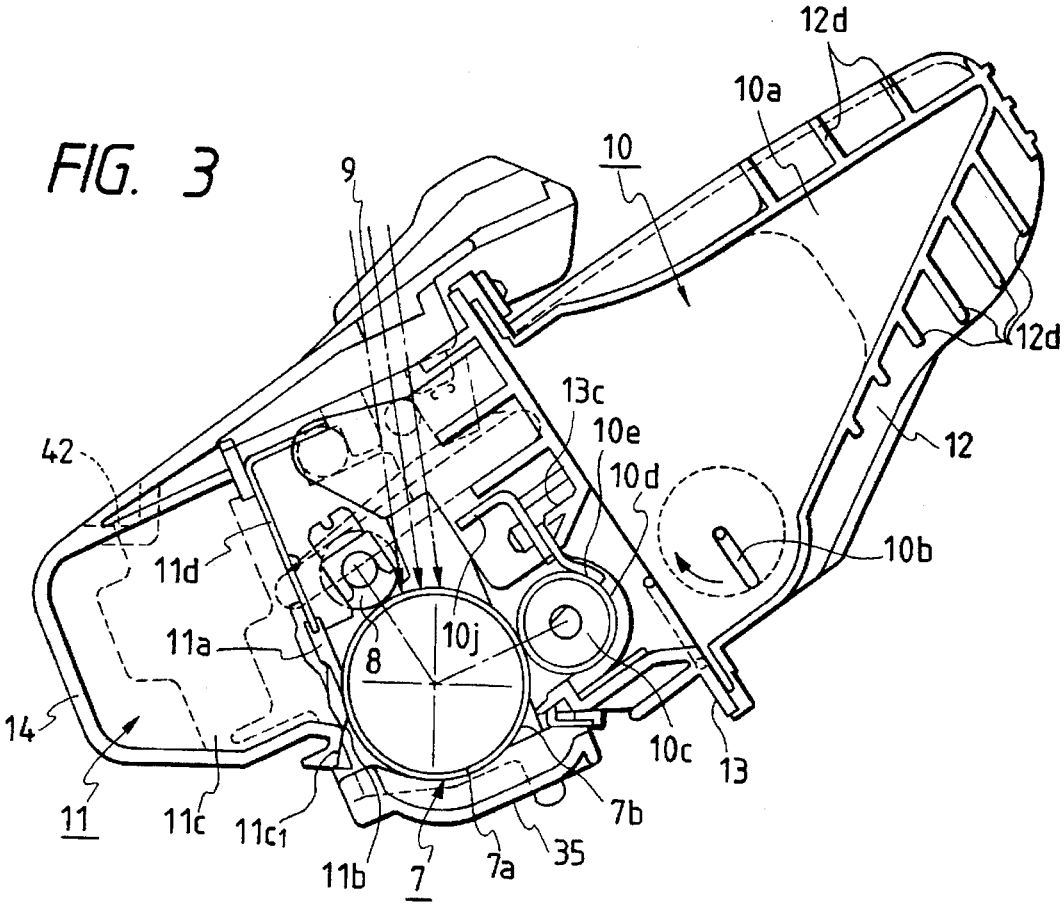
FIG. 3 is a cross-sectional view of the process cartridge.
Figure 4:
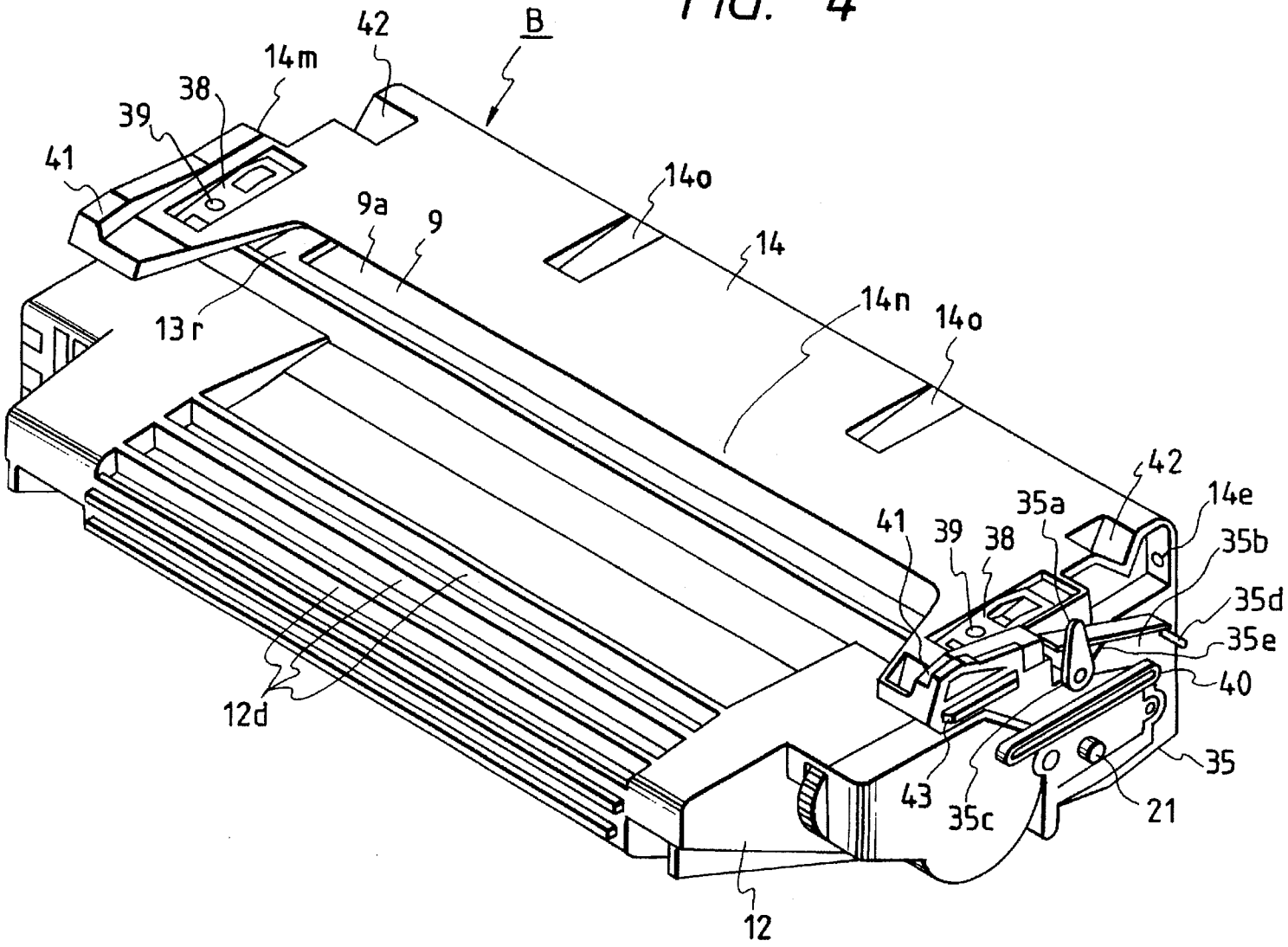
FIG. 4 is a perspective view of the process cartridge.

As shown in FIG. 3, in the process cartridge B providing the image forming station, the rotating photosensitive drum (an example of an image bearing member) 7 is uniformly charged by a charger means 8. The latent image is formed on the photosensitive drum 7 by illuminating the light image from the optical system 1 through an exposure portion 9, and then the latent image is developed by a developing means 10 to visualize the image as a toner image. The toner image is then transferred onto the recording medium 2. On the other hand, after the transferring operation, the residual toner remaining on the photosensitive drum 7 is removed by a cleaning means 11.

Incidentally, the process cartridge B comprises a toner frame 12 as a first frame having a toner reservoir, a developing frame 13 as a second frame having a developing sleeve, and a cleaning frame 14 as a third frame having the photosensitive drum 7 and the cleaning means 11 and the like. In FIG. 2, the reference numeral 15*a* denotes an operation portion on which a recording copy number setting button, a density setting button, a test print button, a lamp for informing of the exchange of the cartridge, which will be described later, and the like are provided.

Next, various parts of the image forming apparatus A and the process cartridge B mounted thereto will be fully explained.

{Image Forming Apparatus}

First of all, regarding the various parts of the image forming apparatus A, the optical system, convey means, transfer means, fixing means and cartridge mounting means will be described in order.

(Optical System):

The optical system 1 serves to illuminate the light image onto the photosensitive drum 7 in response to the image information sent from an external device and the like. As shown in FIG. 1, the optical system comprises an optical unit 1*a* in which a polygon mirror 1*b*, a scanner motor 1*c*, a focusing lens 1*d*, a reflection mirror 1*e* and a laser diode 1*f* are accommodated and which is disposed within a frame 15 of the apparatus A.

When an image signal is given from an external device such as a computer, a word processor and the like (refer to host 62 (FIG. 59)), the laser diode 1*f* emits light in response to the image signal, which light is sent to the polygon mirror 1*b* as image light. The polygon mirror 1*b* is rotated at a high speed by the scanner motor 1*c*, and the image light reflected by the polygon mirror 1*b* is illuminated onto the photosensitive drum 7 via the focusing lens 1*d* and the reflection mirror 1*e*, thereby selectively exposing the surface of the photosensitive drum 7 to form a latent image corresponding to the image information on the photosensitive drum 7.

(Recording Medium Convey Means):

Next, the convey means 3 for conveying or feeding the recording medium 2 (for example, an OHP sheet, thin film or the like) will be explained. The convey means 3 according to the illustrated embodiment permits both the manual sheet supply and the cassette sheet supply. As shown in FIG. 1, in the manual sheet supply, one or more of the recording medium 2 is set on a sheet supply tray 3*a* and then the image forming operation is started. As a result, the recording medium 2 on the sheet supply tray 3*a* is sent into the image forming apparatus by the rotation of a pick-up roller 3*b*. Incidentally, when a plurality of recording media 2 are set on the sheet supply tray, the recording media are separated one by one by a pair of separation rollers 3*c*1, 3*c*2, and the separated recording medium is conveyed until a leading end of the recording medium is abutted against a nip between a pair of register rollers 3*d*1, 3*d*2. The paired register rollers 3*d*1, 3*d*2 are rotated in response to the image forming operation to feed the recording medium 2 to an image forming station. Further, after the image formation, the recording medium 2 is conveyed to the fixing means 5, and then is discharged onto the discharge portion 6 by a pair of intermediate discharge rollers 3*e* and a pair of discharge rollers 3*f*1, 3*f*2. Incidentally, guide members 3*g* for guiding the recording medium 2 are arranged between the fixing means and the intermediate discharge rollers and between the intermediate discharge rollers and the paired discharge rollers.

Further, the sheet supply tray 3*a* comprises an inner member 3*a*1 and an outer member 3*a*2. In an inoperative condition, the inner member 3*a*1 is contained in the outer member 3*a*2, and, as shown in FIG. 2, the outer member 3*a*2 constitutes a portion of the frame 15 of the apparatus.

On the other hand, for the cassette sheet supply, as shown in FIG. 1, a mounting portion for a cassette 3*h* is provided at a lower portion within the frame 15. When the manual sheet supply is not effected, the recording media 2 in the cassette 3*h* mounted in the mounting portion are sent to the paired register rollers 3*d*1, 3*d*2 one by one from the uppermost one by the rotation of a pick-up roller 3*i* and a feed roller 3*j*. At a downstream side of the paired register rollers 3*d*1, 3*d*2, the recording medium is conveyed in the same manner as the manual sheet supply. Incidentally, a sensor 3*k* serves to detect the presence/absence of the recording medium 2 in the cassette 3*h*.

(Transfer Means):

The transfer means 4 serves to transfer the toner image formed on the photosensitive drum 7 onto the recording medium 2, and, as shown in FIG. 1, comprises a transfer roller 4. More particularly, the recording medium 2 is urged against the photosensitive drum 7 of the process cartridge B, which is mounted on a mounting means (described later), by the transfer roller 4, and, by applying a voltage having the polarity opposite to that of the toner image formed on the photosensitive drum 7 to the transfer roller 4 (in the illustrated embodiment, by effecting the constant current control with DC voltage of about 1000 V), the toner image on the photosensitive drum 7 is transferred onto the recording medium 2.

(Fixing Means):

The fixing means 5 serves to fix the toner image transferred to the recording medium 2 by the application of the voltage to the transfer roller 4 onto the recording medium 2. As shown in FIG. 1, the fixing means comprises a rotating drive roller 5*a*, and a driven fixing roller 5*b* having a heater 5*c* therein and urged against the drive roller 5*a*. More particularly, while the recording medium 2, to which the toner image was transferred at the image forming station, is being passed between the drive roller 5*a* and the fixing roller 5*b*, the recording medium is subjected to pressure due to the abutment between the rollers 5*a*, 5*b* and heat due to the heating of the fixing roller 5*b*, thereby fixing the transferred toner image to the recording medium 2.

Figure 5:
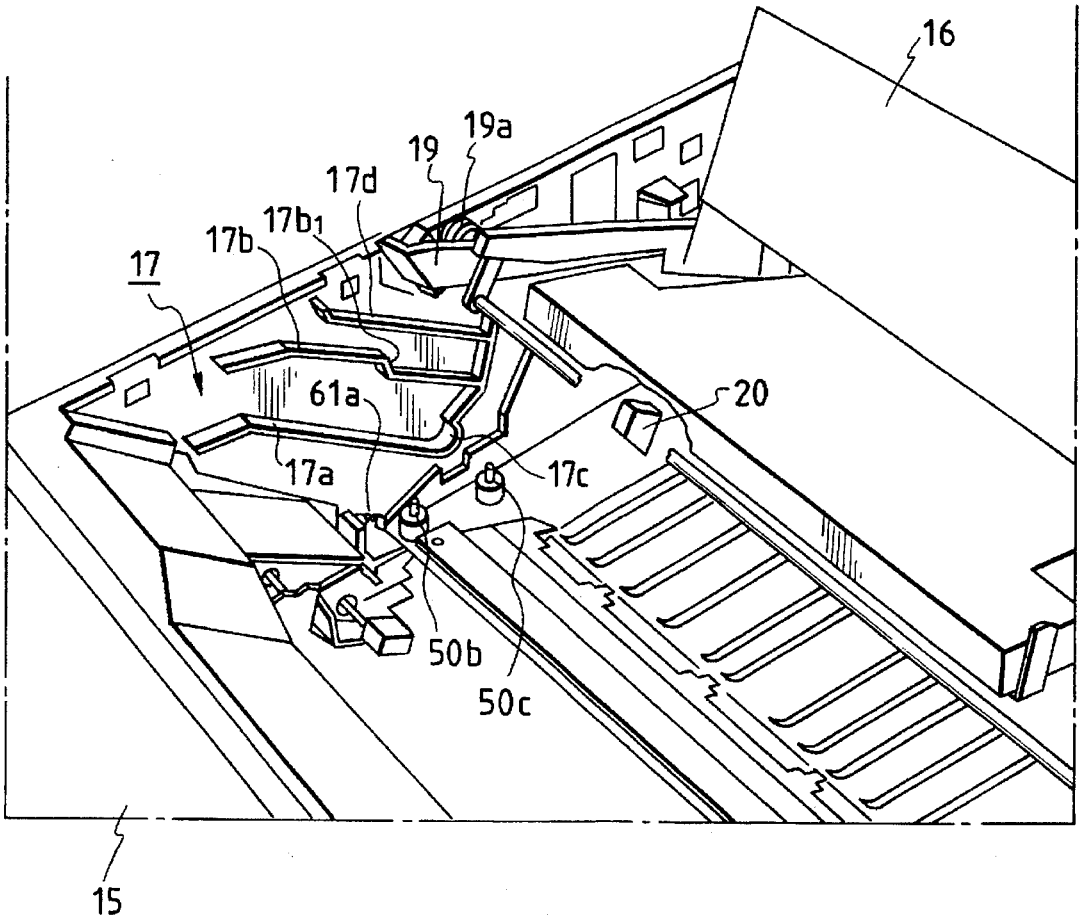
FIG. 5 is a partial view showing a left guide member.
Figure 6:
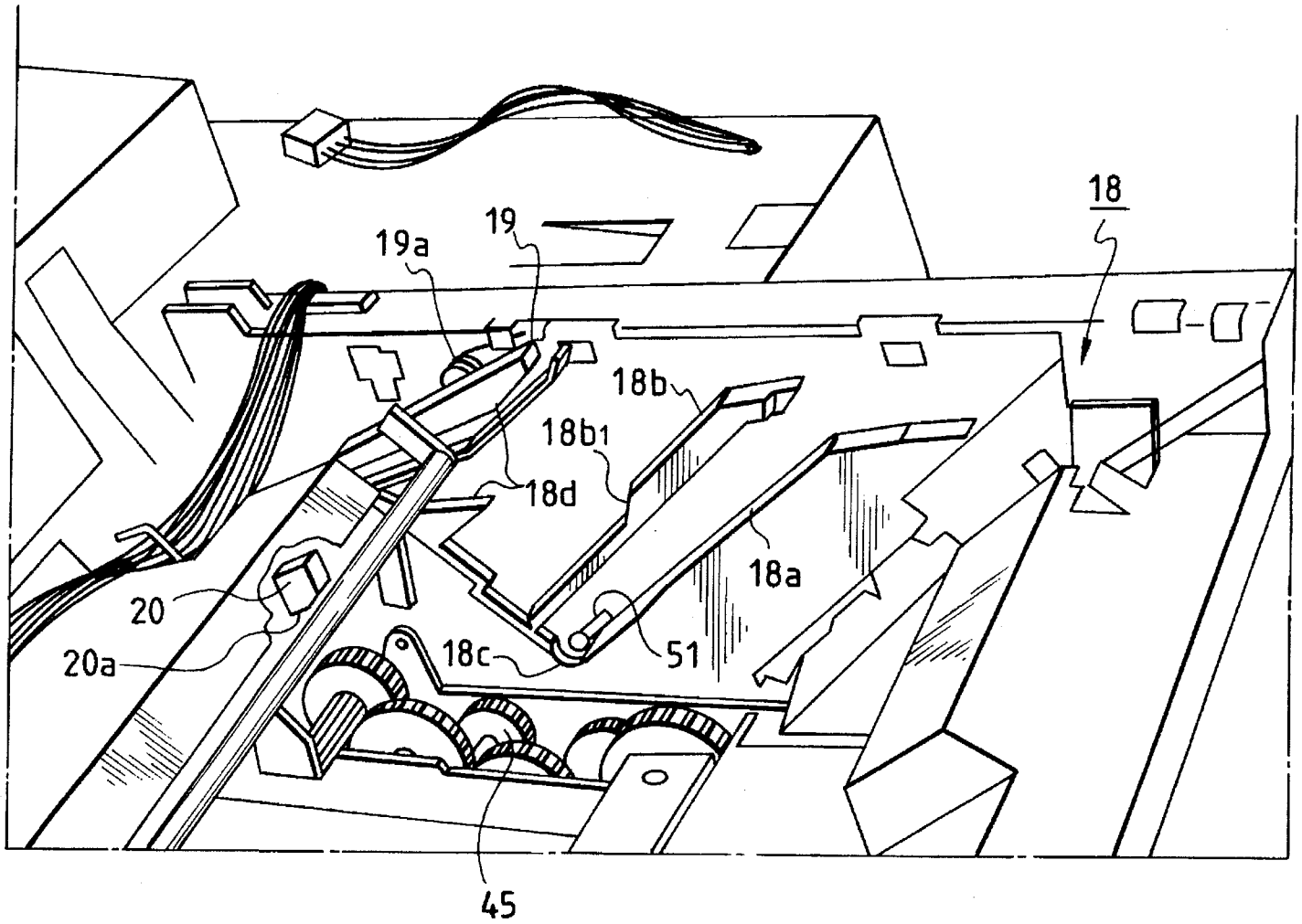
FIG. 6 is a partial view showing a right guide member.

(Cartridge Mounting Means):

The cartridge mounting means for mounting the process cartridge B is provided in the image forming apparatus A. After an opening/closing cover 16 is opened, the mounting or dismounting of the process cartridge B is effected. More particularly, the opening/closing cover 16 is pivotally mounted on an upper part of the frame 15 via hinges 16*a*. On the other hand, as shown in FIGS. 5 and 6, a left guide member 17 and a right guide member 18 are attached to inner side walls. The guide members 17, 18 have first guide portions 17*a*, 18*a* which are inclined forwardly and downwardly, and second guide portions 17*b*, 18*b* which are disposed above the first guide portions. The guide portions 17*a*, 17*b* and 18*a*, 18*b* are arranged with left/right symmetry. Bearing portions 17*c*, 18*c* (described later) for supporting drum bearings of the process cartridge B are formed on ends of the first guide portions 17*a*, 18*a*, respectively, and intermediate stepped portions 17*b*1, 18*b*1 are formed on the second guide portions 17*b*, 18*b*, respectively.

Further, the left guide member 17 has a cartridge rocking movement regulating guide portion 17*d* which is disposed above the second guide portion 17*b*. The right guide member 18 has a shutter cam portion 18*d* for opening and closing a drum shutter 35 of the process cartridge B, which cam portion is disposed above the second guide portion 18*b*.

Further, pressure members 19 are disposed above the rocking movement regulating guide portion 17*d* and the shutter cam portion 18*d*, which pressure members serve to bias the mounted process cartridge B downwardly via torsion coil springs 19*a*. Further, abutment members 20, for positioning the process cartridge B, are arranged at front sides of the left and right guide members 17, 18 (front sides in a cartridge inserting direction).

After the opening/closing cover 16 is opened, the process cartridge B can be mounted within the image forming apparatus while being guided by the first and second guide portions 17*a*, 18*a* and 17*b*, 18*b* of the left and right guide members 17, 18. The mounting operation for the process cartridge will be explained after the construction of the process cartridge is described.

{Process Cartridge}

Next, various parts of the process cartridge B, which is to be mounted to the image forming apparatus A, will be described.

The process cartridge B includes an image bearing member, and at least one process means. The process means may be, for example, a charger means for charging a surface of the image bearing member, a developing means for developing a latent image formed on the image bearing member to form a toner image, a cleaning means for removing residual toner remaining on the image bearing member, and the like. As shown in FIG. 3, the process cartridge B, according to the illustrated embodiment, comprises a charger means 8, exposure portion 9, developing means 10, for performing a developing operation with toner, and cleaning means 11 which are arranged around an electrophotographic photosensitive drum 7 as an image bearing member and which are enclosed by a housing comprising a toner frame 12, developing frame 13 and cleaning frame 14 to form a unit which can be removably mounted to the frame 15 of the image forming apparatus as a process cartridge B.

Next, regarding the various parts of the process cartridge B, the photosensitive drum 7, charger means 8, exposure portion 9, developing means 10 and cleaning means 11 will be fully explained in order.

Figure 7:
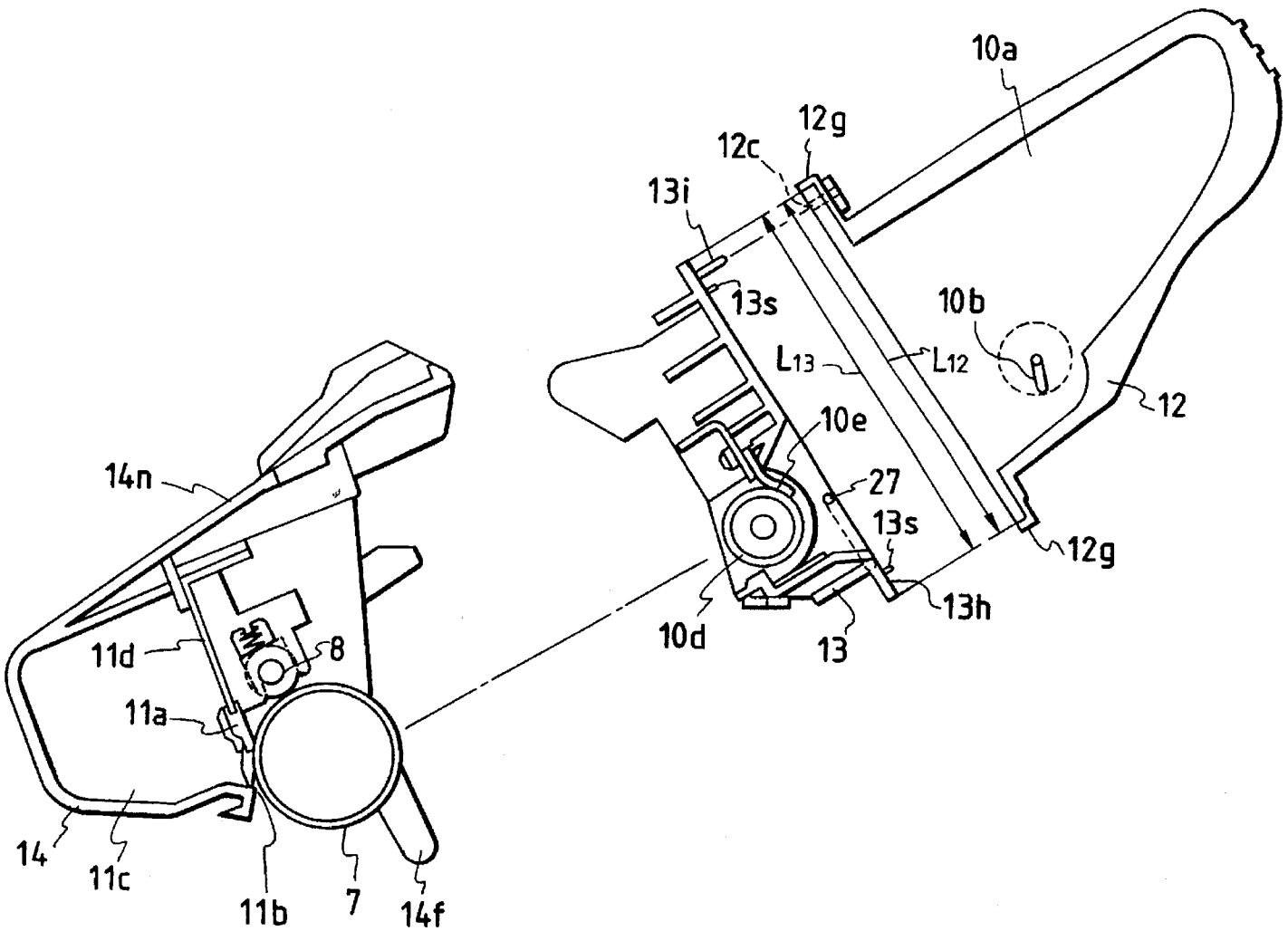
FIG. 7 is an exploded view of the process cartridge showing frames thereof.

(Photosensitive Drum):

The photosensitive drum 7, according to the illustrated embodiment, comprises a cylindrical drum base 17*a* made of aluminium, and an organic photosensitive layer 7*b* coated on an outer peripheral surface of the drum base. As shown in FIG. 7, when the photosensitive drum 7 is attached to the cleaning frame 14 and a driving force of a drive motor 71 (refer to FIG. 59) of the image forming apparatus is transmitted to a helical gear 7*c* (refer to FIG. 8A) secured to one longitudinal end of the photosensitive drum 7, the drum 7 is rotated in a direction shown by the arrow in FIG. 1 in response to the image forming operation.

Figure 8A:
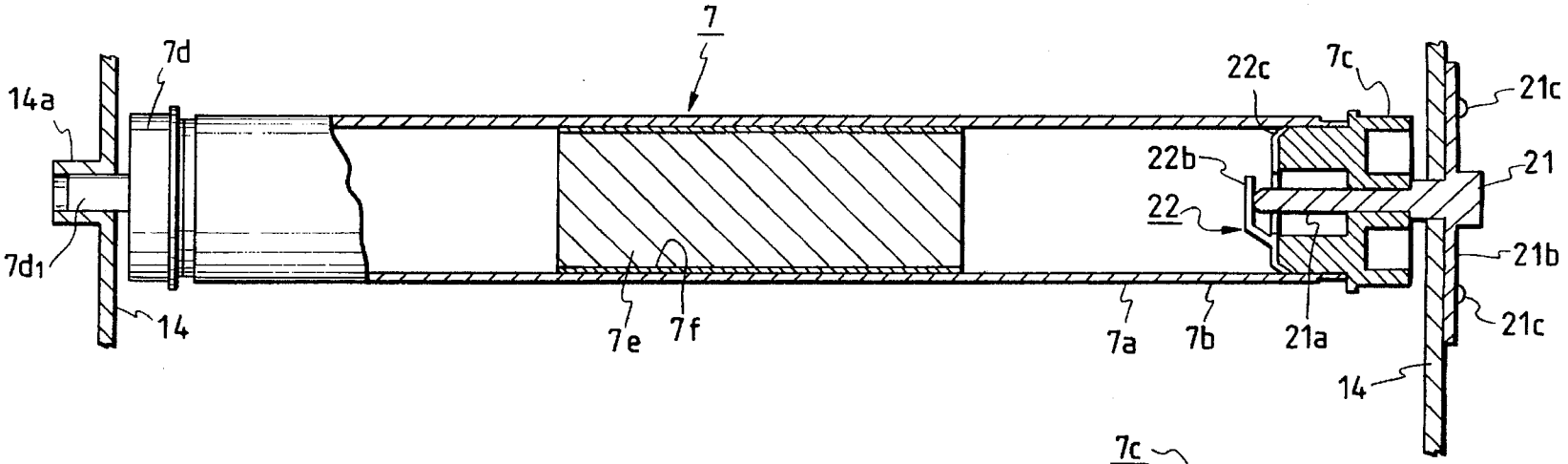
FIG. 8A is a longitudinal sectional view of a photosensitive drum.

Incidentally, as shown by the longitudinal sectional view in FIG. 8A, the photosensitive drum 7 is rotatably attached to the cleaning frame 14 by fitting a boss 7*d*1 of a gear flange 7*d* attached to one longitudinal end of the photosensitive drum into a bearing portion 14*a* of the frame 14 and by inserting a metal (iron in the illustrated embodiment) shaft 21 into a hole formed in a resin helical gear 7*c* attached to the other end of the drum and by securing the shaft 21 to the frame 14. Further, the shaft 21 has an integral shaft portion 21*a* and flange 21*b* and is secured to the frame 14 by securing the flange 21*b* to the frame 14 with screws. Further, the gear flange 7*d* comprises a spur wheel and serves to transmit the rotational force of the photosensitive drum 7 rotated via the helical gear 7*c* receiving the driving force from the image forming apparatus to the transfer roller 4, thereby rotating the latter.

Figure 9:
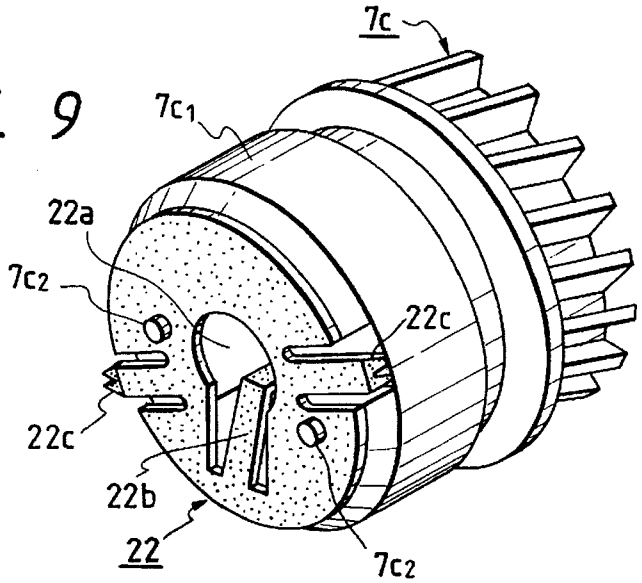
FIG. 9 is a perspective view of a conductive member contacting with a metal shaft.

Further, the metal shaft 21 is a conductive member, and another conductive member 22 (made of bronze phosphide in the illustrated embodiment) is arranged to contact with an inner surface of the aluminium drum base 7*a* of the photosensitive drum at the end thereof into which the metal shaft 21 is inserted, so that, when the metal shaft 21 is inserted, it is contacted with the conductive member 22. Consequently, the photosensitive drum 7 is earthed to the image forming apparatus through the conductive member 22 and the metal shaft 21 as will be described later. That is to say, as shown in FIG. 9, the conductive member 22 is fitted on and secured by bosses 7*c*2, which are formed on a side surface of the flange portion 7*c*1 of the helical gear 7*c*, and has a hole or opening 22*a* into which the metal shaft 21 is to be inserted. Further, a contact portion 22*b*, having a spring feature, is also provided to extend into the opening 22*a*. When the metal shaft 21 is inserted into the opening, it is contacted with the contact member 22*b* while urging the latter. Further, the conductive member 22 is provided with bifurcated pawl portions 22c protruding in the left and right direction, so that, when the flange portion 7c1 is inserted into the photosensitive drum 7, the pawl portions 22c are contacted with the inner surface of the photosensitive drum 7.

In the image forming operation, the photosensitive drum 7 is rotated, and the surface of the photosensitive drum 7 is uniformly charged by applying a DC voltage and an AC voltage in an overlapped fashion to the charger roller 8. Incidentally, in this case, in order to charge the surface of the photosensitive drum 7 uniformly, it is preferable that the DC voltage and AC voltage be applied to the charger roller 8 in the overlapped fashion and that the frequency of the AC voltage be increased. However, if the frequency of the AC voltage exceeds about 200 Hz, then it is feared that a so-called "charging noise" due to the vibration of the photosensitive drum 7 and the charger roller 8 is increased.

More particularly, when the AC voltage is applied to the charger roller 8, an electrostatic attraction force is generated between the photosensitive drum 7 and the charger roller 8, and the attraction force is strong at the maximum and minimum values of the AC voltage, whereby the charger roller 8 is attracted toward the photosensitive drum 7 while deforming elastically. On the other hand, the attraction force is relatively weak at the intermediate value of the AC voltage, with the result that the charger roller 8 tends to separate from the photosensitive drum 7 by the restoring force due to the elastic deformation. Consequently, the photosensitive drum 7 and the charger roller 8 are vibrated at a frequency greater than the frequency of the applied AC voltage by twice. Further, when the charger roller 8 is attracted to the photosensitive drum 7, the rotations of the roller and the drum are braked, thereby generating a vibration due to stick slip (generated as if a wet glass is rubbed by a finger); this vibration causes the charging noise.

Figure 8B:
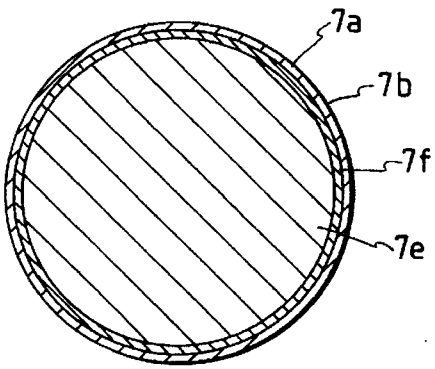
FIG. 8B is a cross-sectional view of the photosensitive drum.

Thus, according to the illustrated embodiment, in order to reduce the vibration of the photosensitive drum 7, as shown by the sectional views in FIGS. 8A and 8B, a filler 7e formed from a rigid body or elastic body is arranged in the photosensitive drum 7 at a central portion in the longitudinal direction thereof. The material of the filler 7e may be metal such as aluminium or brass, or seramics such as cement or gypsum, or rubber such as natural rubber or the like. In consideration of the productivity, workability, and effect of weight and cost, the material of the filler may be appropriately selected among them. Incidentally, in the illustrated embodiment, the filler 7e is made of aluminium having a weight of about 120 grams.

The shape or configuration of the filler 7e may be solid cylindrical or hollow cylindrical (in the illustrated embodiment, as shown in FIG. 8B, the filler is formed as a solid cylinder). For example, the filler 7e, having an outer diameter smaller than an inner diameter of the photosensitive drum 7 by about 100 μm, is inserted into the hollow drum base 7a, thus attaching the filler to the photosensitive drum. That is to say, the gap between the drum base 7a and the filler 7e is kept to 100 μm at the maximum, and an adhesive (for example, cyanoacrylate group, epoxy resin group or the like) is applied to an outer surface of the filler or the inner surface of the drum base 7a, thereby adhering the filler 7e to the inner surface of the drum base 7a.

As mentioned above, by providing the filler 7e in the photosensitive drum 7, the photosensitive drum 7 is rotated stably, thereby suppressing the vibration due to the rotation of the photosensitive drum 7 during the image forming operation. As a result, even when the frequency of the AC voltage applied to the charger roller 8 is increased, it is possible to suppress the charging noise.

Figure 10:
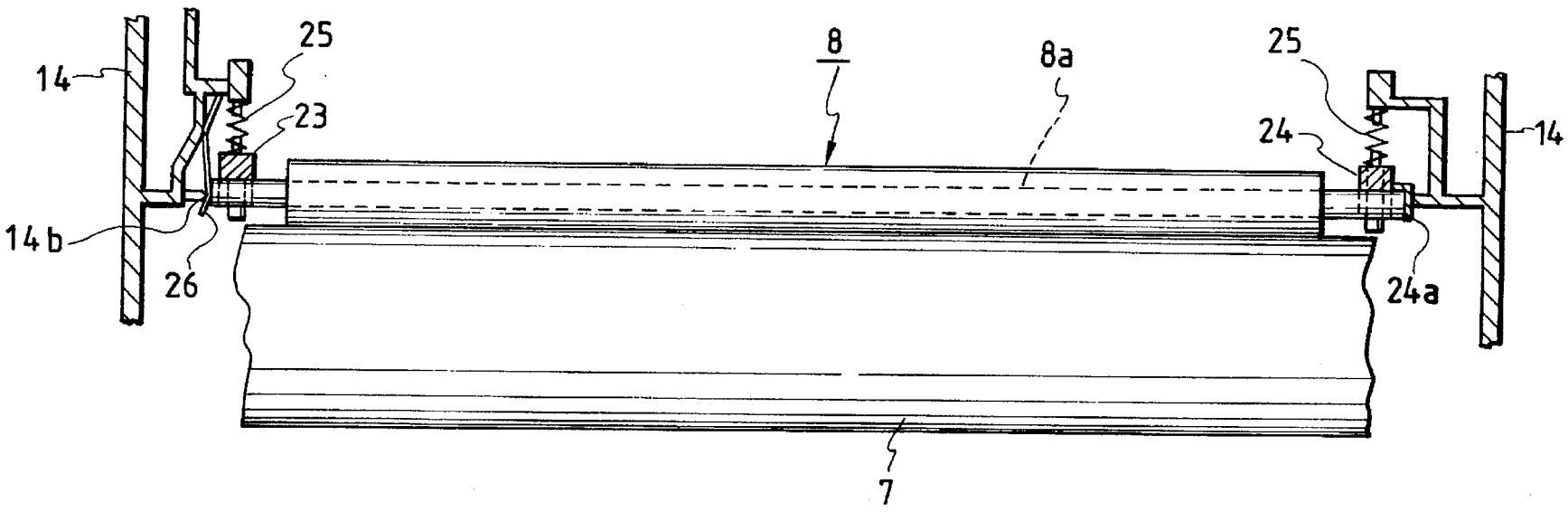
FIG. 10 is a view showing a charger roller and bearings therefor.

(Charger Means):

The charger means serves to charge the surface of the photosensitive drum 7. In the illustrated embodiment, a charging method of a so-called contact type as disclosed in the Japanese Patent Laid-open No. 63-149669 is used. More particularly, as shown in FIG. 10, the charger roller 8 is rotatably mounted on the cleaning frame 14. The charger roller 8 comprises a metal roller shaft 8a, an elastic conductive layer around the roller shaft, a high resistive elastic layer around the conductive layer, and a protection film around the high resistive layer. The elastic conductive layer is formed from an elastic rubber layer made of EPDM or NBR dispersing carbon powder therein, and acts to direct the bias voltage to the roller shaft 8a. Further, the high resistive elastic layer is made of urethane rubber dispersing a small amount of conductive fine powder (for example, carbon powder), and acts to prevent the abrupt reduction of the bias voltage by limiting the leak current to the photosensitive drum 7 even when the charger roller having high conductivity, such as a pin hole, is opposed to the photosensitive drum 7. Further, the protection film is made of N-methyl methoxyl nylon and acts to prevent the deterioration of the surface of the photosensitive drum 7 if the plastic material of the conductive elastic layer and/or the high resistive elastic layer is contacted with the photosensitive layer.

The roller shaft 8a is attached to the frame 14 via bearings 23, 24 slidable slightly toward the photosensitive drum 7, which bearings are biased toward the photosensitive drum 7 by springs 25, thereby contacting the charger roller 8 with the photosensitive drum 7.

In the image forming operation, the charger roller 8 is rotatingly driven by the rotation of the photosensitive drum 7 while applying the DC voltage and AC voltage in the overlapped fashion to the charger roller 8 as mentioned above, thereby uniformly charging the surface of the photosensitive drum 7. To this end, a metal contact member 26, having a spring feature, is contacted with one end of the metal roller shaft 8a, thereby permitting the application of the voltage from the image forming apparatus to the charger roller 8.

Further, a regulating member 14b, for suppressing the deformation of the contact member 26, is formed on the cleaning frame 14 so that, even if any force directing toward the left in FIG. 10 is applied to the roller shaft 8a resulting from the dropping of the process cartridge B or the like, the contact member 26 is prevented from being deformed plastically by contacting the contact member 26 against the regulating member 14b. Further, since the regulating member 14b limits the axial movement (toward the left in FIG. 10) of the charger roller 8, the charger roller 8 is always maintained on the photosensitive drum 7.

On the other hand, the positioning of the other end of the charger roller 8 is effected by the bearing 24. That is to say, as shown in FIG. 10, the bearing 24 has a hooked abutment portion 24a integrally formed therewith. By abutting the other end of the roller shaft 8a of the charger roller 8 against the abutment portion 24a, the right (FIG. 10) axial movement of the charger roller 8 is limited. The bearing 24 is made of polyacetal (POM) which has a good anti-wear feature and provides good slidability with respect to the metal roller shaft 8a.

As mentioned above, both ends of the roller shaft 8a are abutted against the anti-wear bearing 24 and the contact member 26 to limit the axial movement of the charger roller 8, thereby preventing the roller shaft 8a from contacting with the frame 14. If the axial movement of the charger roller 8 is limited by abutting the ends of the roller shaft 8*a* against the frame 14 directly, the frame 14 must be made from material such as polyphenylene oxide resin (PPO) having a good anti-wear feature with respect to the metal roller shaft 8*a*. To the contrary, as in the illustrated embodiment, when the roller shaft 8*a* is not directly contacted with the frame 14, it is not necessary to increase the anti-wear ability of the frame 14. Thus, in the illustrated embodiment, the frame 14 can be made of polystyrene resin (PS) which is less expensive, rather than PPO, thereby reducing the manufacturing cost of the process cartridge B.

Incidentally, the material of the bearing 24 is not limited to polyacetal, but may be other material such as nylon, so long as the material has a high anti-wear ability with respect to the metal roller shaft 8*a*.

According to the illustrated embodiment, the voltage applied to the charger roller 8, to charge the photosensitive drum 7, has an AC component Vpp of about 1800 V and DC component VDC1 of about −670 V, and constant current control is effected.

(Exposure Portion):

The exposure portion 9 serves to form an electrostatic latent image on the photosensitive drum 7 that is uniformly charged by the charger roller 8, by exposing a light image from the optical system 1 onto the photosensitive drum. As shown by the perspective view in FIG. 4, the exposure portion is constituted by an opening portion 9 which is formed in an upper surface between the developing frame 13 and the cleaning frame 14 and through which the image light passes. That is to say, by providing a rectangular notch 9*a* in an upper surface 13*r* of the developing frame 13 and by arranging an upper wall portion 14*n* of the cleaning frame 14 to cover a portion of the notch 9*a*, the exposure portion 9 is formed.

(Developing Means):

Next, the developing means will be explained. The developing means serves to visualize the electrostatic latent image formed on the photosensitive drum 7 by the aforementioned exposure with toner to form a toner image. Incidentally, although the image forming apparatus A can utilize both magnetic toner and non-magnetic toner, in the illustrated embodiment, an example of a process cartridge B, which contains magnetic toner as a one-component magnetic developer and that is mounted to the image forming apparatus, is shown.

The magnetic toner used in the developing operation utilizes polystyrene resin as the binding resin, and preferably utilizes styrene acrylic resin. Coloring material, which can be added to the magnetic toner, may be conventional carbon black, copper phthalocyanine, iron black or the like.

Further, magnetic fine particles included in the magnetic toner are made from material which can be magnetized in the magnetic field and which may be ferromagnetic metal powder such as iron, cobalt, nickel, or alloy or compound such as magnetite or ferrite.

As shown by the sectional view in FIG. 3, the developing means 10 for forming the toner image with the magnetic toner has a toner reservoir 10*a* for containing toner, and a toner feed member 10*b* for feeding out the toner that is disposed in the toner reservoir 10*a*, which feed member is rotated in a direction shown by the arrow. Further, by using the fed out toner and by rotating a developing sleeve 10*d* having a magnet 10*c* therein, a thin toner layer is formed on the developing sleeve. When the toner layer is formed on the developing sleeve 10*d*, a friction charging charge sufficient to develop the electrostatic latent image on the photosensitive drum 7 can be obtained due to the friction between the toner and the developing sleeve 10*d*. Further, a developing blade 10*e* for regulating a thickness of the toner layer is provided to abut against the surface of the developing sleeve 10*d*.

In the illustrated embodiment, as the developing bias, an AC component Vpp of about 1600 V and the DC component VDC2 of about −500 V are applied. Incidentally, in a relation between the DC component VDC2 of this developing bias and the DC component VDC1 of the aforementioned charging bias, if a value (VDC1−VDC2) becomes greater than −50 V (becomes greater toward the plus side), it is possible that fogging may occur.

Incidentally, the toner reservoir 10*a* and the toner feed member 10*b* are formed in the toner frame 12; whereas, the developing sleeve 10*d* and the developing blade 10*e* are attached to the developing frame 13. Longitudinal abutment portions of the frames 12 and 13 are bonded to each other by ultrasonic welding, thereby integrally connecting these frames.

The developing sleeve 10*d* on which the toner layer is formed and the photosensitive drum 7 are positioned to be spaced apart from each other with a small gap (about 250 μm). To this end, in the illustrated embodiment, as shown by the exploded perspective view in FIG. 11, abutment rings 10*f*, each having an outer diameter greater than an outer diameter of the developing sleeve 10*d* by a value corresponding to the above-mentioned gap, are arranged in the vicinity of both axial ends of the developing sleeve 10*d* and out of a toner forming area on the developing sleeve, which abutment rings are abutted against the photosensitive drum 7 out of a latent image forming area thereon.

Further, a gear (helical gear) 10*g* is attached to one axial end of the developing sleeve 10*d* so that the gear 10*g* can be rotated together with the developing sleeve 10*d*. When the developing frame 13 is bonded to the cleaning frame 14, the gear 10*g* is meshed with the helical gear 7*c* of the photosensitive drum 7 so that the developing sleeve 10*d* can be rotated by the rotation of the photosensitive drum 7. Further, the gear 10*g* is meshed with a gear (not shown) connected to the toner feed member 10*b*, thereby transmitting the rotational force of the photosensitive drum 7 to the toner feed member 10*b*.

With this arrangement, in the image forming operation, by the rotation of the toner feed member 10*b*, the toner in the toner reservoir 10*a* is sent to the developing sleeve 10*d*, where a toner layer having a constant thickness is formed on the developing sleeve 10*d* by the developing blade 10*e*, and then the toner on the developing sleeve is transferred onto the electrostatic latent image formed on the photosensitive drum 7. Incidentally, the formation of the toner layer on the developing sleeve 10*d* is effected by supplying the toner to only a carbon coating area of the developing sleeve 10*d*, and a relation between (a) the photosensitive layer area on the photosensitive drum 7 along its longitudinal (axial) direction and (b) the charging area affected by the charger roller 8 and (c) the toner layer forming area (developing area) on the developing sleeve 10*d* is so selected to become (a)>(b)>(c).

Figure 11:
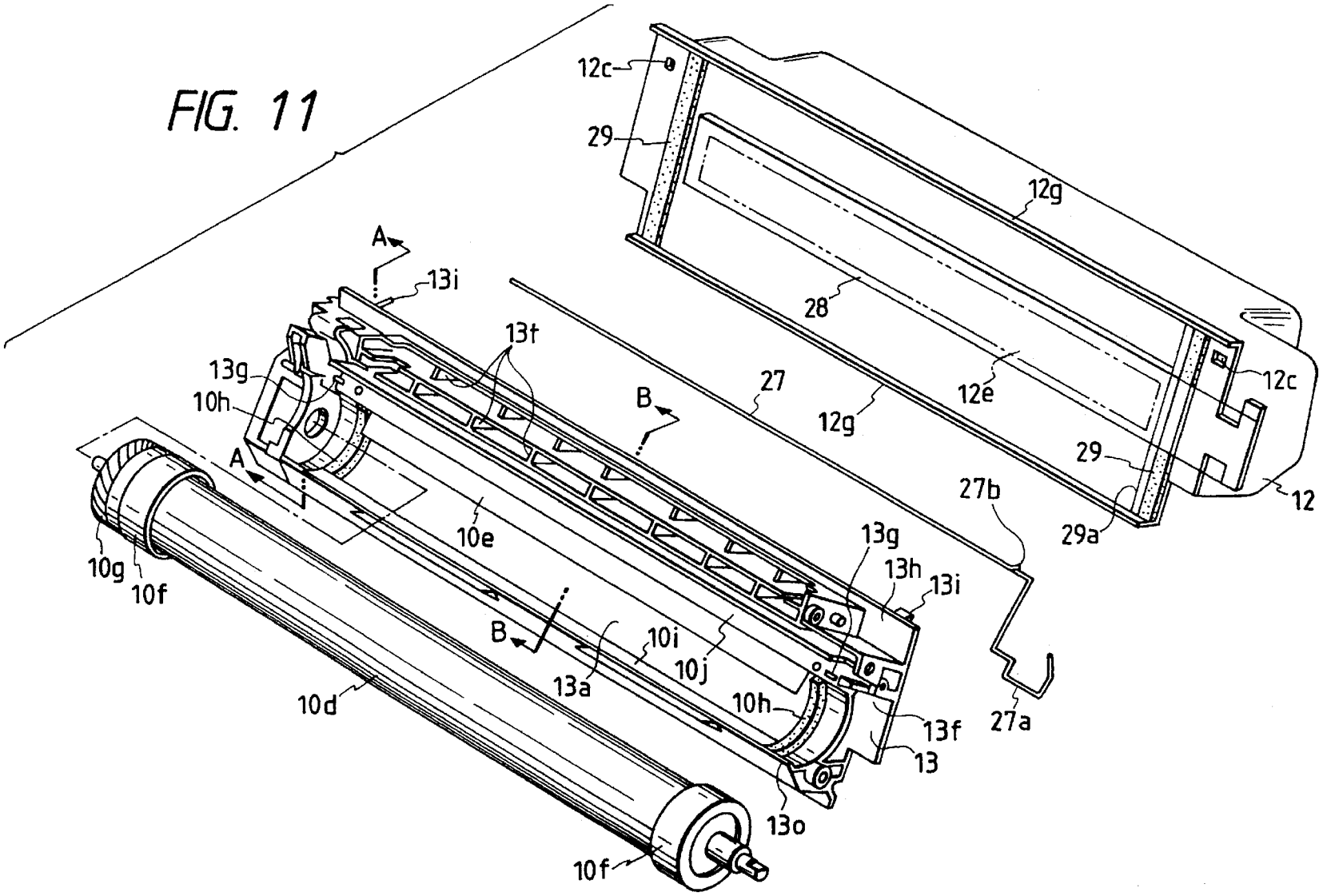
FIG. 11 is an exploded perspective view showing an overlapping relation between a blow sheet and toner leak preventing seals.

Incidentally, the toner in the toner reservoir 10*a* must be prevented from leaking between the developing sleeve 10*d* and the developing frame 13. To this end, in the illustrated embodiment, as shown in FIG. 11, toner leak preventing elastic seals 10*h* are arranged on both longitudinal end portions of an opening 13*a* which is formed in the developing frame 13 and through which the toner is fed toward the developing sleeve 10*d*, and an elastic blow sheet 10*i* is arranged along a lower edge of the opening 13*a* to contact with the whole length of the developing sleeve 10*d*.

Now, a thickness of each toner leak preventing seal 10h is equal to a thickness of a stepped portion formed on a lower edge 13o of the developing frame 13 so that, when the toner leak preventing seals 10h are adhered to the developing frame 13, the upper surfaces of the seals 10h become flush with the lower edge 13o. The blow sheet 10i is adhered to an upper surface of the lower edge portion 13o by a both-sided adhesive tape (not shown). A (longitudinal) length of the blow sheet 10i is longer than a (longitudinal) length of the opening 13a, and both longitudinal end portions of the blow sheet are overlapped with the toner leak preventing seals 10h, and a (widthwise) free edge of the blow sheet is urged against the peripheral surface of the developing sleeve 10d along its length with an appropriate urging force.

Figure 12:
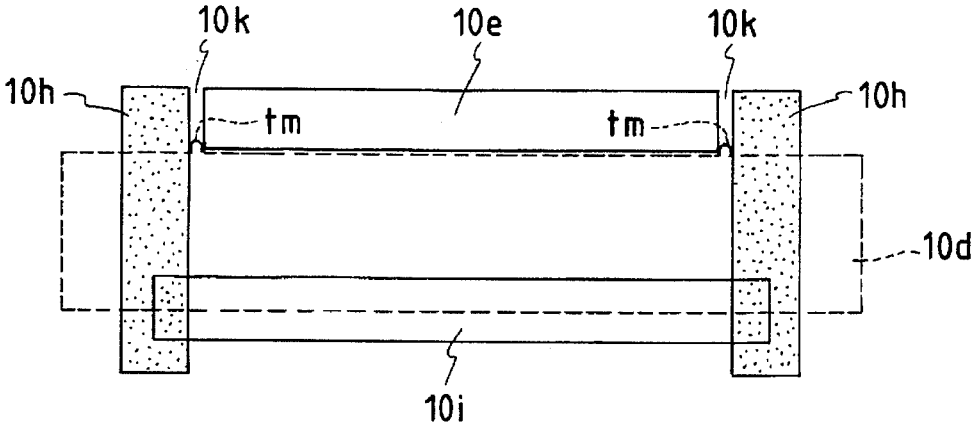
FIG. 12 is a view showing a positional relation between a developing blade and the toner leak preventing seals and the blow sheet.

The overlapped relation between the blow sheet and the toner leak preventing seals will now be fully described. Since the thickness of the developing blade 10e is about 13 mm, as shown in FIG. 12, both longitudinal end portions of the developing blade 10e and the toner leak preventing seals 10h cannot be overlapped, with the result that a small gap 10k is created between the end of the developing blade and each toner leak preventing seal. And, the toner leak preventing seals 10h are overlapped with the blow sheet 10i at areas that are axially outward of the gaps 10k.

Thus, when the toner layer is formed on the developing sleeve 10d, the toner tm passing through the gaps 10k is adhered to the developing sleeve 10d in a swelled condition. However, since there is no toner leak preventing seals 10h in the rotating areas of the toner tm, the toner tm is collected to the toner reservoir 10a through the blow sheet 10i, thereby preventing the toner from leaking out of the cartridge.

Figure 13A:
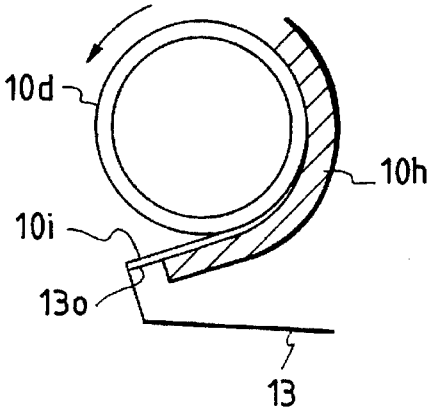
FIG. 13A is a sectional view taken along the line A—A in FIG. 11.
Figure 13B:
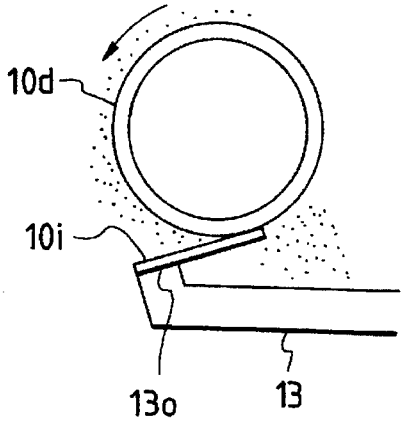
FIG. 13B is a sectional view taken along the line B—B in FIG. 11.
Figure 14A:
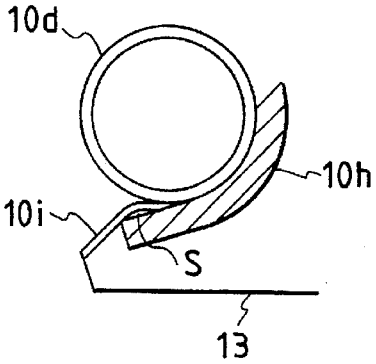
FIGS. 14A and 14B are views showing a case where a blow sheet is bent.
Figure 14B:
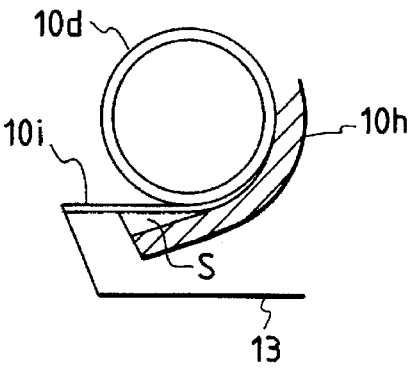

Further, FIG. 13A shows a section taken along the line A—A in FIG. 11, and FIG. 13B shows a section taken along the line B—B in FIG. 11. As shown in FIG. 13A, the toner leak preventing seals 10h and the blow sheet 10i are closely contacted with each other without bending at the overlapped areas, and they become parallel with each other. If the blow sheet 10i is bent so as not to be in close contact with the toner leak preventing seals 10h, as shown in FIGS. 14A and 14B, it is possible that the toner will leak between a gap formed between the seals and the sheet. However, in the illustrated embodiment, since the blow sheet 10i is not bent and is closely contacted with the toner leak preventing seals 10h, the risk of the leakage of toner can be avoided.

Further, in the illustrated embodiment, an abutment angle between the free edge portion of the blow sheet 10i and the peripheral surface of the developing sleeve 10d is defined by the upper surfaces of the toner leak preventing seals 10h, and there is no dispersion in the accuracy of the upper surfaces of the toner leak preventing seals. Thus, there is substantially no dispersion in the initial setting accuracy of the abutment angle. Further, since the blow sheet 10i is used in the straight condition, the abutment angle of the blow sheet 10i is difficult to change for a long time. Thus, it is hard for the toner contained in the toner reservoir 10a to, leak between the blow sheet 10i and the developing sleeve 10d.

Incidentally, regarding the leakage of toner, it is possible that the toner may leak between the developing blade 10e and the developing frame 13. To avoid this, in the illustrated embodiment, as shown by the sectional views in FIGS. 3 and 15, three longitudinal ribs 13b, 13c, 13d are formed on a portion of the developing frame 13 against which the developing blade 10e is abutted, so that the first and second ribs 13b, 13c are abutted against the developing blade 10e and the third rib 13d is abutted against a blade attachment member 10j, such as a metal plate, for attaching the developing blade 10e. Further, a free edge of the second rib 13c abutted against the developing blade 10e is sharpened so that, when the first rib 13b is abutted against the developing blade 10e and the third rib 13d is abutted against the blade attachment member 10j, the sharpened edge of the second rib 13c is penetrated into the developing blade made of rubber having a thickness of about 1.3 mm.

Further, the sharpened edge of the second rib 13c is curved so that a central portion of the edge in the longitudinal direction is convexly protruded slightly more than both end portions of the edge. Now, when the developing blade 10e is attached to the developing frame 13, since portions of the blade attachment member 10j, near both longitudinal edges, are secured by screws, the longitudinal central portion of the developing blade attached to the blade attachment member may be deflected. However, according to the above arrangement, even if the central portion of the blade is deflected, since the edge of the second rib 13c is curved so that the central portion is protruded more than both end portions (in a process cartridge capable of recording an image on A4 size sheet, it is preferable to protrude by 0.1–0.5 mm), the rib 13c can be surely penetrated into the developing blade 10e along its whole longitudinal edge. Accordingly, there is no gap between the developing frame 13 and the blade 10e, thus preventing the toner from leaking between the blade and the developing frame.

If a gap is created between the second rib 13c and the developing blade 10e and the toner is leaked therebetween, since the third rib 13d is abutted against the blade attachment member 10j, the leakage of toner is prevented by the third rib. Particularly, since the abutment area between the second rib 13c and the developing blade 10e is offset (i.e. not aligned) with respect to the abutment area between the third rib 13d and the blade attachment member 10j by an amount corresponding to the thickness of the developing blade 10e, it is hard for the toner to leak out of the cartridge through both the abutment area between the second rib 13c and the developing blade 10e and the abutment area between the third rib 13d and the blade attachment member 10j.

Figure 15:
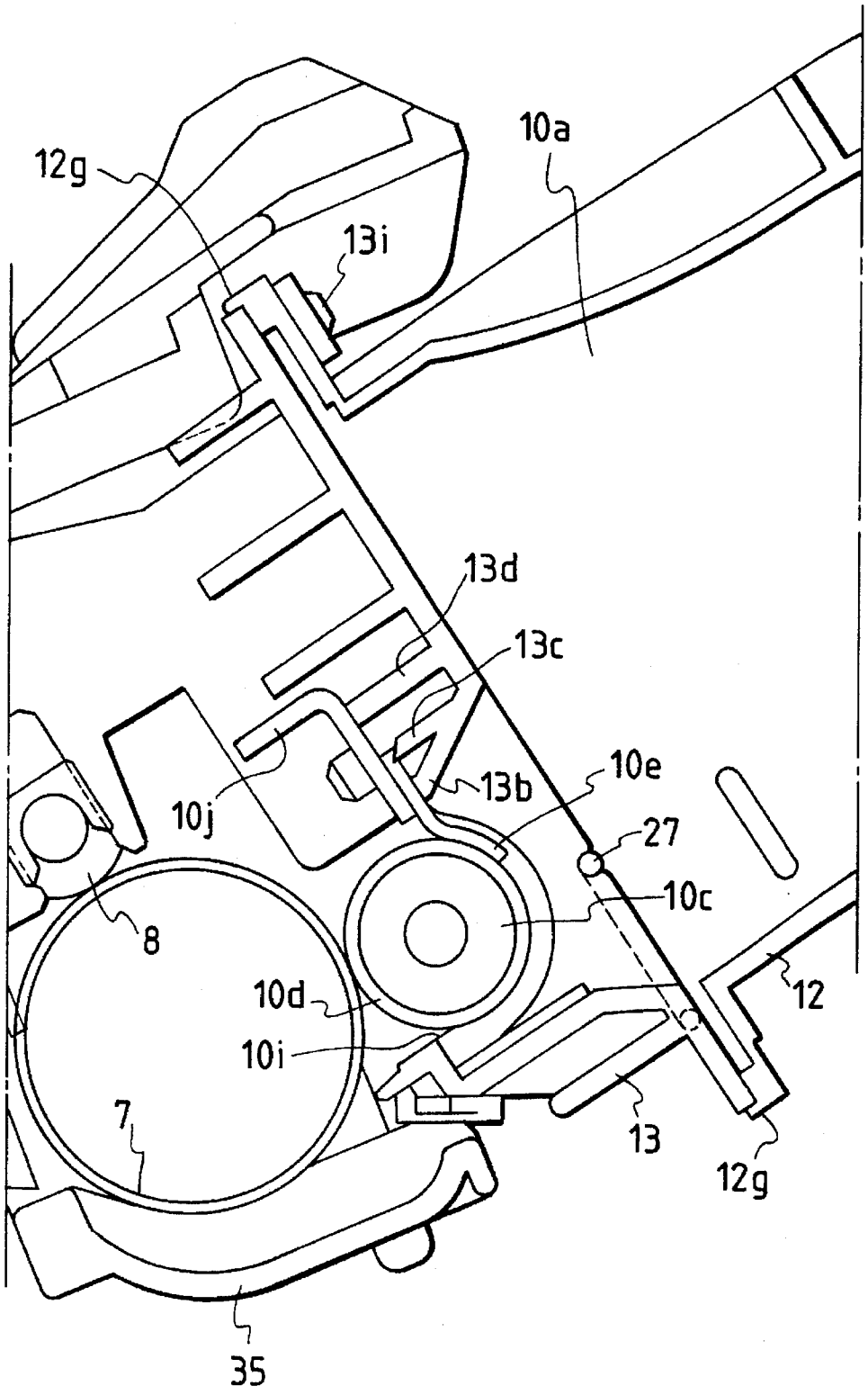
FIG. 15 is an enlarged sectional view showing a condition that a sharp rib is penetrated into a developing blade.

Further, in the developing means 10 according to the illustrated embodiment, there is provided a toner remaining amount detection mechanism for detecting the toner remaining in the toner reservoir 10a. As shown in FIGS. 11 and 15, this mechanism comprises a metallic antenna wire 27 arranged at a jointed zone between the toner frame 12 and the developing frame 13 and in a toner passage from the toner reservoir 10a to the developing sleeve 10d. By having the antenna wire 27 act as a first electrode and the developing sleeve 10d as a second electrode, a voltage is applied between the first and second electrodes. In this case, if there is any toner between the electrodes, the electrostatic capacity therebetween will be increased; whereas, if there is no toner between the electrodes, the electrostatic capacity will be decreased. Accordingly, by detecting the change in the electrostatic capacity by a control portion 60 (refer to FIG. 59), it is possible to detect the toner remaining amount. By comparing an electric signal representative of the electrostatic capacity with a predetermined reference value, it is possible to detect a "no toner" condition. When the "no toner" condition is detected by the control portion 60, for example, a lamp (alarm for process cartridge exchange) is lightened to inform an operator of the need for exchanging the process cartridge B. Incidentally, a concrete circuit for detecting the amount of toner remaining will be described later.

Regarding the jointed zone between the toner frame 12 and the developing frame 13, since the longitudinal jointed area is welded, the toner cannot leak through this jointed area. However, the widthwise jointed areas cannot be welded, because, as shown in FIG. 11, an opening 12*e* formed in the toner frame 12 is sealingly covered by a cover film 28 to prevent the leakage of the toner in the toner reservoir 10*a* of the process cartridge B and a free end of the cover film 28 is exposed outwardly through the widthwise jointed area (between the frames 12, 13) so that in use the operator can pull the free end of the cover film 28 to open the opening 12*e*. Therefore, in order to prevent the toner from leaking through the widthwise jointed areas between the toner frame 12 and the developing frame 13, toner leak preventing seals 29 are disposed at the widthwise jointed areas.

Figure 16:
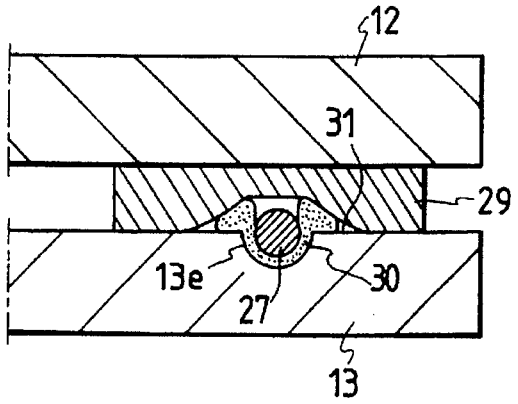
FIG. 16 is a sectional view showing a condition that an adhesive for an antenna wire is swollen.

However, as mentioned above, since the voltage is applied to the antenna wire or line 27, one end of the antenna line 27 must be protruded outwardly through the jointed zone between the frames 12, 13 and a contact portion 27*a* is formed on the end of the antenna line. To this end, the antenna line 27 must be protruded outwardly through the widthwise jointed area (between the toner frame 12 and the developing frame 13) where the toner leak preventing seal 29 is adhered. In order to attach the antenna line 27 in this way, as shown in FIG. 16, a recess 13*e* is formed in the developing frame 13 at its jointed zone, and an adhesive 30 such as silicone is coated on the surface of the recess 13*e*, and then the antenna line 27 is adhered to the developing frame 13 by inserting the antenna line into the recess. When the antenna line 27 is inserted into the recess 13*e*, as shown in FIG. 16, the adhesive 30 coated on the surface of the recess 13*e* is projected from the recess and swollen. If the adhesive 30 is cured in the swelled condition, even when the toner leak preventing seal 29 is adhered to the frame 13, the seal 29 cannot be closely contacted with the developing frame 13 completely, thereby often creating a clearance 31. Although such clearance 31 is small, since the toner comprises fine particles, so it is possible for the toner to leak through the clearance 31.

Figure 17A:
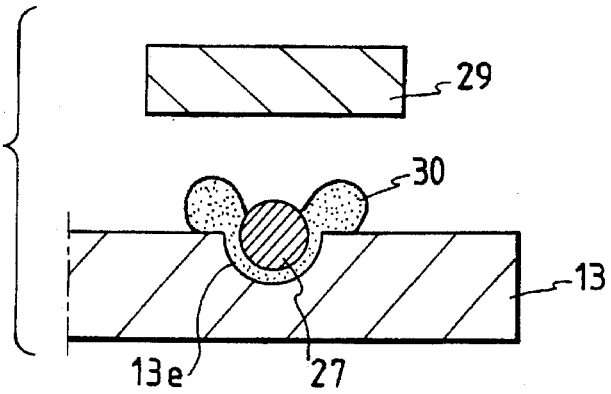
FIG. 17A is a view showing a condition that the adhesive is swollen by fitting the antenna wire.
Figure 17B:
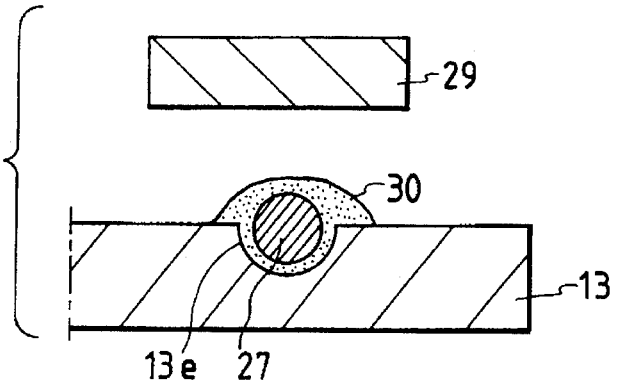
FIG. 17B is a view showing a condition that the swelled adhesive is averaged.
Figure 17C:
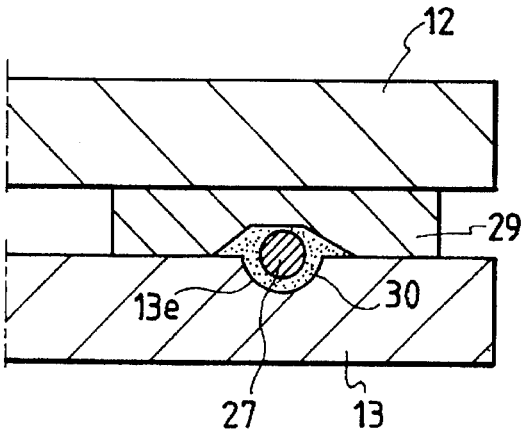
FIG. 17C is a view showing a condition that a seal is attached.

To avoid this, in the illustrated embodiment, as shown in FIG. 17A, after the antenna line 27 is inserted into the recess 13*e* having the adhesive 30 therein, the adhesive swollen from the recess 13*e* is flattened or averaged along and on the antenna line 27 (as completely covering the antenna line 27) by a rod member or the like as shown in FIG. 17B. Thereafter, as shown in FIG. 17C, when the toner leak preventing seal 29 is adhered to the frame 13, the seal 29 can be closely contacted with the surface (to be jointed) of the developing frame 13 without any clearance, thereby preventing the leakage of toner completely. Incidentally, when the swelled adhesive 30 is averaged as shown in FIG. 17B, new adhesive may be added to average the adhesive and completely cover the antenna line 27.

Figure 18A:
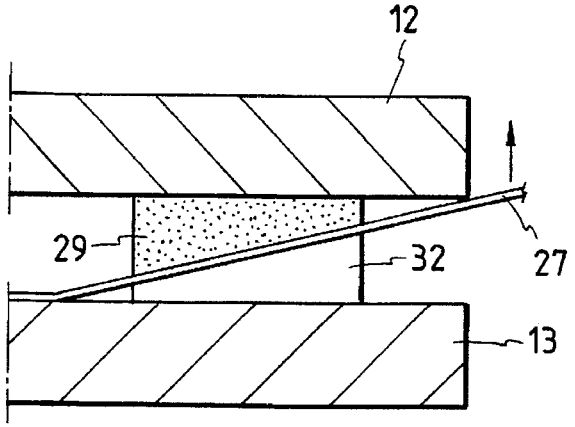
FIG. 18A is a view showing the antenna wire which is not bent.
Figure 18B:
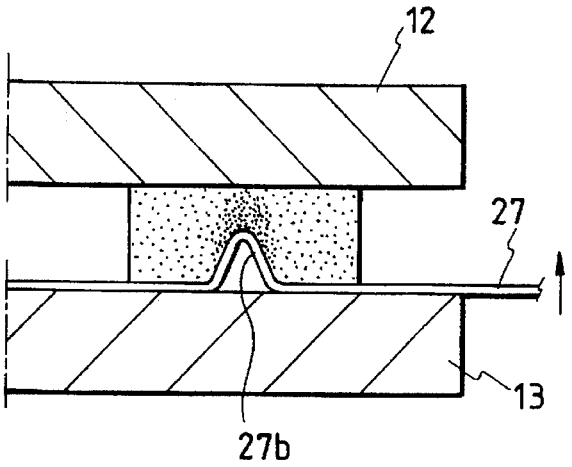
FIG. 18B is a view showing the antenna wire which is bent.

Further, the contact portion 27*a* of the antenna line 27 is exposed outwardly. Therefore, it is feared that the exposed portion of the antenna line 27 is erroneously struck against any body by the operator during the handling of the process cartridge B. Since the toner leak preventing seal 29 is made of foam urethane having a thickness of about 4 mm and is elastic, if the exposed portion of the antenna line 27 is struck against any body, as shown in FIG. 18A, it is possible for the antenna line 27, to float from the developing frame 13. Also in this case, a small clearance 32 is created between the frame 13 and the antenna line 27, resulting in the leakage of toner. To avoid this, in the illustrated embodiment, as shown in FIG. 18B, a bent portion 27*b* bent in an L-shape directing from the developing frame 13 to the toner frame 12 is formed on the antenna line 27 disposed in the jointed zone between the toner frame 12 and the developing frame 13. At this bent portion 27*b*, since the seal 29 having the thickness of about 4 mm is compressed up to about 1 mm, elastic deformation does not occur. Accordingly, if a shock acts on the exposed portion of the antenna line 27, as mentioned above, the antenna line 27 does not float from the recess 13*e* of the developing frame 13. Thus, since the clearance as shown in FIG. 18A is not created, the risk of the leakage of the toner can be avoided.

(Toner Leak Preventing Seal):

Next, the toner leak preventing seal 29 will be explained. The toner leak preventing seals 29 are adhered to both longitudinal end portions of the opening 12*e* of the toner frame 12 by both-sided tapes. As shown in FIG. 11, on the upper surface of the toner leak preventing seal 29 that is disposed at a side that the operator draws out the cover film 28, a tear preventing sheet 29*a* having a width narrower than a width of the seal 29 and a thickness of about 0.01–1 mm is adhered.

Figure 19:
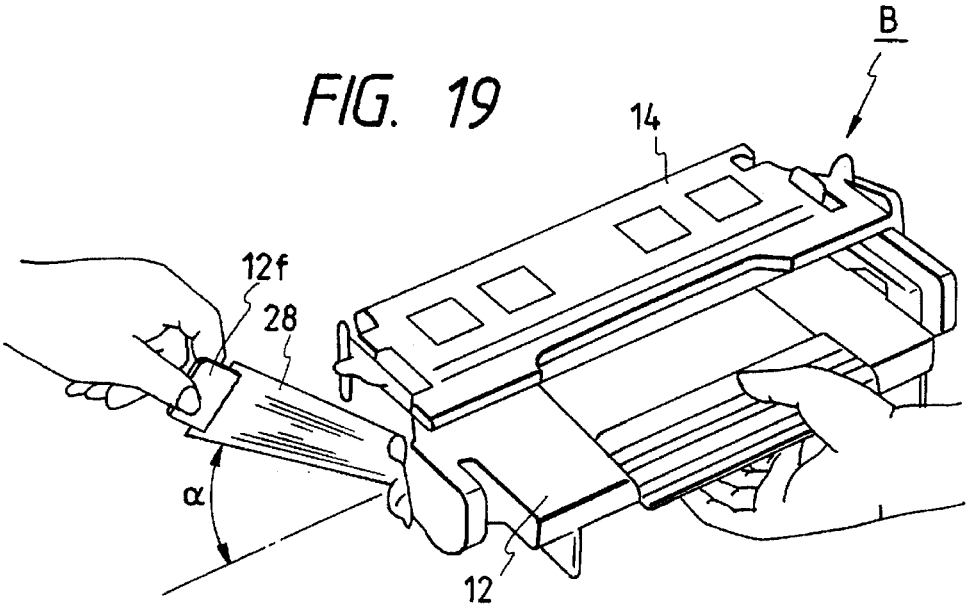
FIG. 19 is a perspective view of a cartridge showing a condition that a cover film is drawn obliquely.
Figure 20:
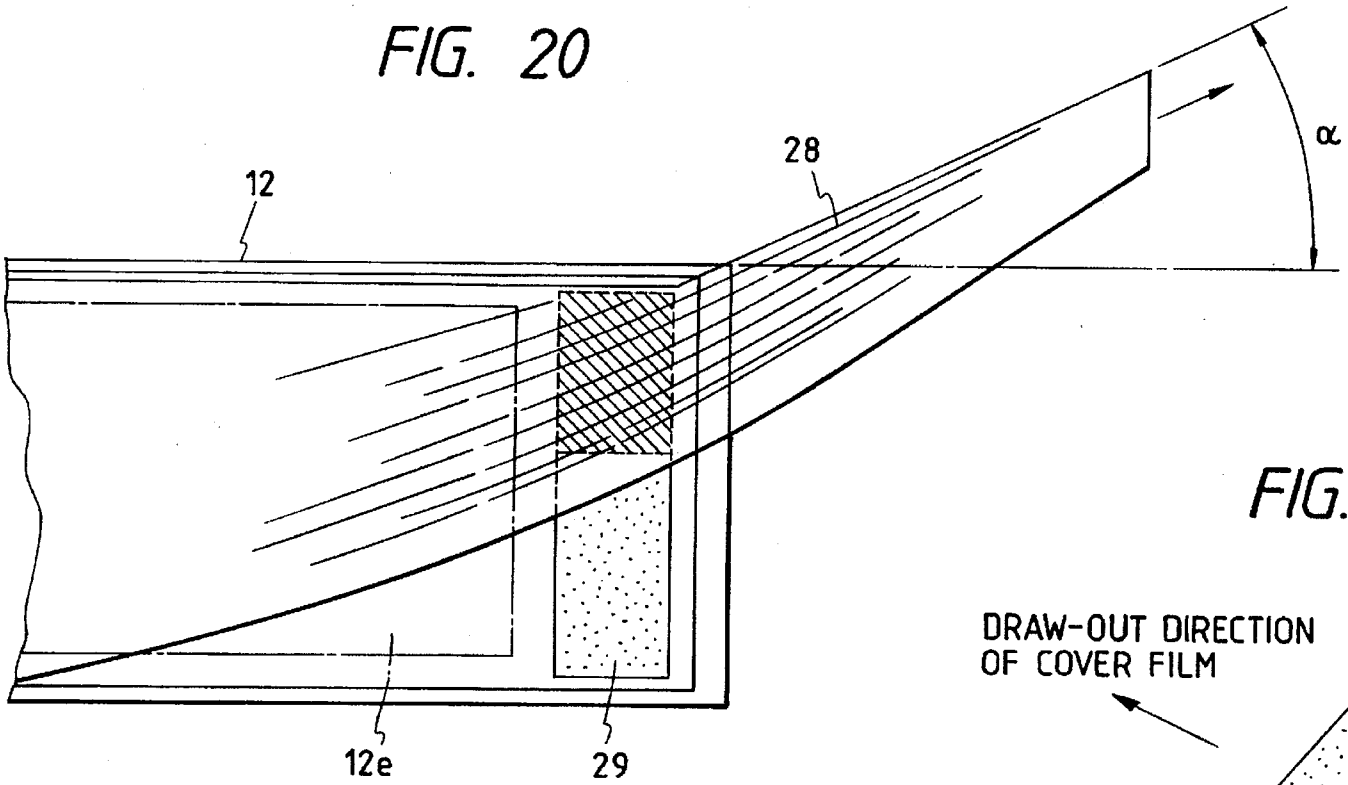
FIG. 20 is a view showing a relation between the cover film and the toner leak preventing seal when the cover film is drawn obliquely.

The reason why the tear preventing sheet 29*a* is provided is as follows. That is to say, in use, the operator must draw out the cover film 28 by hand to open the opening 12*e* of the process cartridge B. In this case, there is no problem when the operator pulls the cover film 28 in a film draw-out direction (corresponding to the longitudinal direction of the opening 12*e*). However, as shown in FIG. 19, when the cover film is pulled in a direction inclined with respect to the film draw-out direction by an angle $\alpha$, as shown in FIG. 20, the width of the cover film 28 is shortened or wrinkled by gathering the sheet in one direction (upward direction in FIG. 20), with the result that the creases of the sheet are rubbed against the toner leak preventing seal 29, thereby often tearing a portion (hatched area) of the seal 29. If the toner leak preventing seal 29 is torn or broken, the toner is leaked through the broken portion of the seal, thus smudging the operantor's hand or often dropping into the image forming apparatus to smudge the recorded recording medium.

However, as in the illustrated embodiment, when the tear preventing sheet 29*a* is adhered to the toner leak preventing seal 29 through which the cover film 28 is drawn out, if the creases are created during the pulling of the cover film 28, since the tear preventing sheet 29*a* protects the seal 29, the seal 29 is prevented from tearing. Accordingly, regardless of the direction along which the operator draws out the cover film 28, the leakage of the toner can be prevented.

Further, by providing the tear preventing sheet 29*a* along the width of the seal 29 at a side of the opening 12*e*, while the cover film 28 is being drawn out, the toner adhered to the film 28 is scraped by the tear preventing sheet 29*a*, thereby eliminating the possibility that the operator's hand is smudged by the drawn-out film 28.

Incidentally, when the toner frame 12 and the developing frame 13 are welded to each other, since the toner leak preventing seal 29 and the tear preventing sheet 29*a* are firmly pinched between and secured by the frames 12, 13 at both longitudinal ends thereof (upper and flower ends in FIG. 11), the sheet 29*a* is not deviated from the seal 29. The tear preventing sheet 29*a* is preferably made from material which is strong enough to withstand the rubbing of the cover film 28, for example, such as polyethylene terephthalate or high dense polyethylene.

Figure 21:
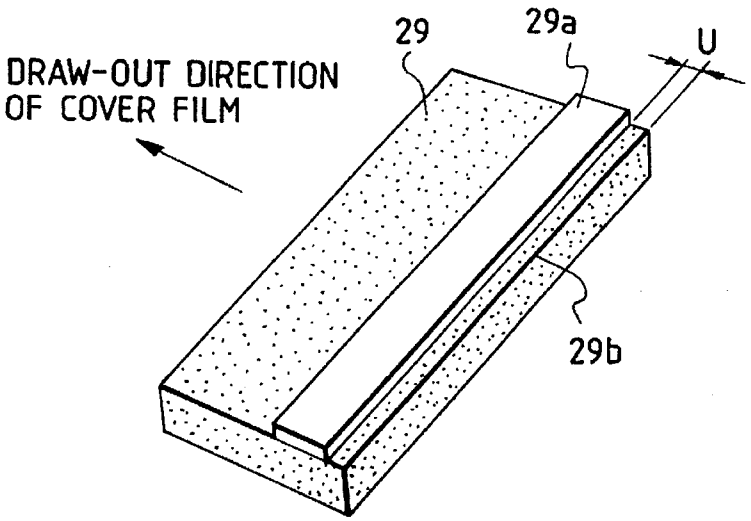
FIG. 21 is a perspective view showing a condition that a tear preventing sheet is secured to the toner leak preventing seal in spaced relation to an edge of the toner leak preventing seal.

Further, when the tear preventing sheet 29*a* having the width smaller than the width of the toner leak preventing seal 29 is adhered to the seal 29, as shown in FIG. 21, the adhering position of the sheet 29*a* is spaced apart from an edge 29*b* of the toner leak preventing seal 29 in the film draw-out direction by a distance U. By doing so, while the cover film 28 is being drawn out, the toner adhered to the film 28 is scraped by the edge 29b more effectively. And, when the distance is selected to be about 5 mm or less, the tear preventing effect regarding the toner leak preventing seal 29 is not worsened during the draw-out of the cover film 28.

Incidentally, as mentioned above, the tear preventing sheet 29a may have a width not smaller than the width of the toner preventing seal 29 so that the sheet is adhered to the whole surface of the seal 29.

Figure 22:
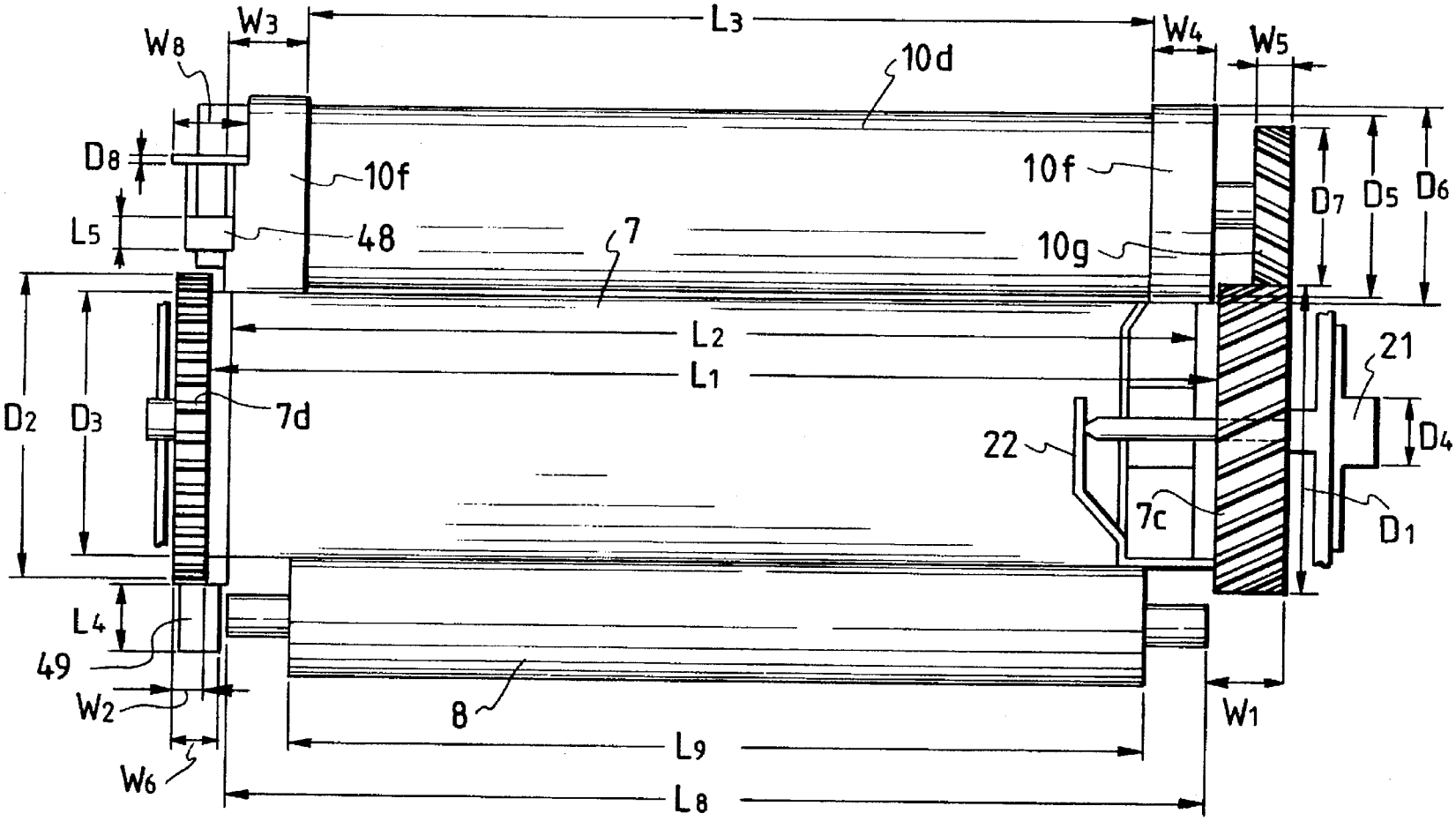
FIG. 22 is a view showing various dimensions of a photosensitive drum, a developing sleeve and a charger roller.
Figure 23:
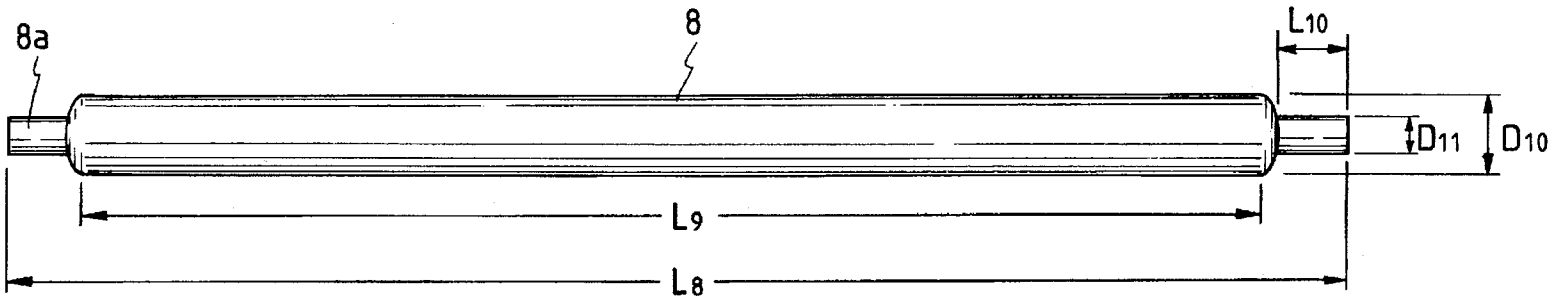
FIG. 23 is a view showing various dimensions of the charger roller.

(Various Sizes of Photosensitive Drum and the like):

Next, various sizes of the photosensitive drum 7, charger roller 8 and developing sleeve 10d according to the illustrated embodiment, and the positional relation between these elements will be explained with reference to FIGS. 22 and 23. However, the present invention is not limited to such example, but other sizes and positional relation may be adopted appropriately.

| | |
|---|---|
| (1) Number of teeth of helical gear 7c | 32; |
| (2) Diameter (D1) of helical gear 7c | about 31.85 mm; |
| (3) Width (W1) of helical gear 7c | about 9.8 mm; |
| (4) Number of teeth of gear flange 7d | 43; |
| (5) Diameter (D2) of gear flange 7d | about 32 mm; |
| (6) Width (W2) of gear flange 7d | about 5.6 mm; |
| (7) Length (L1) of photosensitive drum 7 | about 254 mm; |
| (8) Length (L2) of photosensitive body coating area on photosensitive drum 7 | about 250 mm |
| (9) Diameter (D3) of photosensitive drum 7 | about 30 mm; |
| (10) Diameter (D4) of metal shaft 21 of photosensitive drum 7 | about 10 mm; |
| (11) Length (L3) of developing sleeve 10d | about 246 mm; |
| (12) Length (L4) of carbon coating area on developing sleeve 10d | about 216 mm; |
| (13) Diameter (D5) of developing sleeve 10d | about 16 mm; |
| (14) Outer diameter (D6) of ring member 10f | about 16.5 mm; |
| (15) Length (L5) of ring member 10f | about 12 mm; |
| (16) Length (L6) of ring member 10f | about 9 mm; |
| (17) Outer diameter (D7) of drum abutment portion of ring member 10f | about 16.7 mm; |
| (18) Thickness (E1) of drum abutment portion of ring member 10f | about 0.3 mm; |
| (19) Width (W3) of drum abutment portion of ring member 10f | about 4 mm; |
| (20) Number of teeth of developing gear 10 g | 17; |
| (21) Diameter (D8) of developing gear 10 g | about 18.1 mm; |
| (22) Width (W4) of developing gear 10 g | about 8.3 mm; |
| (23) Length (L7) of charging bias contact 49 | about 7 mm; |
| (24) Width (W5) of charge bias contact 49 | about 7.8 mm; |
| (25) Length (L8) of charging bias contact 48 | about 6 mm; |
| (26) Width (W6) of charging bias contact 48 | about 9.4 mm; |
| (27) Diameter (D9) of contact portion 27a of antenna line 27 | about 2 mm; |
| (28) Width (W7) of contact portion 27a of antenna line 27 | about 15.5 mm; |
| (29) Length (L8) of charger roller 8 | about 251 mm; |

-continued

| | |
|---|---|
| (30) Length (L9) of charging portion (rubber portion) of charger roller 8 | about 225 mm; |
| (31) Diameter (D10) of charger roller 8 | about 12 mm; |
| (32) Length (L10) of roller shaft 8a | about 12 mm; and |
| (33) Diameter (D11) of roller shaft 8a | about 6 mm. |

Incidentally, here, the helical gear 7c and the developing gear 10g are so-called helical gears, so that, when the gear 7c is subjected to the driving force from the image forming apparatus, the photosensitive drum 7, mounted with play, is subjected to the thrust force directing to the gear 7c. Thus, the photosensitive drum 7 is shifted in the thrust direction by the thrust force, with the result that the photosensitive drum is abutted against the cleaning frame 14, thus positioning the photosensitive drum in the thrust direction.

(Cleaning Means):

The cleaning means 11 serves to remove the toner remaining on the photosensitive drum 7 after the toner image on the photosensitive drum 7 is transferred onto the recording medium 2 by the transfer means 4. As shown in FIG. 3, the cleaning means 11 comprises a cleaning blade 11a contacted with the surface of the photosensitive drum 7 and adapted to scrape off the toner remaining on the drum 7, a dip sheet 11b disposed below the blade 11a to receive the scraped toner and contacted with the surface of the photosensitive drum 7, and a waste toner resevoir 11c for collecting the received waste toner. Incidentally, the dip sheet 11b is lightly contacted with the surface of the photosensitive drum 7 so that it permits the passage of the waste toner on the photosensitive drum 7 and directs the toner removed from the photosensitive drum 7 by the blade 11a toward a direction away from the surface of the photosensitive drum 7 (i.e., toward the waste toner reservoir 11c).

Similar to the developing blade 10e, the cleaning blade 11a is made of rubber and the like and is adhered to a blade attachment member 11d by a both-sided adhesive tape, which blade attachment member is attached to the cleaning frame 14 by screws. Further, the dip sheet 11b is adhered to a dip sheet adhesion surface (edge portion) 11c1 of the waste toner reservoir 11c by a both-sided adhesive tape.

Now, it is necessary to prevent the waste toner collected in the waste toner reservoir 11c from leaking between both longitudinal ends of the cleaning blade 11a and the opposed cleaning frame 14. To this end, toner leak preventing seals are adhered to both longitudinal end portions of the blade 11a. However, if the toner leak preventing seals are not closely contacted with the cleaning blade 11a completely, it is feared that the toner is leaked through a gap between the seal and blade. Similarly, if the toner leak preventing seals are not closely contacted with the dip sheet adhesion surface 11c1 of the waste toner reservoir 11c, it is possible for the toner, to leak through a gap between the seal and the adhesion surface.

Figure 24:
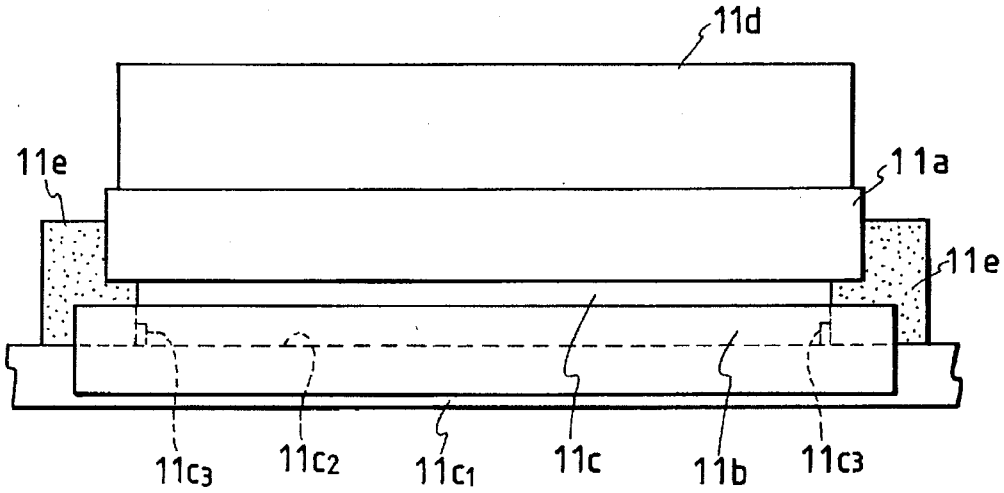
FIG. 24 is a plan view showing toner leak preventing seals and screens disposed on both ends of a cleaning blade.
Figure 25:
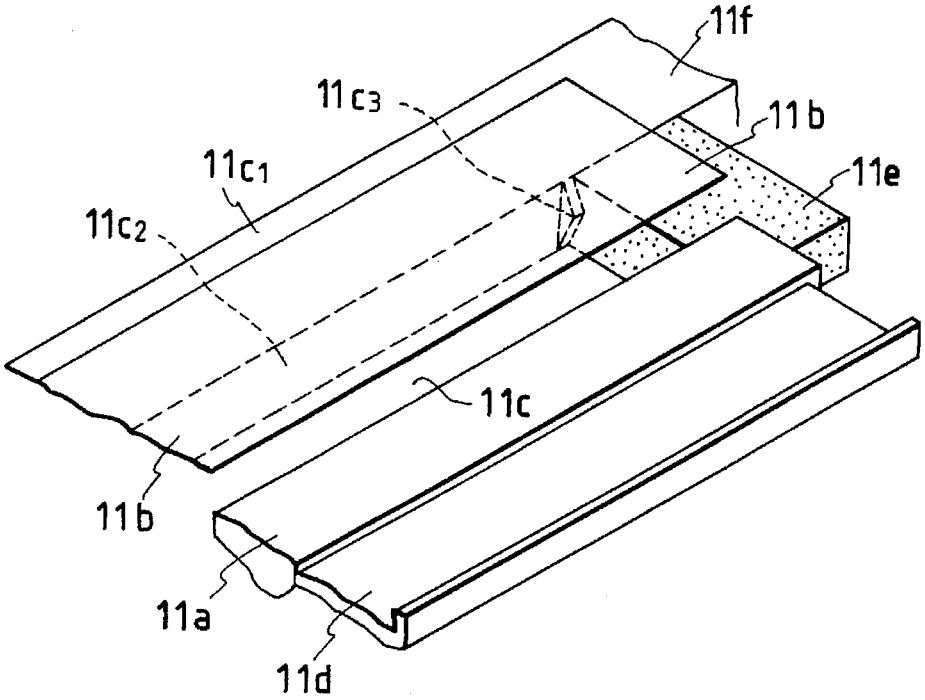
FIG. 25 is a perspective view showing the toner leak preventing seal and the screens disposed on the end of the cleaning blade.

To avoid this, in the illustrated embodiment, as shown in FIG. 24, toner leak preventing seals 11e are provided on both longitudinal ends of the cleaning blade 11a. The portions where the seals 11e are provided will be further fully described. As shown in FIGS. 24 and 25, the seals 11e are adhered to both end portions of the waste toner reservoir 11c, and both the longitudinal end portions of the cleaning blade 11a are adhered to the seals 11e. Further, screen members 11c3 are formed on an upper surface 11c2 of the waste toner reservoir 11c to contact with inner surfaces of the corresponding seals 11e.

Figure 26:
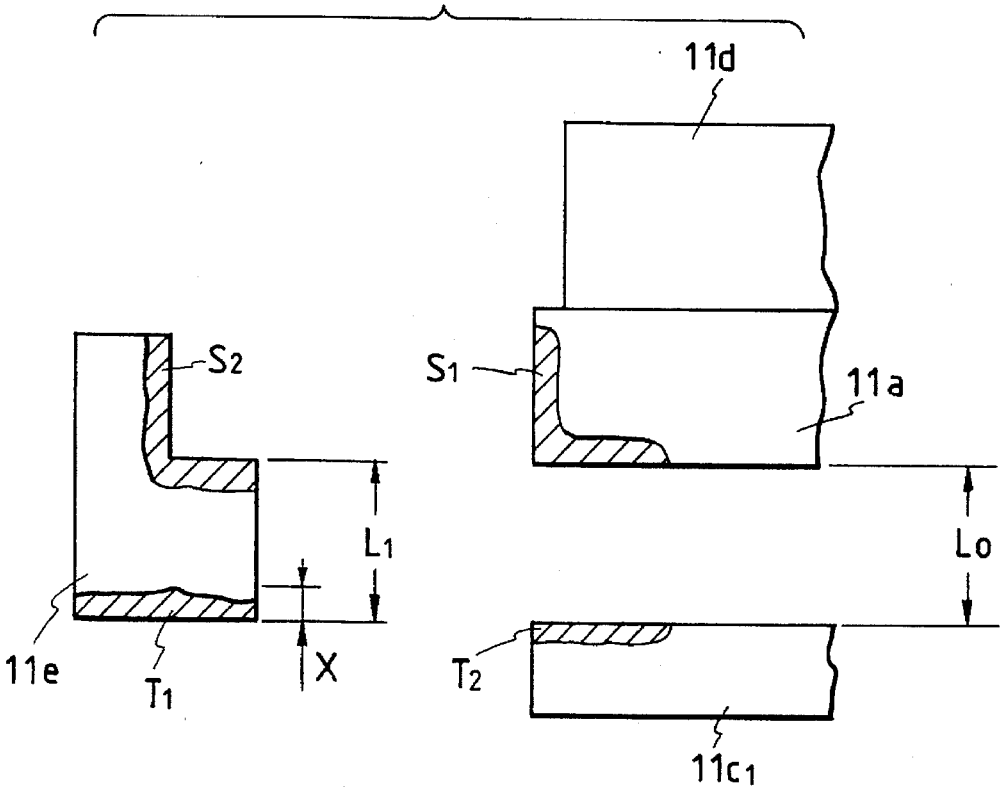
FIG. 26 is an explanatory view for explaining a method for attaching the toner preventing seal on the end of the cleaning blade.

Now, a method for attaching the toner leak preventing seals 11e will be explained. First of all, the cleaning blade 11a is attached to the cleaning frame 14, and then the seals 11e are attached in such a manner that edges S2 of the seals are closely contacted with both longitudinal edges S1 of the cleaning blade 11a shown in FIG. 26. In this case, if the width W1 of the seal 11e is longer than a distance $L_O$ between the dip sheet adhesion surface 11c1 and the cleaning blade 11a, a clearance is created between a lower edge T1 of the seal 11e and the dip sheet adhesion surface 11c1, thus causing the leakage of toner. In order to prevent this, in the illustrated embodiment, the distance $L_O$ is selected to be greater than the width L1 ($L_O$>L1) in tolerance and an compression amount X is given to the seal 11e. In this case, the seal 11e must be adhered to the dip sheet adhesion surface 11c1 while urging the lower edge T1 of the seal against a hatched portion T2 of the adhesion surface; however, in the illustrated embodiment, since the screen members 11c3 are provided, the waste toner is prevented from leaking while sliding laterally along the dip sheet adhesion surface. Thus, it is possible to make the compression amount X of the seal 11e substantially zero in tolerance.

(Frames):

Next, the frames constituting the housing of the process cartridge B will be explained. As shown in FIG. 7, the housing of the process cartridge B comprises the toner frame 12, developing frame 13 and cleaning frame 14. The toner frame 12 and the developing frame 13 are integrally welded to each other to form a toner developing frame C. The toner developing frame C is connected to the cleaning frame 14 in a manner as described later to form the housing of the process cartridge B. Incidentally, the frames 12, 13, 14, according to the illustrated embodiment, are formed from polystyrene resin by injection molding. When the frames 12, 13, 14 are made of material having the charging feature near that of the toner component, even if the toner is rubbed against an frames during the image forming operation, the abnormal charge is not generated due to the frictional charging, thereby preventing deterioration of the image quality.

In this respect, in the illustrated embodiment, as shown in the following Table 1 (literature "Surface Polymer and Electrostatics" Surface Film Molecule Design Series 5, published from Japan Surface Science Associates, written by Yuji Murata), since polystyrene, which is the material for the frames, and styren acryl, which is the toner component, are both the same styren group and have a similar charging feature, even if the toner is rubbed against the frames, the abnormal charge is not generated. Incidentally, "styren group" means a base material including styrene of 60% or more.

TABLE 1

| (Charging System) |
|---|
| (positive end) |
| Silicone elastomer with silica filler |
| \| |
| Cellulose sponge |
| Cotton, woven |
| Polyurethane elastomer |
| Styren acrylonitrile copolymer (Material of toner binding agent in the embodiment) |
| Styren butadiene copolymer |
| Polystyrene (Material of frames in the embodiment) |
| Polyisobutylene |
| Polyurethane flexible sponge |

TABLE 1-continued

| (Charging System) |
|---|
| Borosilicate glass, ground surface |
| \| |
| Polytetrafluoroethylene (negative end) |

By the way, as shown in FIG. 7, the toner reservoir 12a and the toner feed member 10b is provided in the toner frame 12. Further, as shown in FIGS. 3 and 4, a plurality of longitudinal ribs 12d are formed on an outer surface of the toner frame 12, which ribs constitute a gripper portion. The widths of the ribs 12d formed on the outer surface of the toner frame 12 are gradually changed to form the R configuration wholly. Thus, when the process cartridge B is mounted or dismounted with respect to the image forming apparatus A, since the operator can easily grip the toner frame 12 without slipping, the mounting and dismounting operability is improved.

Further, as shown in FIG. 7, the developing sleeve 10d and the developing blade 10e are provided on the developing frame 13. As shown in FIG. 11, although the developing blade 10e is mounted by attaching both longitudinal end portions of the blade attachment member 10j to which the blade is adhered to the frame 13 by screws, in the illustrated embodiment, prior to the attachment by the screws, the blade attachment member 10j is positioned with respect to the developing frame 13. To this end, positioning bosses 13g are uprightly formed on a blade attachment surface 13f of the developing frame 13, and holes formed in the blade attachment member 10j are fitted onto the positioning bosses 13g, thereby positioning the attachment member with respect the frame 13. Further, as shown in FIGS. 7 and 11, positioning bosses 13i are uprightly formed on an interface 13h of the developing frame 13 which is to be joined to the toner frame 12 (these positioning bosses are disposed on both longitudinal end portions of the developing frame 13, as shown in FIG. 11), and these bosses 13i are fitted into fitting holes 12c formed in the toner frame 12, thereby positioning the joint position between the developing frame 13 and the toner frame 12.

Figure 27:
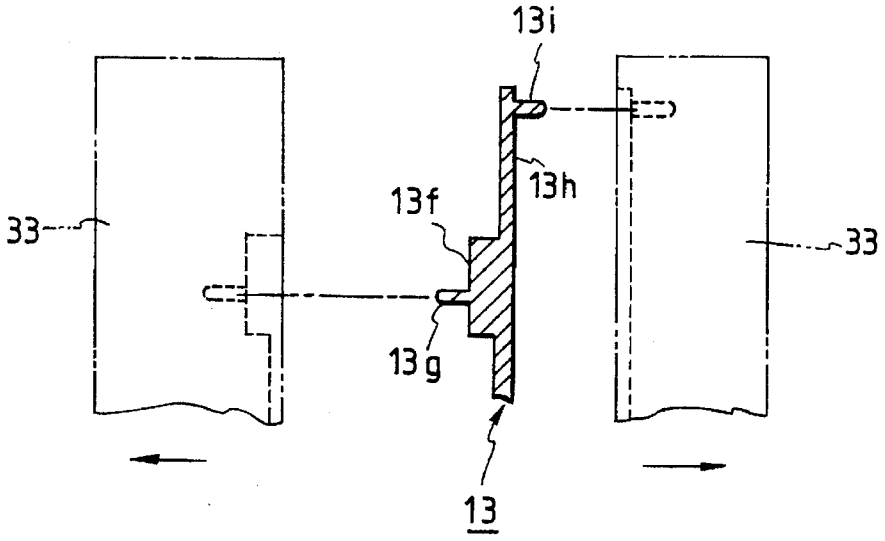
FIG. 27 is a view showing a method for demolding a developing frame.

In the illustrated embodiment, as shown in FIG. 27, it is so designed that the blade attachment surface 13f and the joint interface 13h of the developing frame 13 are in parallel with each other. Thus, when the developing frame 13 is formed by injection molding, since the bosses 13g for positioning the blade and the bosses 13i for positioning the toner frame are in parallel with each other, after the molding operation, only by separating molds 33 from each other in the left and right direction can the molded frame be easily separated from the molds.

Figure 28:
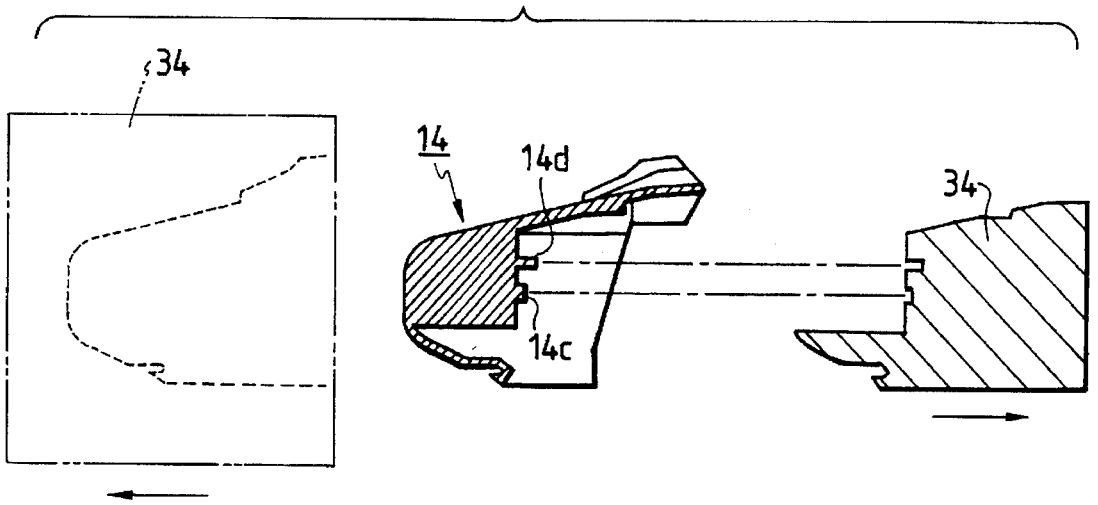
FIG. 28 is a view showing a method for demolding a cleaning frame.

Further, as shown in FIG. 7, the photosensitive drum 7, the charger roller 8, and the cleaning blade 11a, dip sheet 11b and waste toner reservoir 11c of the cleaning means 11 are provided on the cleaning frame 14. Incidentally, when the cleaning blade 11a is attached to the cleaning frame 14, similar to the attachment of the developing blade 10e as mentioned above, both longitudinal end portions of a blade attachment member 11d, to which the cleaning blade is adhered, are attached to the frame 14 by screws. However, prior to the attachment by the screws, the blade attachment member 11d is positioned with respect to the frame 14. To this end, as shown in FIG. 28, positioning bosses 14d are uprightly formed on a blade attachment surface 14c of the frame 14, and holes (not shown) formed in the blade attachment member 11*d* are fitted onto the bosses 14*d*, thereby positioning the attachment member with respect to the cleaning frame. In this case, it is so designed that the blade attachment surface 14*c* becomes perpendicular to a mold releasing direction (as shown by the arrow in FIG. 28) for molds 34. With this arrangement, since the protruded direction of the positioning bosses 14*d*, formed on the blade attachment surface 14*c*, are aligned with the mold releasing direction for the molds 34, the design of the molds 34 can be facilitated.

Incidentally, the drum shutter 35 shown in FIG. 3 is pivotably mounted on the cleaning frame 14. The drum shutter 35 serves to open and close an opening through which the photosensitive drum 7 faces the transfer roller 4. As will be described later, the drum shutter is automatically opened when the process cartridge B is mounted to the image forming apparatus A and is automatically closed when the process cartridge is dismounted from the image forming apparatus A.

Figure 29:
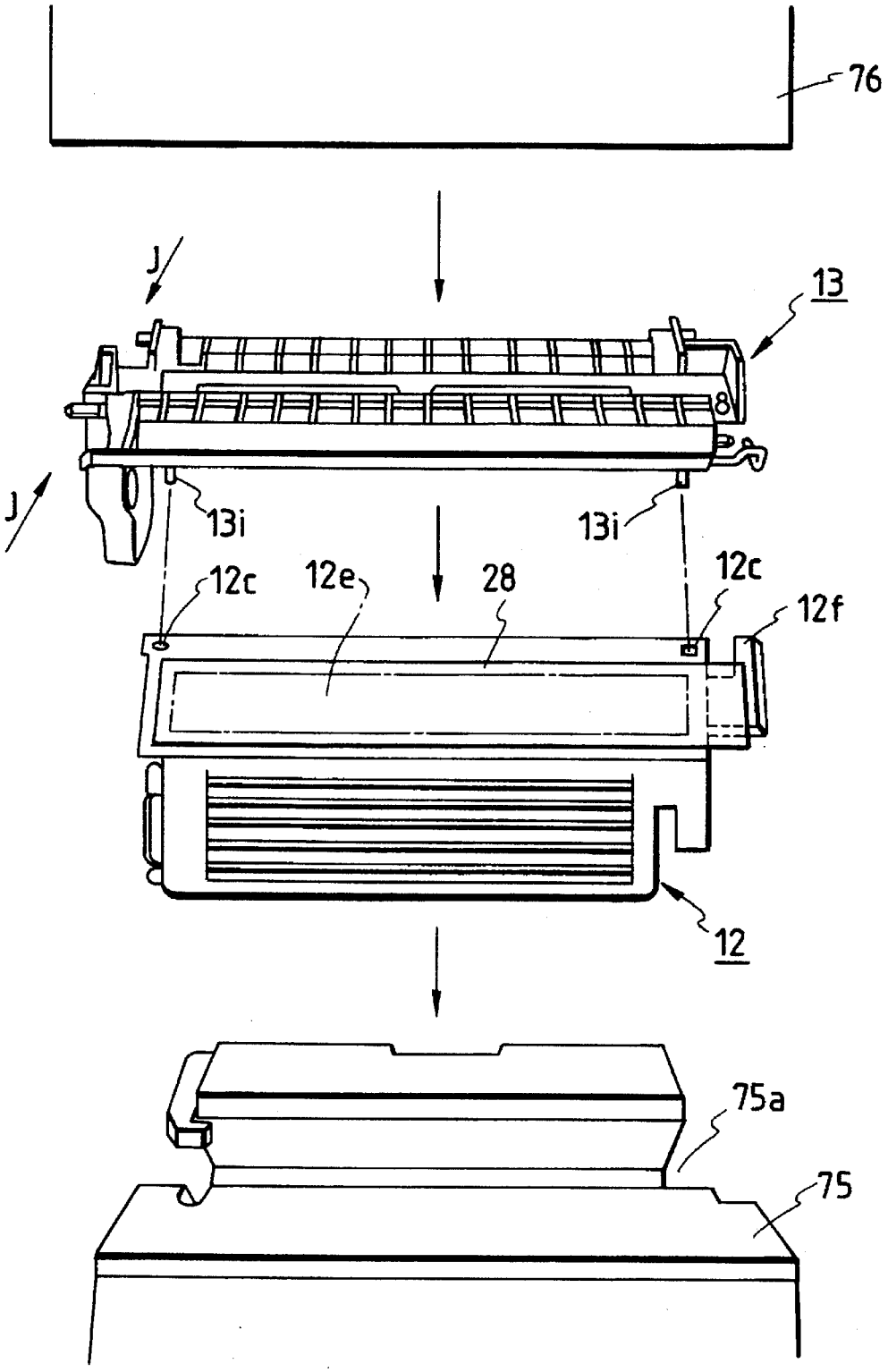
FIG. 29 is a view showing a process for bonding a toner frame and a developing frame by ultrasonic welding.
Figure 30:
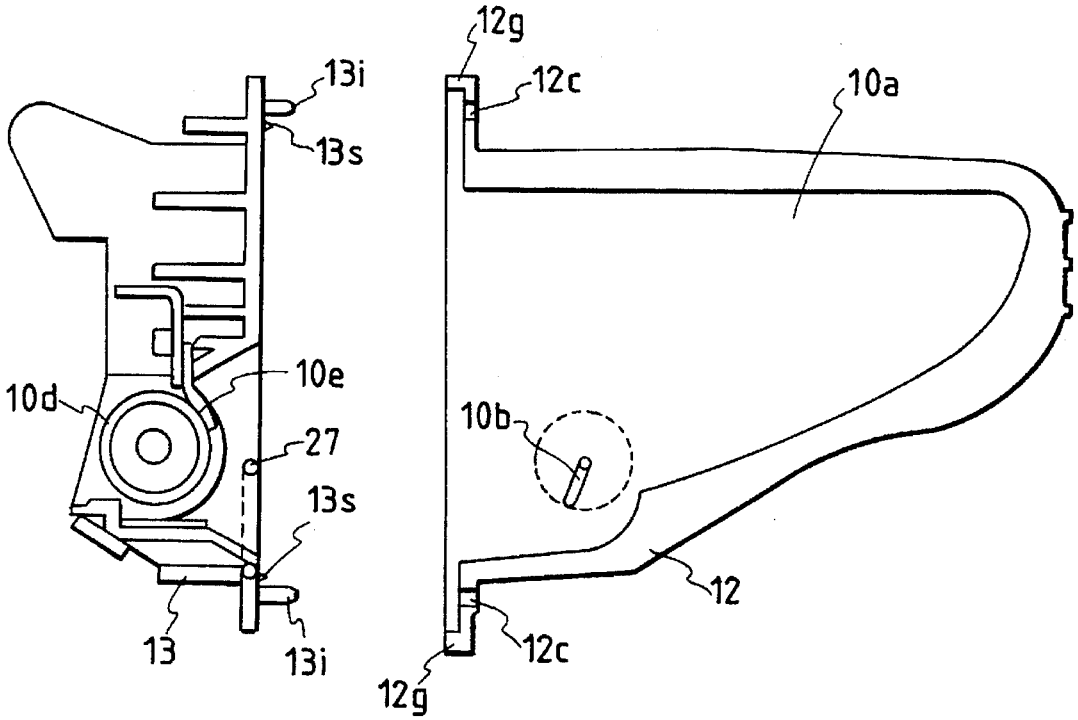
FIG. 30 is a view showing positioning bosses and fitting holes formed on and in the toner frame and the developing frame in a widthwise direction thereof.

(Welding Between Toner Frame and Developing Frame):

Now, the welding between the toner frame 12 and the developing frame 13 will be explained. The frames 12, 13 are joined to each other by ultrasonic welding. That is to say, after the opening 12*e* of the toner frame 12 is closed by the cover film 28, as shown in FIG. 29, the toner frame 12 is set in a recessed portion 75*a* of a receiving tool 75, and then a separable cover film draw-out grip 12*f*, formed integrally with the frame 12, is bent downwardly. Then, the developing frame 13 is overlapped with the toner frame 12, and the developing frame 13 is pressed from above by a press (hold-down) tool 76. In this condition, when the ultrasonic waves are applied to the toner frame 12 and the developing frame 13, ribs 13*s* (FIG. 7) formed on the joint interface of the toner frame 12 are welded, thereby interconnecting the frames 12 and 13.

By the way, when the ultrasonic waves are applied to the frames, the frames 12 and 13 are apt to deform in their widthwise directions (shown by the arrows J in FIG. 29). However, in the illustrated embodiment, since longitudinal ribs 13*t* are formed on the developing frame 13, as shown in FIG. 11, and the blade attachment member 10*j*, made of a metal plate, is attached to the developing frame, the developing frame has the sufficient strength to resist the deformation thereof. Furthermore, since the toner frame 12 has no reinforcement rib, the toner frame has poor strength and is generally apt to deform. However, in the illustrated embodiment, as shown in FIGS. 7 and 11, flanges 12*g* are formed on the toner frame 12 at both lengthwise edges (upper and lower ends along lengthwise direction of opening 12*e*) thereof. A distance between the flanges 12*g* is substantially equal to the widthwise length L13 of the interface 13*h* of the developing frame 13, so that the interface 13*h* of the developing frame 13 can be fitted between the flanges 12*g*.

Thus, when the frames 12, 13 are joined together by the ultrasonic welding, the interface 13*h*, of the developing frame 13, is fitted between the flanges 12*g*, of the toner frame 12, and the positioning bosses 13*i*, of the developing frame 13, are fitted into the fitting holes 12*c* of the toner frame 12. Therefore, the toner frame 12 is hard to deform by the vibration generated during the ultrasonic welding operation, thereby preventing deviation between the frames 12 and 13. That is to say, since the interface 13*h* of the developing frame is fitted between the flanges 12*g* formed on the toner frame 12 along their upper and lower edges, even if the up-and-down vibration is applied to the widthwise direction of the toner frame 12, the movement of the toner frame 12 is regulated by the developing frame 13, thus preventing the formation of the toner frame and the deviation between the frames 12 and 13.

Further, when the frames 12 and 13 are welded together, in the illustrated embodiment, since all of the frames are formed from the same material (polystyrene resin), the welding and bonding strength between the frames 12 and 13 is increased extremely. Incidentally, since the developing frame 13 is not welded to the cleaning frame 14, from the view point of the improvement of the welding and bonding strength, it is not necessary to make the cleaning frame 14 of the same material as the material of the toner frame 12 and the developing frame 13.

Further, in the illustrated embodiment, as mentioned above, while an example that the positioning bosses 13*i* of the developing frame 13 are disposed only at one lengthwise edge of the developing frame was explained, such positioning bosses 13*i* may be formed on both lengthwise edges of the developing frame 13. If done so, it is possible to prevent the deformation of the toner frame 12 and the developing frame 13 more positively during the welding operation and to prevent deviation between the frames 12 and 13 more positively.

Figure 31:
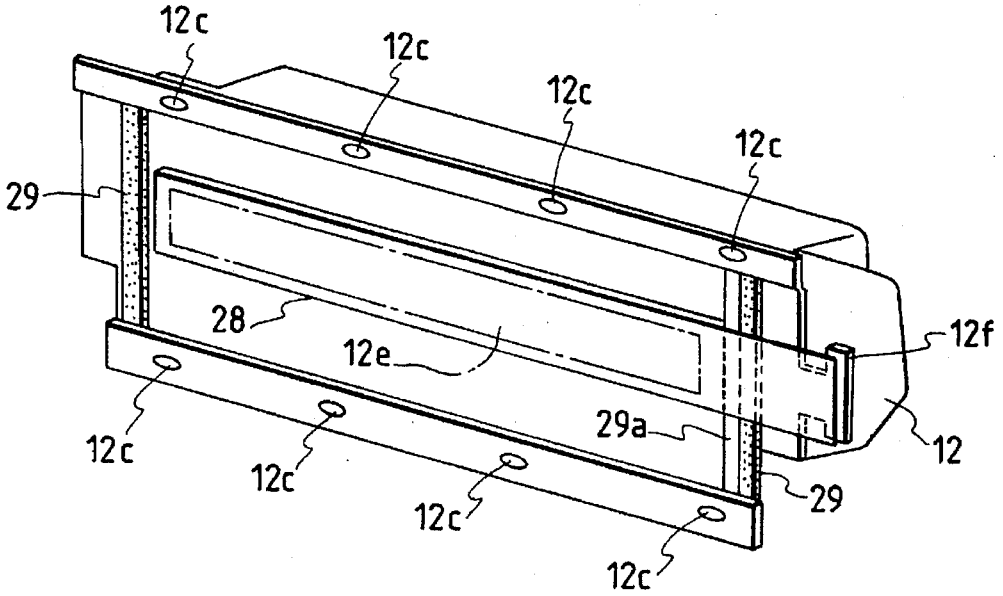
FIG. 31 is a perspective view showing a plurality of positioning bosses and fitting holes formed on and in the toner frame and the developing frame in a longitudinal direction thereof.

Further, as shown in FIG. 31, when a plurality of positioning bosses (not seen) of the developing frame and the fitting holes 12*c* (into which the bosses are fitted) of the toner frame 12 are arranged side by side in the longitudinal directions of the frames, the deformation of the frames and the deviation between the frames can be prevented more positively. If done so, the flanges 12*g*, arranged on both widthwise edges of the toner frame 12 as mentioned above, can be omitted.

Figure 32A:
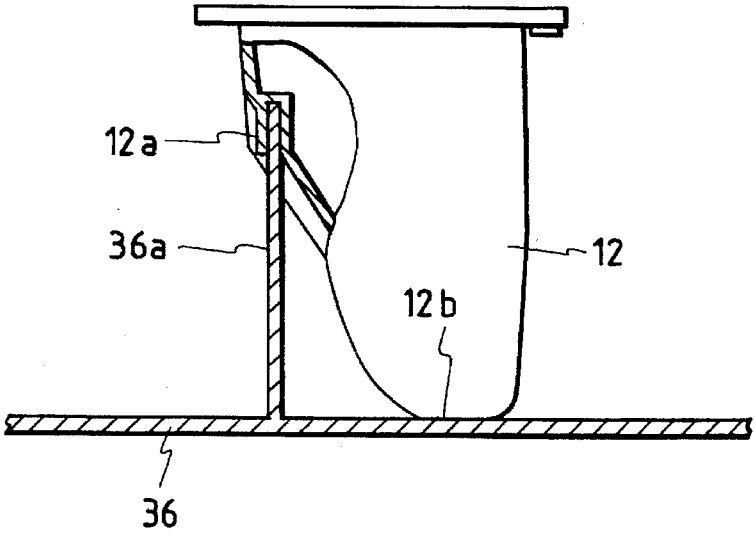
FIG. 32A is a view showing a condition that the toner developing frame is rested on an assembling tray.

(Construction for Facilitating Assembling of the Process Cartridge):

In assembling the process cartridge B, the toner feed member 10*b* is mounted on the toner frame 12, and the opening 12*e* of the toner reservoir 10*a* containing the toner is closed by the cover film 28, and the antenna line 27 is attached. Thereafter, the developing frame 13 is welded to the toner frame. Then, the developing sleeve 10*d* and the like are assembled to the developing frame 13. In this case, the toner developing frame C comprising the integral developing frame 13 and toner frame 12 is securely rested on the assembling tray, and the various parts are assembled to the frame C (refer to FIG. 33). In the illustrated embodiment, as shown in FIG. 32A, a fitting hole 12*a* is formed in the toner frame 12 at a predetermined position, and a bottom 12*b* of the toner frame 12 is made flat. Thus, by inserting a member 36*a* formed on the assembling tray 36 into the fitting hole 12*a*, the toner frame 12 can easily be fixed, thereby facilitating the assembling of parts such as the developing sleeve 10*d*, developing blade 10*e* and the like, which results in the improvement of the assembling operability.

Figure 32B:
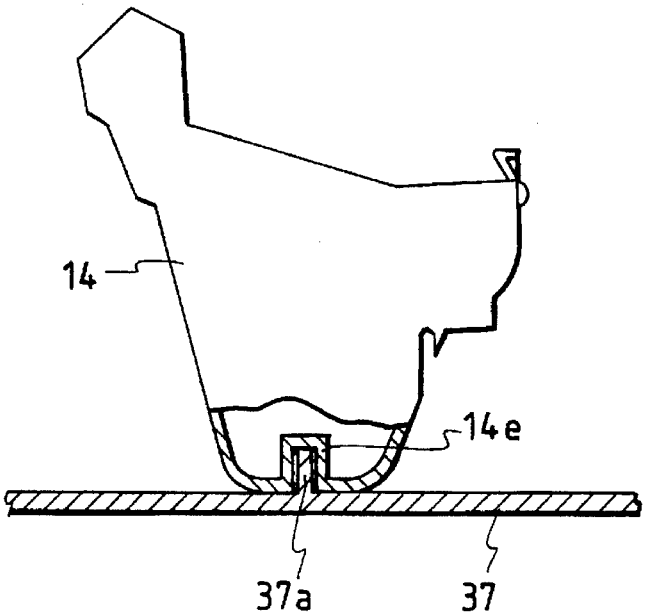
FIG. 32B is a view showing a condition that the cleaning frame is rested on an assembling tray.

Similarly, the parts, such as the cleaning blade 11*a* and the like, are assembled to the cleaning frame 14. In the illustrated embodiment, as shown in FIG. 32B, a bottom of the cleaning frame 14 is made flat, and a fitting hole 14*e* is formed in the bottom of the cleaning frame. Accordingly, when the parts such as the blade 11*a* and the like are assembled to the cleaning frame 14, by inserting a fitting projection 37*a* formed on the assembling tray 37 into the fitting hole 14*e*, the cleaning frame 14 can easily be fixed, thereby facilitating the assembling of the parts such as the cleaning blade 11*a* and the like, which results in the improvement 6f the assembling operability.

Figure 33:
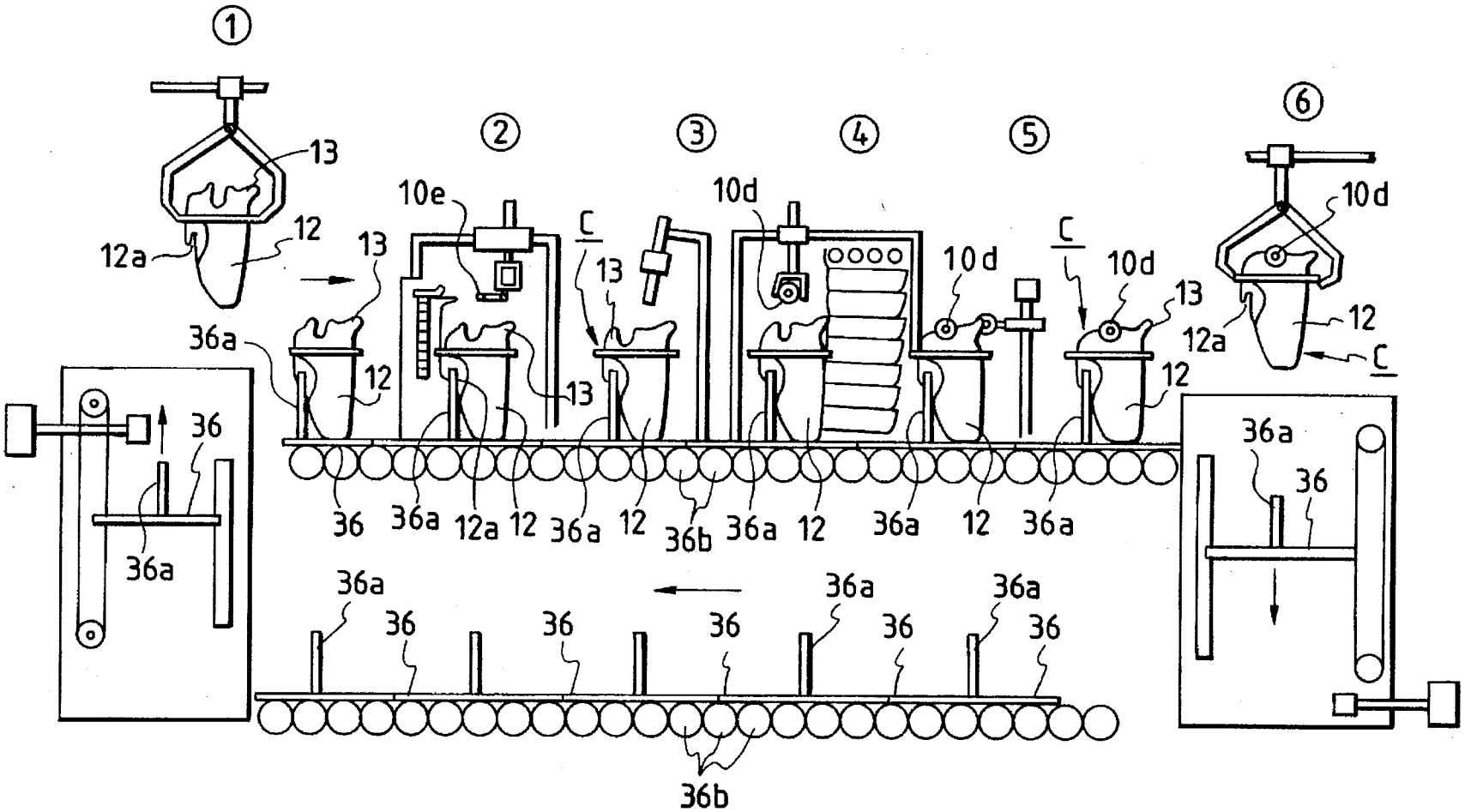
FIG. 33 is a view showing assembling steps through which the toner developing frame is assembled by an automatic machine.

Now, the automatic assembling will be explained with reference to the accompanying drawings. First of all, regarding the assembling of the toner developing frame C, as shown in FIG. 33, with respect to the assembling tray 36 shifting in a direction shown by the arrow via conveyor rollers 36*b*, at a step ① the fitting hole 12*a* of the toner frame 12 is fitted onto the projection 36*a* of the assembling tray 36, at a step ② the developing blade 10*e* is mounted, and at a step ③ the developing blade 10*e* is secured by screws. Then, at a step ④ the developing sleeve 10*d* is assembled, at a step ⑤ the developing sleeve is fixed, and at a step ⑥ the toner developing frame C is picked up to bring it to a next step. Further, after the toner developing frame C is picked up, the assembling tray 36 is returned through a lower auxiliary line, and step ① is repeated again.

As mentioned above, by providing the fitting portion (for fitting into the assembling tray 36) in the toner frame 12, it is possible to omit a clamping step for clamping the toner frame, thereby facilitating the assembling of the toner frame 12.

Figure 34:
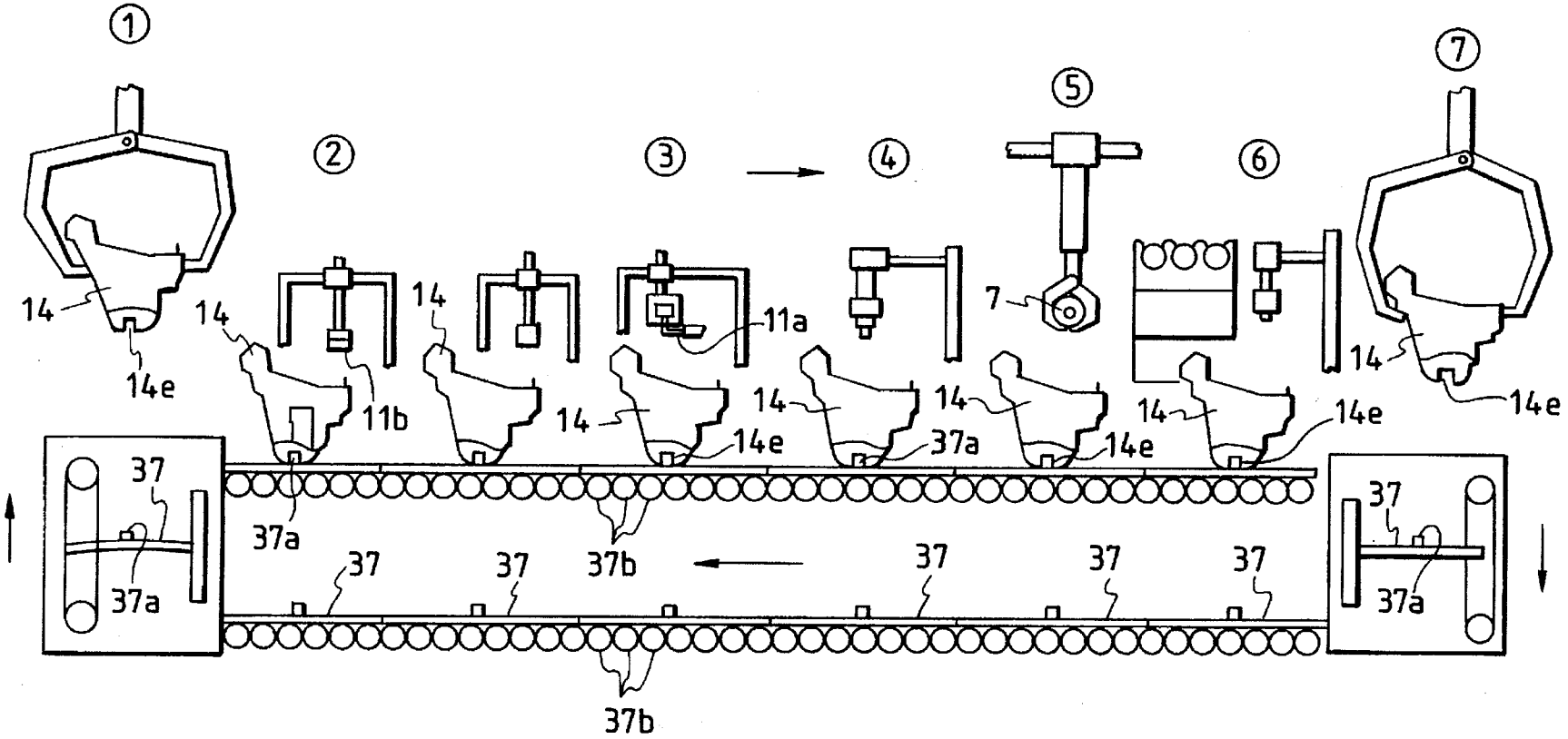
FIG. 34 is a view showing assembling steps through which the cleaning frame is assembled by an automatic machine.

Next, regarding the assembling of the cleaning frame 14, as shown in FIG. 34, with respect to the assembling tray 37 shifting in a direction shown by the arrow via conveyor rollers 37*b*, at a step ① the fitting hole 14*e* of the cleaning frame 14 is fitted onto the projection 37*a* of the assembling tray 37, at a step ② the dip sheet 11*a* is adhered, at a step ③ the cleaning blade 11*a* is mounted, and at a step ④ the cleaning blade 11*a* is secured by screws. Further, at a step ⑤ the photosensitive drum 7 is mounted, and at a step ⑥ the photosensitive drum is fixed. And, at a step ⑦ the assembled cleaning frame 14 is picked up to bring it to a next step. Further, after the cleaning frame 14 is picked up, the assembling tray 37 is returned through a lower auxiliary line, and step ① is repeated again.

Accordingly, similar to the toner developing frame C, by providing the fitting portion (for fitting into the assembling tray 37) in the cleaning frame 14, it is possible to omit a clamping step for clamping the cleaning frame 14, thereby facilitating the assembling of the cleaning frame 14. Incidentally, as shown in FIG. 4, the cleaing frame 14 is provided with locking recessed portions 14*o* which are gripped by the assembling machine to shift the cleaning frame between the stations during the automatic assembling operation.

Incidentally, the assembling of the toner frame 12 and the cleaning frame 14 can be effected by any means other than the automatic assembling machines. For example, in simple assembling lines where the frames are assembled manually by using simple tools, by utilizing the assembling trays 36, 37, the working efficiency can be improved.

After the various parts are assembled to the toner developing frame C comprising the integral toner frame 12 and developing frame 13 and to the cleaning frame 14, the toner developing frame C is joined to the cleaning frame 14. In this regard, the frames are often rested on a table. In this case, before the toner developing frame C is joined to the cleaning frame 14, the photosensitive drum 7, assembled to the cleaning frame 14, and the developing sleeve 10*d*, assembled to the developing frame 13, are exposed outwardly. Thus, it is feared that such elements are contacted with the table to damage such elements. Particularly, the photosensitive drum 7 is a most important element for performing the image forming operation, and, if the surface of the drum is damaged more or less, the image will be distorted or deteriorated, thereby worsening the image quality. Therefore, in the assembling operation and the like, when the frame to which the photosensitive drum 7 is assembled or the frame to which the developing sleeve 10*d* is assembled is rested on the table, the operator must take care not to contact the photosensitive drum 7 or the developing sleeve 10*d* with the table.

Figure 35:
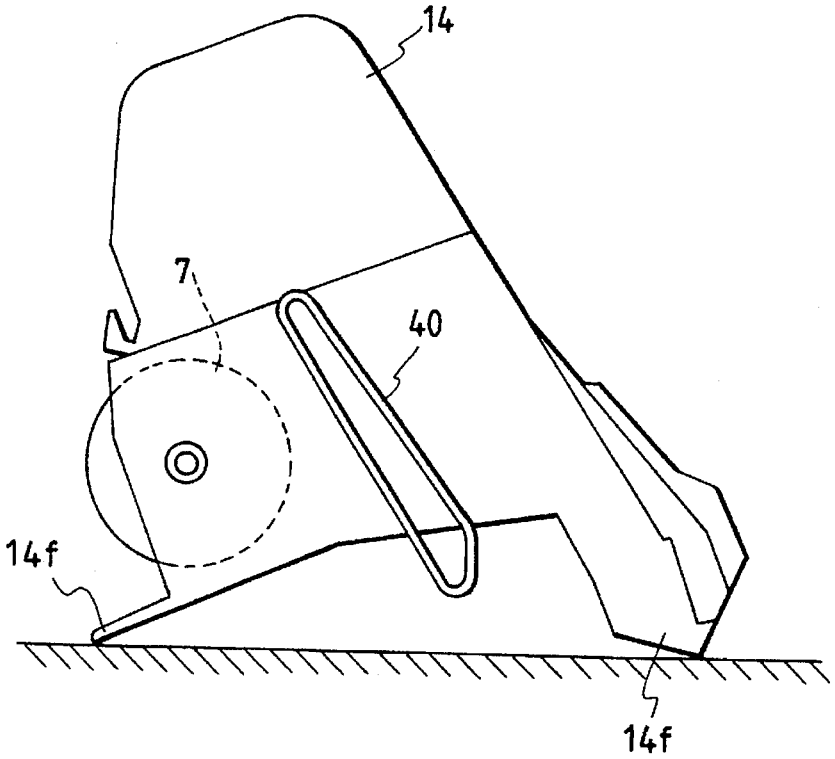
FIGS. 35 and 36 are views showing a construction or arrangement wherein the photosensitive drum is not contacted with a table when the cleaning frame is rested on the table.
Figure 36:
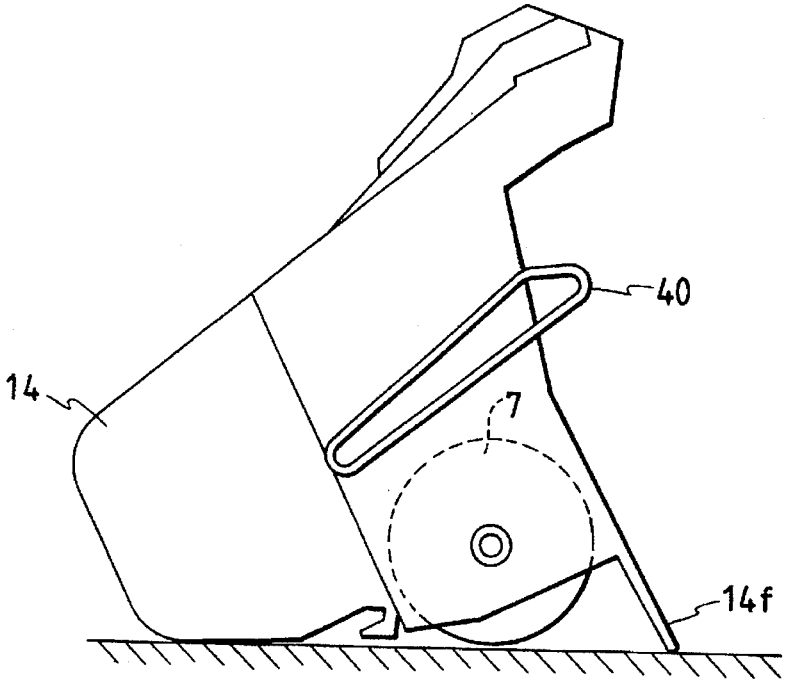

In the illustrated embodiment, as shown in FIG. 35, protruded portions 14*f* are formed on edges of an open end of the cleaning frame 14 to which the photosensitive drum 7 is assembled. The photosensitive drum 7 is arranged so that the photosensitive drum is positioned inwardly (toward the cleaning frame 14) from a line connecting between tip ends of the protruded portions 14*f*. With this arrangement, as shown in FIGS. 35 and 36, when the cleaning frame 14 is rested on the table, the protruded portions 14*f* are contacted with the table and the photosensitive drum 7 is not contacted with the table, thereby preventing the damage of the surface of the photosensitive drum 7.

Figure 37:
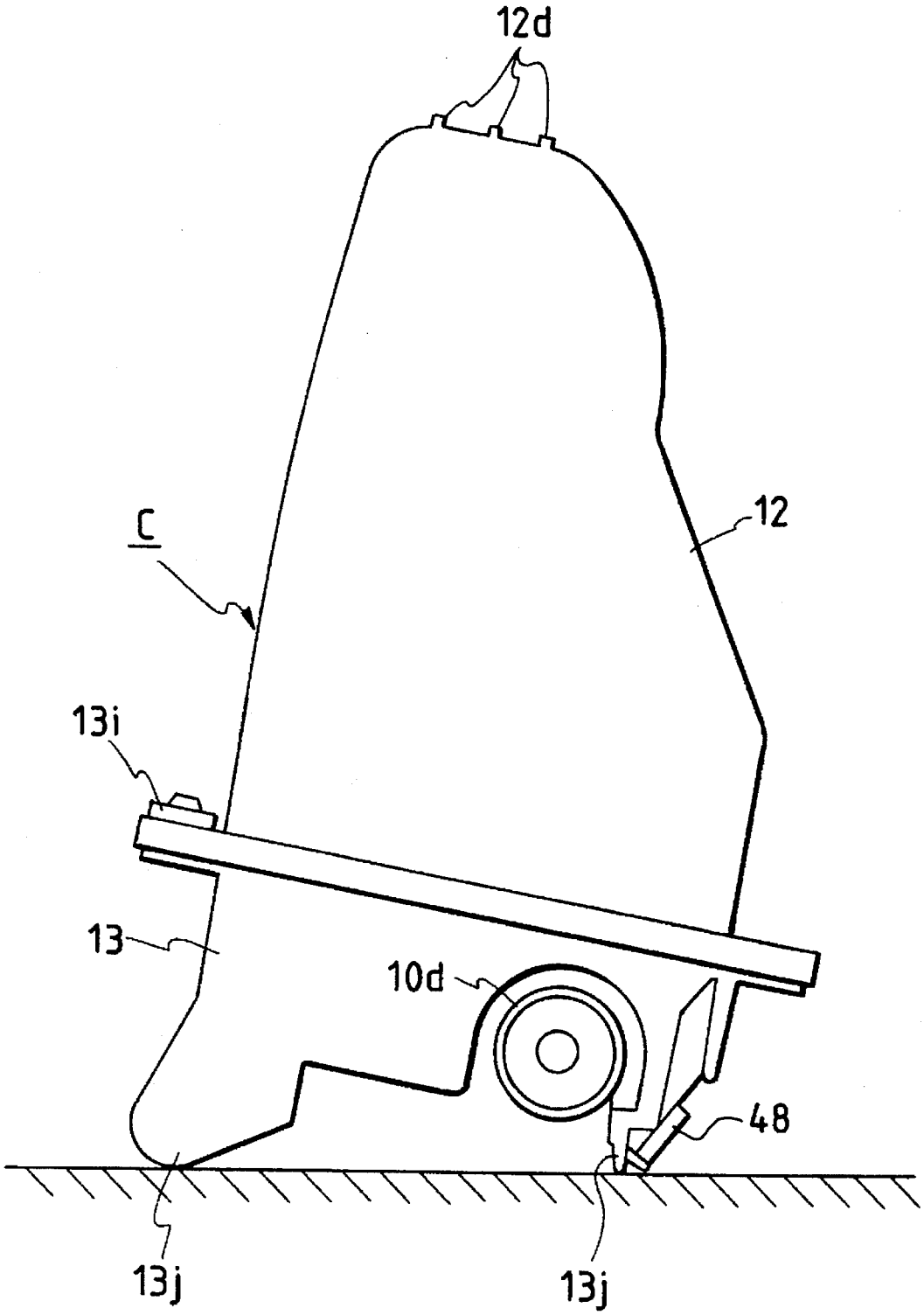
FIG. 37 is a view showing a construction wherein a developing sleeve is not contacted with a table when the toner developing frame is rested on a table.

Similarly, as shown in FIG. 37, protruded portions 13*j* are formed on edges of an open end of the toner developing frame C to which the developing sleeve 10*d* is assembled. And, the developing sleeve 10*d* is arranged so that the developing sleeve is positioned inwardly (toward the developing frame 13) from a line connected between tip ends of the protruded portions 13*j*. With this arrangement, when the developing frame 13, integrally joined to the toner frame 12, is rested on the table, the protruded portions 13*j* are contacted with the table and the developing sleeve 10*d* is not contacted with the table.

In this way, since the developing sleeve 10*d* or the photosensitive drum 7 is not contacted with the table, even when the developing frame 13 or the cleaning frame 14 is rested on the table, the inadvertent damage of the photosensitive drum 7 and the like can be prevented, thus improving the assembling operability. After the various parts are assembled to the toner frame 12, developing frame 13 and cleaning frame 14 in this way, the developing frame 13 is joined to the cleaning frame 14 to assemble the process cartridge B. The connection between the frames 13 and 14 is effected by connection members 38 shown in FIG. 38. Next, the connection between the frames 13, 14 will be explained.

Figure 38:
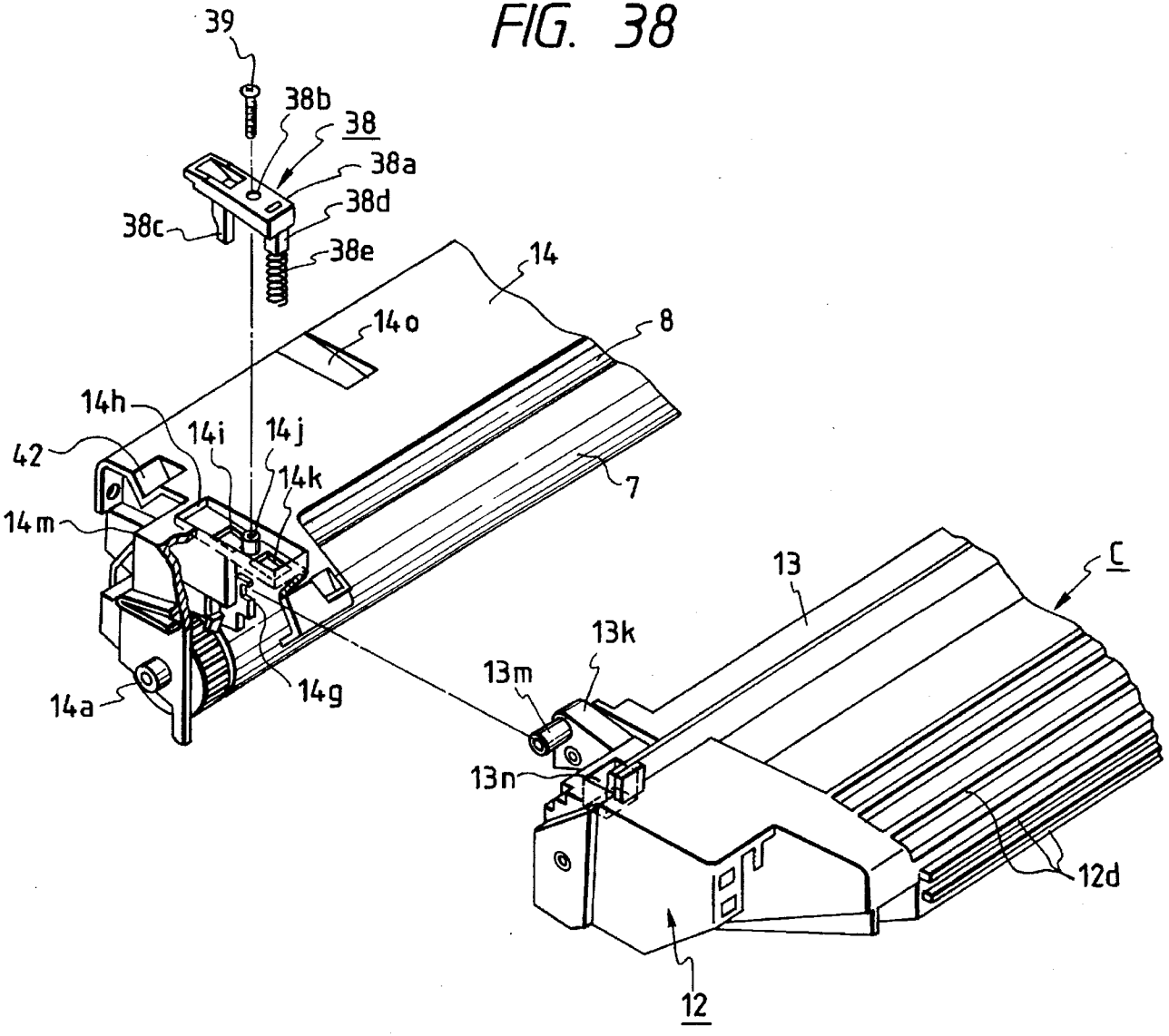
FIG. 38 is an exploded partial perspective view showing a method for connecting the toner developing frame and the cleaning frame by connecting members.

In FIG. 38, the connection member 38 comprises a base member 38*a* having a threaded hole 38*b* through which a screw 39 is threaded, a vertical portion 38*c*, and a spring attachment portion 38*d*, which portions 38*c*, 38*d* are disposed on both sides of the threaded hole 38*b*. The vertical portion 38*c* protrudes downwardly from the base member 38*a* to prevent a connection projection (described later) of the developing frame 13 from falling out. The spring attachment portion 38*d* is disposed in parallel with the vertical portion 38*c* and is provided at its free end portion with a spring 38*e* which is protruded downwardly more than the vertical portion 38*c*. Arm portions 13*k* are provided on both longitudinal ends of the developing frame 13, and a connection projection 13*m* is protruded laterally from each arm portion 13*k*. Further, a spring receiving recessed portion 13*n* is formed on an upper surface of each arm portion 13*k*.

On the other hand, connection recessed portions 14*g*, into which the connection projections 13*m* are fitted, are provided in the cleaning frame 14. And, a fastening portion 14*h* is formed on each recessed portion 14*g*. The fastening portion 14*h* has a fitting hole 14*i* into which the vertical portion 38*c* of the connection member 38 is fitted, a female threaded portion 14*j* into which the screw 39 is threaded, and a through hole 14*k* through which the spring 38*e* extends.

Figure 39A:
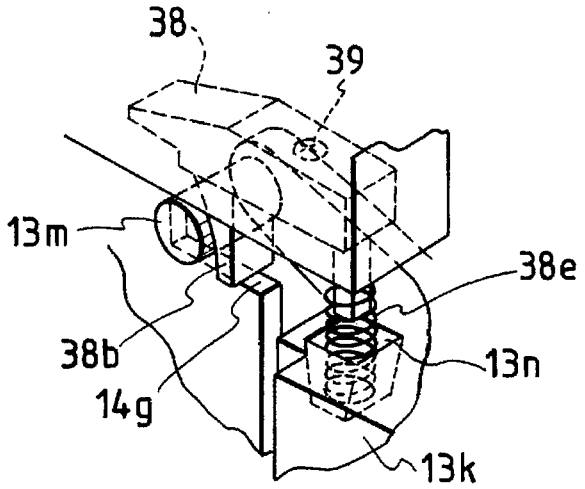
FIG. 39A is a perspective view showing a condition that the connecting members are attached.
Figure 39B:
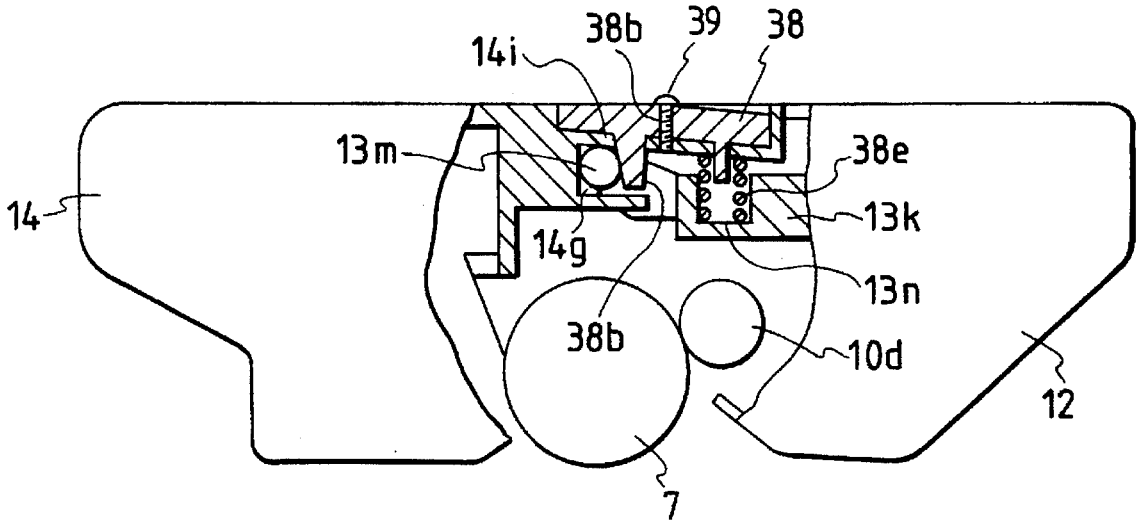
FIG. 39B is a sectional view showing a condition that the connecting members are attached.

To join the toner developing frame C and the cleaning frame 14, as shown in FIGS. 39A and 39B, the connection projections 13*m*, of the developing frame 13, are deeply fitted into the corresponding connection recessed portions 14*g* of the cleaning frame 14, and then the connection members 38 are fastened to the fastening portions 14*h*. That is to say, each vertical portion 38*c*, of the connection member 38, is fitted into the hole 14*i*, and the spring 38*e* is passed through the through hole 14*k* and is compressed against the spring receiving recessed portion 13*n* of the developing frame 13. In this condition, the screw 39 is threaded into the threaded hole 38*b* and is fastened to the female threaded portion 14*j*.

In this way, the toner developing frame C and the cleaning frame 14 are connected to each other for relative pivotal movement around the connection projections 13*m*, thereby completing the assembling of the process cartridge B. In a condition where the frames 13 and 14 are interconnected, the ring members 10*f* are abutted against the peripheral surface of the photosensitive drum 7, thereby determining the positions of the photosensitive drum 7 and the developing sleeve 10*d*. Further, by spring forces of the compressed springs 38*e*, the developing sleeve 10*d* is biased toward the photosensitive drum 7 (Incidentally, in the illustrated embodiment, the spring force of the spring 38*e* is selected to about 2 kg to urge the developing sleeve 10*d* with a force of about 1 kg). Further, when the toner developing frame C is joined to the cleaning frame 14, the helical gear 7*c*, provided at the end of the photosensitive drum 7, is meshed with the gear 10*g* provided at the end of the developing sleeve 10*d*.

In the joint construction between the toner developing frame C and the cleaning frame 14 according to the illustrated embodiment, since the toner developing frame C can be mounted in a direction of the connection recessed portions 14*g*, the connection projections 13*m* can be extended outwardly (these may be extended inwardly). Thus, the frames 13 and 14 can be positioned with respect to the longitudinal direction thrust direction), thereby eliminating the need for providing thrust stoppers.

Further, since the connection members 38 are inserted from the above and are fastened, the toner developing frame C can be pressurized at the same time as when the connection members 38 are fastened. In this respect, conventionally, after the toner developing frame was joined to the cleaning frame, it was required to hook a tension spring to the frames to urge the frames against each other, with the result that a space for arranging the tension spring was required and the spring hooking operation was troublesome. However, according to the illustrated embodiment, it is possible to eliminate the provision of such tension spring and save the installation space for the tension spring. Further, when the frames are disconnected from each other, by loosening the screws 39, the compression forces of the compressed springs 38*e* are released, thereby permitting very easy disassembling of the frames because of no thrust stopper.

(Cartridge Mounting Construction):

Next, the construction for mounting the process cartridge B to the image forming apparatus A will be explained.

Figure 40:
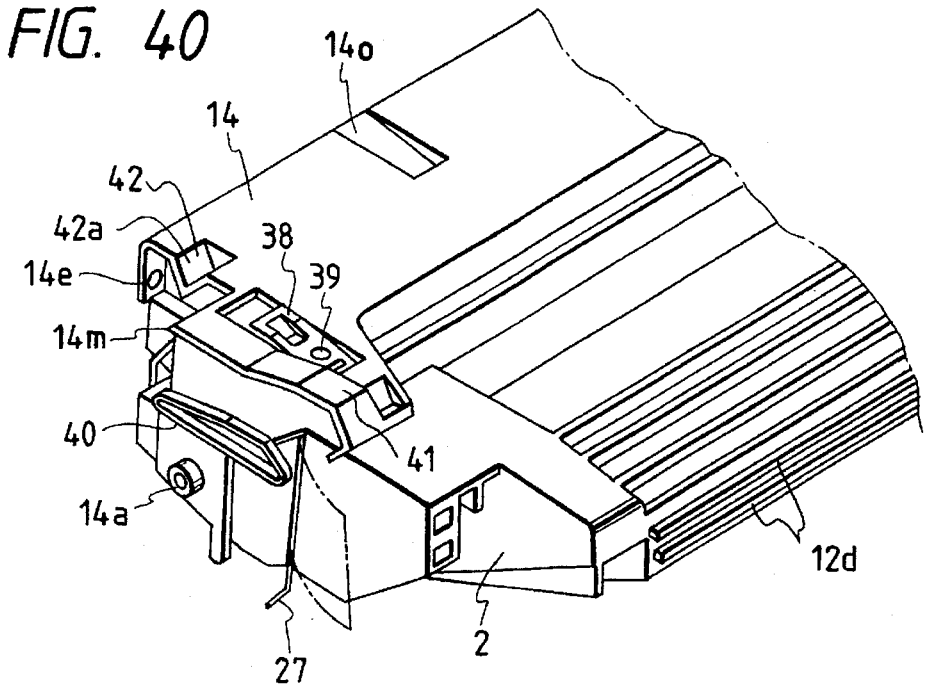
FIG. 40 is a partial perspective view showing a left end surface of a process cartridge.

As shown in FIGS. 5 and 6 and as mentioned above, the left guide member 17 having the first and second guide portions 17*a*, 17*b* and the right guide member, 18 having the first and second guide portions 18*a*, 18*b*, are formed on the frame 15 of the image forming apparatus. In correspondence to these guide members, as shown in FIG. 4 (showing the right side surface of the process cartridge B) and FIG. 40 (showing the left side surface of the cartridge), the bearing portion 14*a* and the shaft 21 (which are guided along the first guide portions 17*a*, 18*a*) are protruded from the left and right side surfaces of the cleaning frame 14 of the process cartridge B substantially in left/right symmetry. Further, protruded ribs 40, which are to be guided along the second guide portions 17*b*, 18*b*, are arranged above the bearing portion 14*a* and the shaft 21 in left/right symmetry.

Further, pressure surfaces 41 are formed on the upper surface of the cleaning frame 14 at both longitudinal ends thereof, which pressure surfaces are pressurized by pressure members 19 attached to the frame 15 of the image forming apparatus. Furthermore, there are provided positioning recesses 42 for receiving the abutment members 20 and for positioning the abutment members. In addition, an auxiliary rib 43 is protruded from the right side surface of the cleaning frame 14 above the protruded rib 40, as shown in FIG. 4. Further, there is provided a link portion 35*a* for opening and closing the drum shutter 35. The link portion 35*a* is pivoted in response to the mounting and dismounting movement of the process cartridge B, thereby opening and closing the drum shutter 35 connected to the link portion. Incidentally, the opening and closing of the drum shutter 35 will be described later fully.

Now, the mounting and dismounting of the process cartridge B with respect to the image forming apparatus A will be explained with reference to FIGS. 41 to 44. Incidentally, although the left and right sides of the process cartridge B are similarly guided by the left and right guide members 17 and 18, to clarify and simplify the explanation, only the right guide member 18 will be explained.

Figure 41:
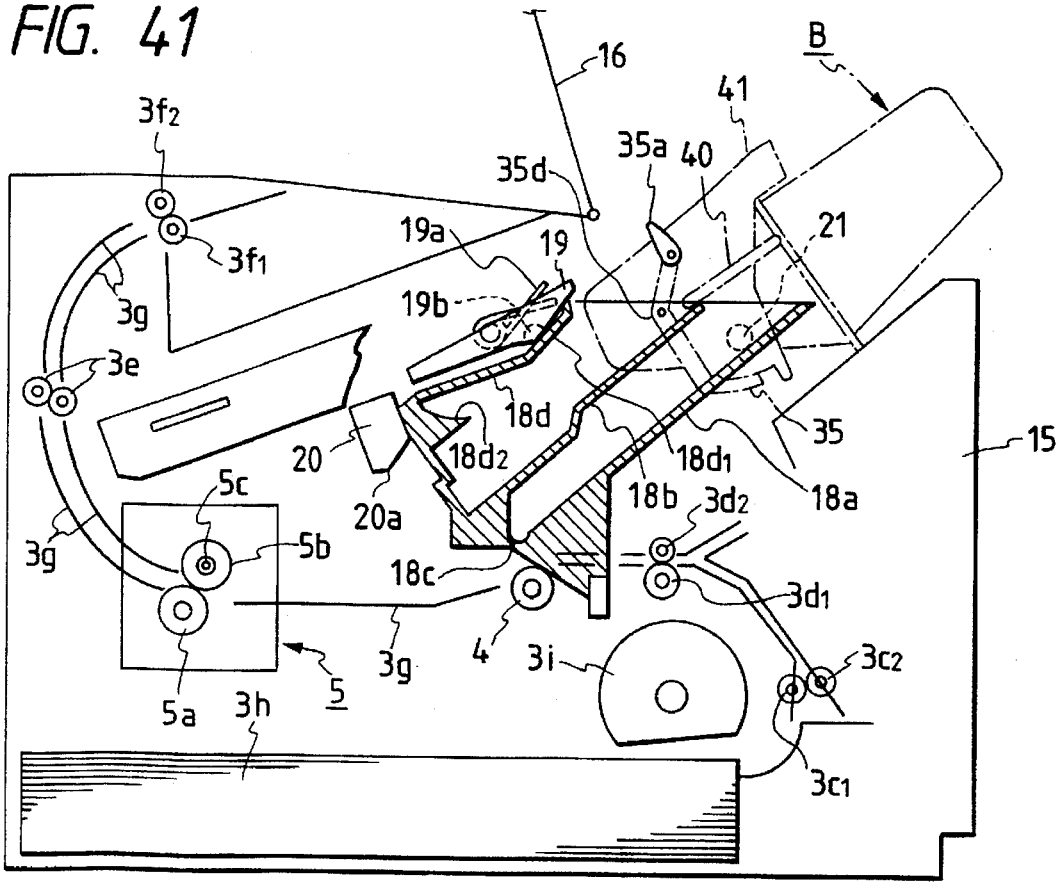
FIG. 41 is an elevational sectional view showing a condition that the process cartridge is mounted to an image forming apparatus.
Figure 42:
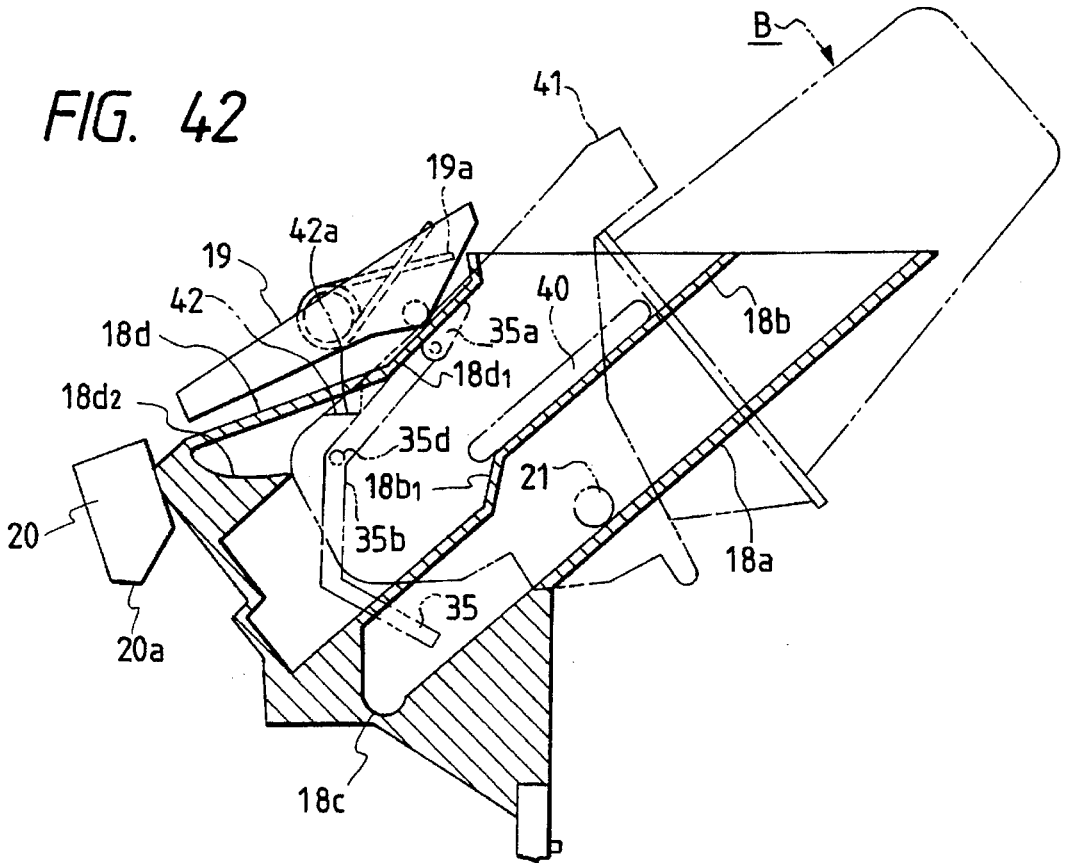
FIGS. 42 to 45 are enlarged partial sectional views showing a condition that the process cartridge is mounted to the image forming apparatus.

First of all, as shown in FIG. 41, after the opening/closing cover 16 of the frame 15 of the image forming apparatus is opened, the shaft 21 of the process cartridge B is rested on the first guide portion 18*a*, and the protruded rib 40 is rested on the second guide portion 18*b*. Then, as shown in FIG. 42, the shaft 21 and the protruded rib 40 are slid along the guide portions 18*b*, 18*a* to insert the process cartridge into the frame 15 of the apparatus. As a result, the pressure surfaces 41 of the process cartridge B are pressurized by the pressure members 10 of the frame 15, whereby the process cartridge B is inserted into the frame while being urged against the second guide portion 18*b*.

Figure 43:
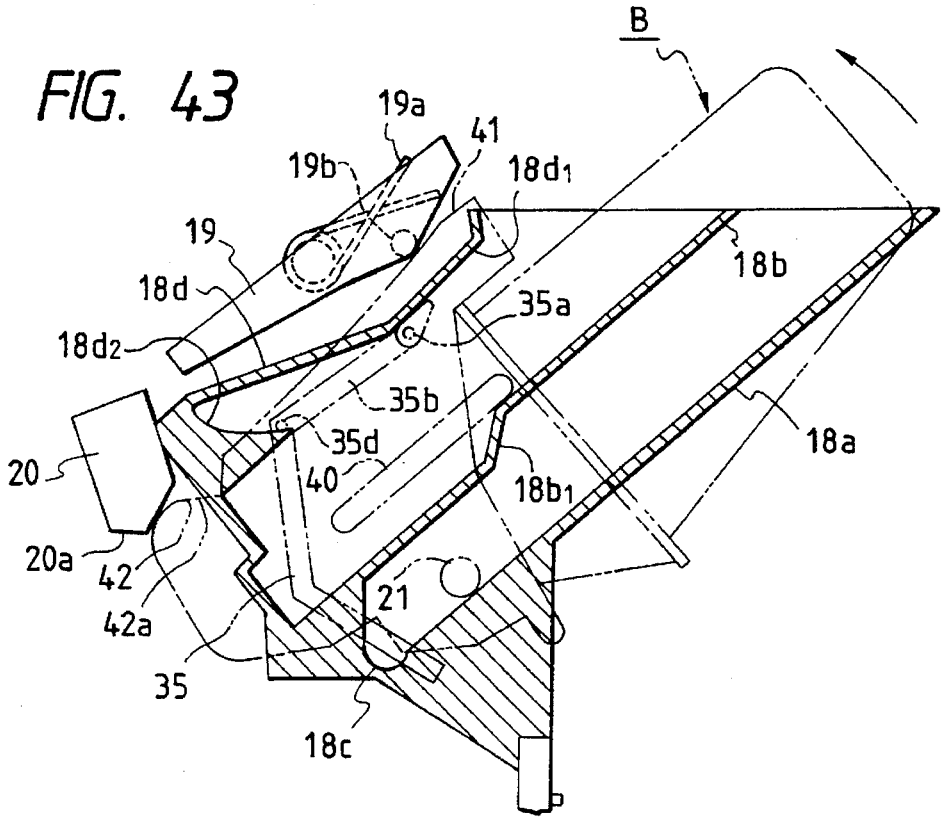
Figure 44:
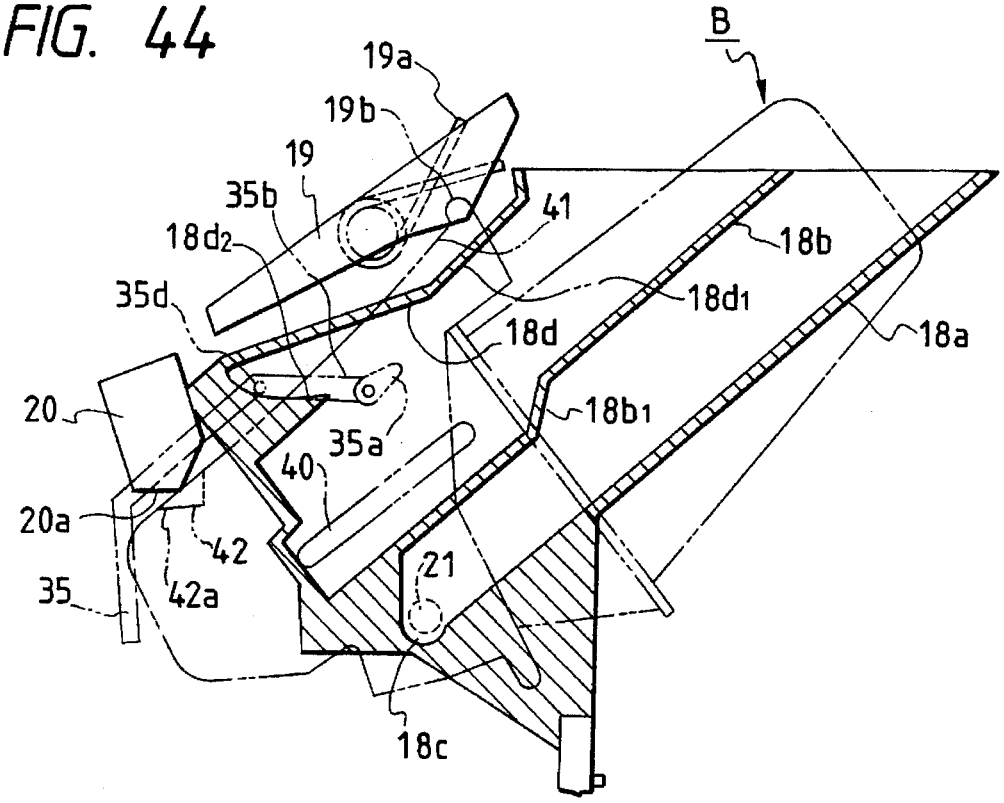
Figure 45:
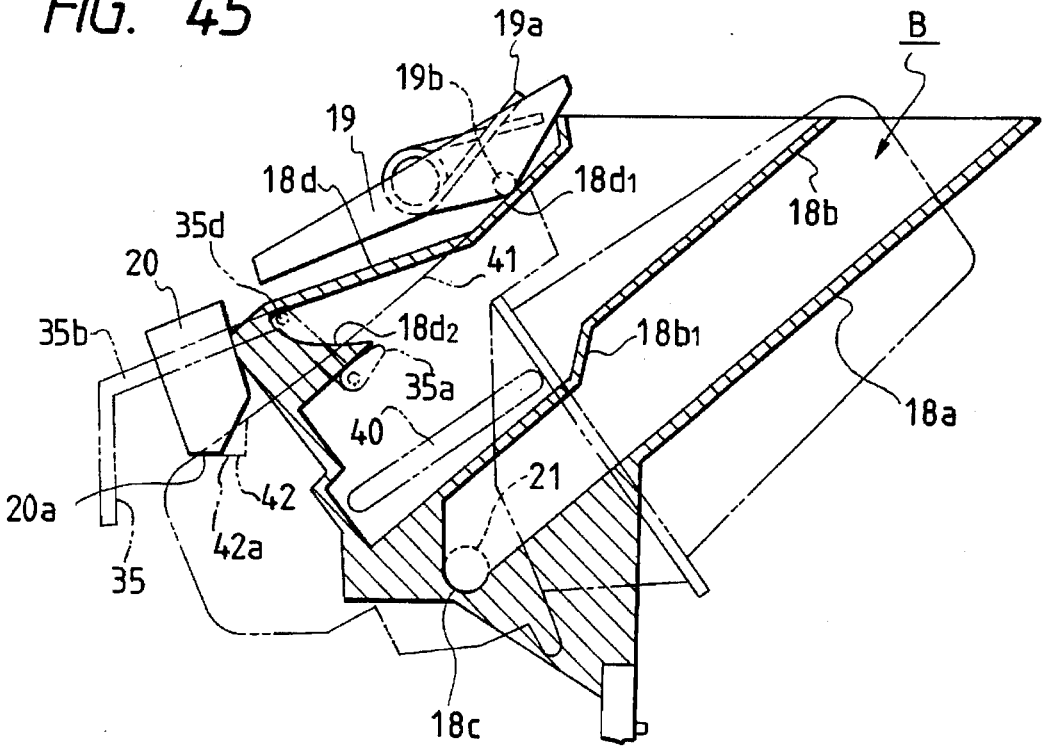

Then, as shown in FIG. 43, when the protruded rib 40 exceeds the second guide portion 18*b*, the process cartridge B is rotated slightly in an counter-clockwise direction by the urging forces of the pressure members 19, thereby supporting the shaft 21 on the first guide portion 18*a*. When the process cartridge B is further inserted, as shown in FIG. 44, the process cartridge B is further rotated in the anti-clockwise direction, with the result that the abutment members 20 of the frame 15 are engaged by the positioning recesses 42 of the process cartridge B. Thereafter, when the operator releases the process cartridge, as shown in FIG. 45, the shaft 21 of the process cartridge B is dropped into the bearing portion 18*c* by its own weight. In this case, the abutment members 20 are completely engaged by the positioning recesses 42, with the result that the process cartridge B is mounted to the frame 15 of the image forming apparatus while being pressurized by the pressure members 19. Further, in this case, the helical gear 7*c* of the photosensitive drum 7 is meshed with the drive gear (refer to FIG. 6) in the frame 15, thereby permitting the transmission of the driving force. Further, when the process cartridge B is mounted, the urging forces of the pressure members 19 against the process cartridge B are relieved by the lowering movement of the process cartridge B. Thus, the operator who has mounted the process cartridge B feels a "click" feeling to easily recognize the fact that the process cartridge B was positioned at the mounting position.

Incidentally, the abutment members 20, of the apparatus frame 15, and the positioning recesses 42, of the process cartridge B, are so arranged that abutment surfaces 20*a*, 42*a* thereof are substantially in parallel with each other. Thus, the abutment members 20 may be assembled to the frame 15 in such a manner that the abutment surfaces 20*a* are disposed substantially horizontally. Therefore, the design of the abutment members 20 and the assembling of the abutment members to the frame 15 can be simplified or facilitated, with the result that it is hard for a dimensional error to occur. Accordingly, it is easy to mount the process cartridge B to the frame 15 of the image forming apparatus correctly.

Incidentally, a roller 19*b* is mounted on each pressure member 19, so that the sliding resistance is minimized by pressurizing the process cartridge by the rollers 19*b* when the process cartridge B is being shifted while pressurizing the pressure surfaces 41 by the pressure members 19. Further, in the illustrated embodiment, while the pressure surfaces 41 of the process cartridge B pressurized by the rollers 19*a* were formed as surface configuration, such process surfaces may be ribbed-shape to reduce the contacting area, thereby further reducing the sliding resistance.

Further, as apparent from the sectional view in FIG. 1 and the perspective view in FIG. 4, the upper portion of the process cartridge B is made substantially flat, and the flat upper surface of the process cartridge is substantially in parallel with the cartridge mounting direction. Thus, the cartridge mounting space in the frame 15 of the image forming apparatus can be minimized, and the space in the process cartridge B (for example, spaces for the toner reservoir and the waste toner reservoir) can be used efficiently.

Figure 46:
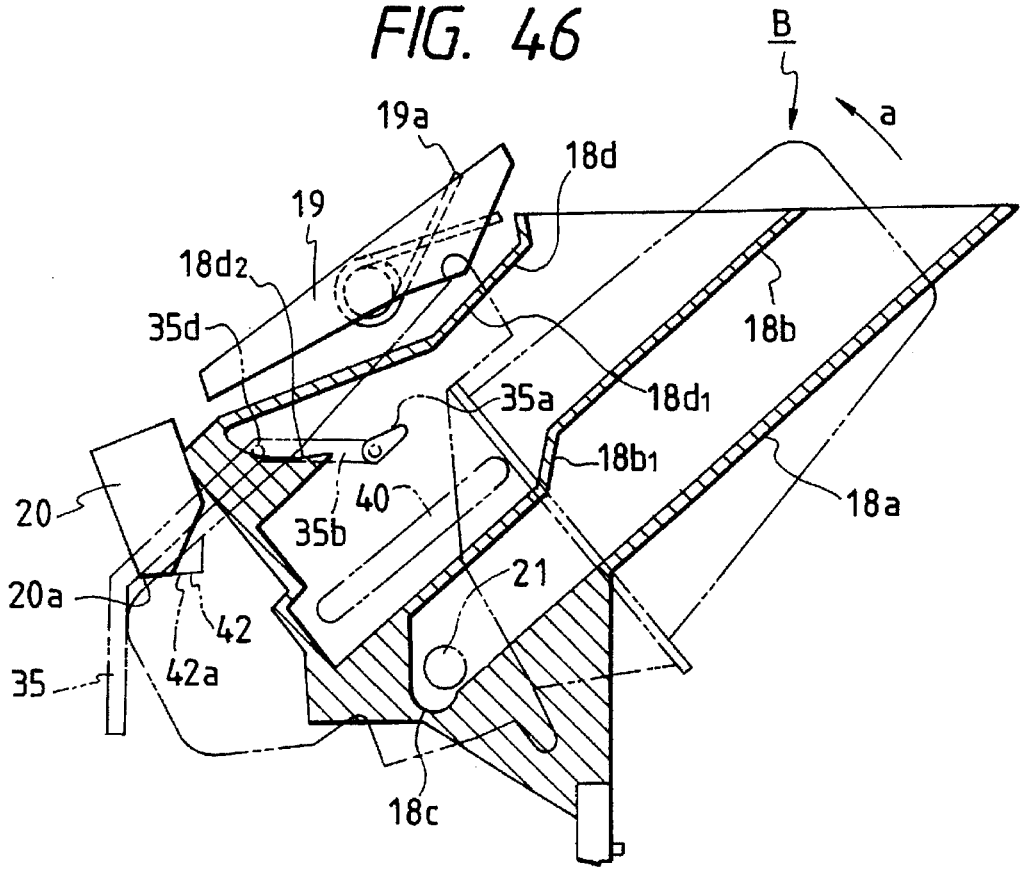
FIG. 46 is an enlarged partial sectional view showing a condition that the process cartridge is dismounted from the image forming apparatus.

On the other hand, when the process cartridge B is dismounted, as shown in FIG. 46, the process cartridge B is rotated in a slightly counter-clockwise direction (shown by the arrow a), thereby permitting the riding of the protruded rib 40 over the stepped portion 18*b*1 of the second guide portion 18*b*, with the result that the process cartridge can be dismounted by drawing out the process cartridge as it is. Incidentally, when the process cartridge B is rotated in the counter-clockwise direction, if the cartridge is rotated excessively, the auxiliary rib 43 (refer to FIG. 4) is abutted against the shutter cam portion 18*d* (and, regarding the left guide member 17, the protruded rib 40 is abutted against the rocking movement regulating guide portion (refer to FIG. 5)), thereby regulating anti-clockwise rotation of the process cartridge. Further, when the process cartridge is mounted, the auxiliary rib 43, provided at the right side of the process cartridge, is inserted between the second guide portion 18*b* and the shutter cam portion 18*d*, and the protruded rib 40 provided at the left side of the cartridge is inserted between the second guide portion 17*b* and the rocking movement regulating guide portion 17*d*. Thus, the moving paths when the process cartridge B is mounted and dismounted are further regulated, thereby mounting and dismounting the process cartridge B more smoothly.

(Drum Shutter Opening/Closing Construction):

The drum shutter 35 is opened and closed in response to the mounting and dismounting movement of the process cartridge. Now, the opening/closing operation of the drum shutter will be explained.

As shown in FIG. 4, the drum shutter 35 has an arm portion 35*b* pivotally mounted around a shaft 35*c*, and a link portion 35*a* that is pivotally mounted on the shaft 35*c* for movement together with the arm portion 35*b*. Thus, when the link portion 35*a* is pivoted, the arm portion 35*b* is also pivoted, thereby opening and closing the drum shutter 35. Further, a link boss 35*d* is protruded from the arm portion 35*b*. By engaging the link portion 35*a* and the link boss 35*d* with the shutter cam portion 18*d*, the drum shutter 35 is opened and closed. The opening and closing of the drum shutter will be explained in connection with the mounting of the process cartridge B to the image forming apparatus A with reference to FIGS. 41 to 45.

As shown in FIGS. 41 to 45, the shutter cam portion 18*d* provided on the right guide member 18 has a first cam portion 18*d*1 engaged by the link portion 35*a*, and a second cam portion 18*d*2 engaged by the link boss 35*d*. An inclined angle of the first cam portion 18*d*1 is substantially the same as that of the second guide portion 18*b* for guiding the protruded portion 40 of the process cartridge B, and an inclined angle of the second cam portion 18*d*2 is greater than that of the first cam portion 18*d*1.

As shown in FIG. 41, when the process cartridge B is inserted and is pushed, the link portion 35*a* is engaged by the first cam portion 18*d*1 of the shutter cam portion 18*d*, as shown in FIG. 42, thereby rotating the link portion 35*a* around the shaft 35*c*. As a result, the arm portion 35*b* is rotated to open the drum shutter 35; however, in this case, the drum shutter is not completely opened but is in a so-called half open condition. When the cartridge B is further pushed, as shown in FIG. 43, the rotation of the arm portion 35*b* causes the disengagement between the link portion 35*a* and the first cam portion 18*d*1 and at the same time the engagement between link boss 35*d* and the second cam portion 18*d*2. And, when the mounting of the process cartridge B is completed, as shown in FIG. 45, the drum shutter 35 is completely opened so that the recording medium 2, fed below the cartridge, does not interfere with the drum shutter.

Incidentally, when the process cartridge B is drawn from the condition shown in FIG. 45 to dismount the process cartridge B from the image forming apparatus A, by a spring force of a torsion coil spring 35*e*, locked to the arm portion 35*b*, the shutter cam portion 18*d* is engaged by the link boss 35*d* and then by the link portion 35*a* in an order opposite to the aforementioned order, thus closing the drum shutter 35.

The above-mentioned drum shutter 35 serves to protect the photosensitive drum 7. In the illustrated embodiment, other than the drum shutter 35, the laser shutter is provided in the image forming apparatus A. The laser shutter constitutes a laser light path blocking means to prevent the laser light emitted from the optical system 1 to the photosensitive drum 7 from leaking from the optical unit 1*a* (of the image forming apparatus) in an inoperative condition of the apparatus.

Figure 47:
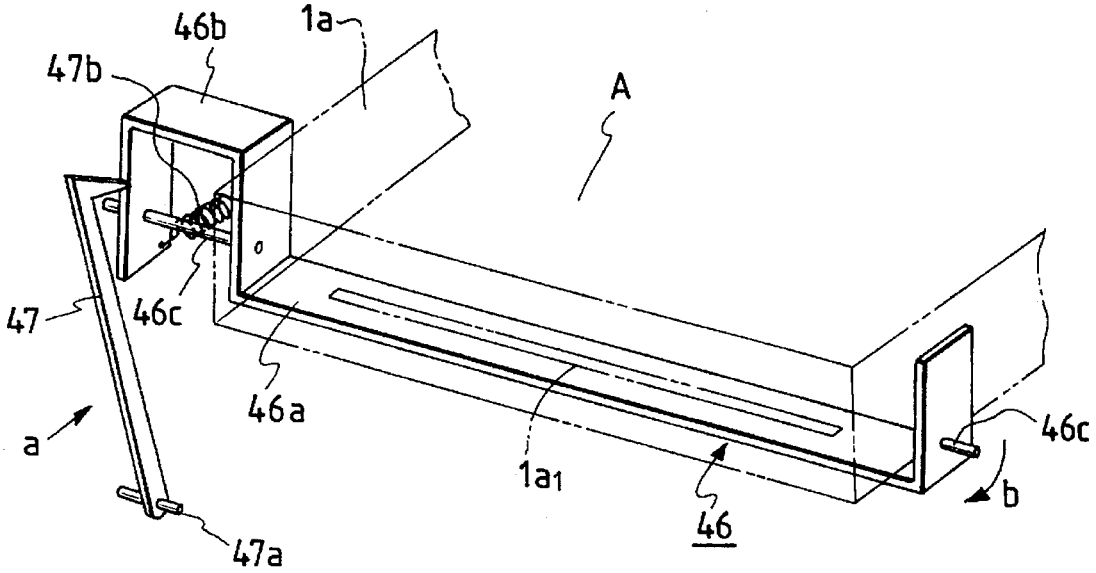
FIG. 47 is a perspective view showing a mechanism for opening and closing a laser shutter.

(Laser Light Path Blocking Means):

Next, the construction of the laser light path blocking means will be explained. As shown in FIG. 47, the optical unit 1*a* is provided with an opening 1*a*1 through which the laser light is illuminated onto the photosensitive drum 7, and the laser shutter 46 is formed from a metal plate bent to cover the opening 1*a*1. That is to say, the laser shutter 46 has a shutter portion 46*a* comprising the bent metal plate, and a link portion 46*b* disposed at the left of the shutter portion and integrally formed therewith. The laser shutter 46 is pivotally mounted on the frame 15 of the image forming apparatus via shafts 46*c*.

Further, in the vicinity of the left guide member 17 for guiding the process cartridge B, an arm member 47 is pivotally mounted around a shaft 47*a*. The arm member 47 has a free end engageable by the link portion 46*b* of the laser shutter 46 and is positioned to abut against the end of the process cartridge B when the cartridge B is mounted to the frame 15 of the apparatus.

With this arrangement, when the process cartridge B is inserted while being guided by the left and right guide members 17 and 18, an opening/closing member of the cartridge B pushes the arm member 47 in a direction shown by the arrow a in FIG. 47. As a result the free end of the arm member 47 urges the link portion 46*b* of the laser shutter 46, thereby rotating the shutter portion 46*b* in a direction shown by the arrow b. Consequently, the opening 1*a*1 of the optical unit 1*a* is opened, thus permitting the illumination of the laser light onto the photosensitive drum 7.

Further, by a biasing force of a tension spring attached to the link portion 46*b* of the laser shutter 46, the laser shutter 46 is always biased toward a direction to close the opening 1*a*1. Thus, when the operator dismounts the process cartridge B from the image forming apparatus A, since the urging force of the arm member 47 is released, the laser shutter 46 automatically closes the opening 1*a*1 by the spring force of the spring 47*b*.

Accordingly, other than the case where the process cartridge B is mounted to the image forming apparatus to permit the image recording operation, the laser lgiht is prevented from illuminating onto the photosensitive drum 7 and the like from the optical unit 1*a*. Further, since the link portion 46*b* and the arm member 47, for opening and closing the laser shutter 46, are positioned in the vicinity of the left guide member 17 and opposite to the right guide member 18, the space for installing these elements can be used effectively. Accordingly, effective use of the space can be achieved, and, thus, the apparatus can be made small-sized. Incidentally, in the illustrated embodiment, as shown in FIG. 48, the position where the projection 14*m* is abutted against the arm member 47 is spaced apart from the longitudinal end of the cartridge by a distance Y1 of about 5–6 mm.

Figure 48:
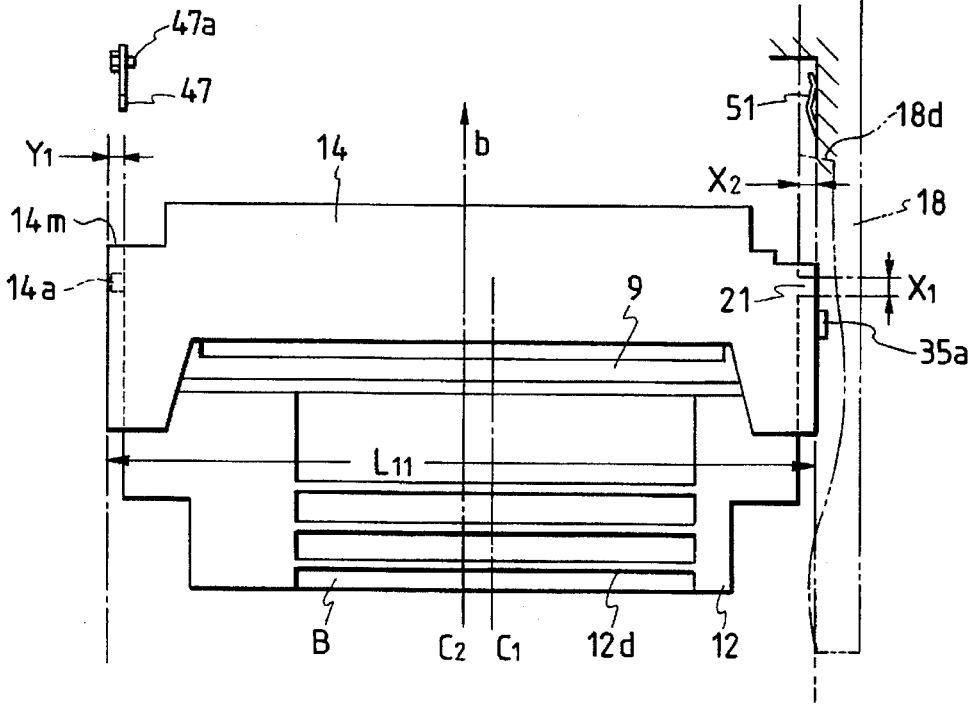
FIG. 48 is a view showing a gripper portion on which lateral ribs are formed.

(Offset of Gripper Portion):

As shown in FIG. 48, when the operator mounts the process cartridge B to the image forming apparatus A, the projection 14*m* (acting as an opening member) provided at the left (in longitudinal or thrust direction) shoulder portion of the process cartridge B urges the arm member 47 (for opening and closing the laser shutter 46) provided on the frame of the apparatus. Substantially at the same time, the metal shaft 21 (having a diameter X1 of about 10 mm and a protruding amount X2 of about 5 mm) protruded from the right side of the process cartridge B and acting as a drum earth is contacted with an earthing contact member (electric contact) 51 having a spring feature and provided on the frame of the apparatus. Further, the link portion provided on the right side of the cartridge B is abutted against the shutter cam portion 18*d* of the frame to open the drum shutter 35.

Accordingly, when the cartridge B is mounted, the left side of the cartridge B in the longitudinal direction is subjected to a load for resisting the biasing force of the spring 47*b*, in order to open the laser shutter 46. On the other hand, the right side of the process cartridge B is subjected to a load for deforming the contact member 51, having the spring feature due to the contact between the metal shaft 21 and the earthing contact member 51, and a load for resisting to the biasing force of the torsion coil spring 35*e* in order to open the drum shutter 35. In the illustrated embodiment, among the above loads, the load for opening the drum shutter 35 is greatest. As a result, when the cartridge B is inserted, the cartridge is subjected to the load offset from a longitudinal center C2 of the cartridge.

Thus, in the illustrated embodiment, as shown in FIG. 48, the ribs 12*d* are arranged so that the longitudinal center C1 of the ribs (constituting the gripper portion of the cartridge B) is offset from the longitudinal center C2 of the process cartridge B toward a side where the link portion 35*a* of the drum shutter 35 and the metal shaft (conductive member) 21 are provided. That is to say, in the illustrated embodiment, the longitudinal center C1 of the ribs 12*d* is offset from the center C2 of the longitudinal length L11 (about 300 mm) of the process cartridge B by about 10 mm (The longitudinal center C1 of the ribs 12*d* is offset from a center of a recording medium convey path when the process cartridge B is mounted to the image forming apparatus A by about 10 mm or is offset from a longitudinal center of the photosensitive drum 7 of the process cartridge B by about 10 mm).

Figure 49:
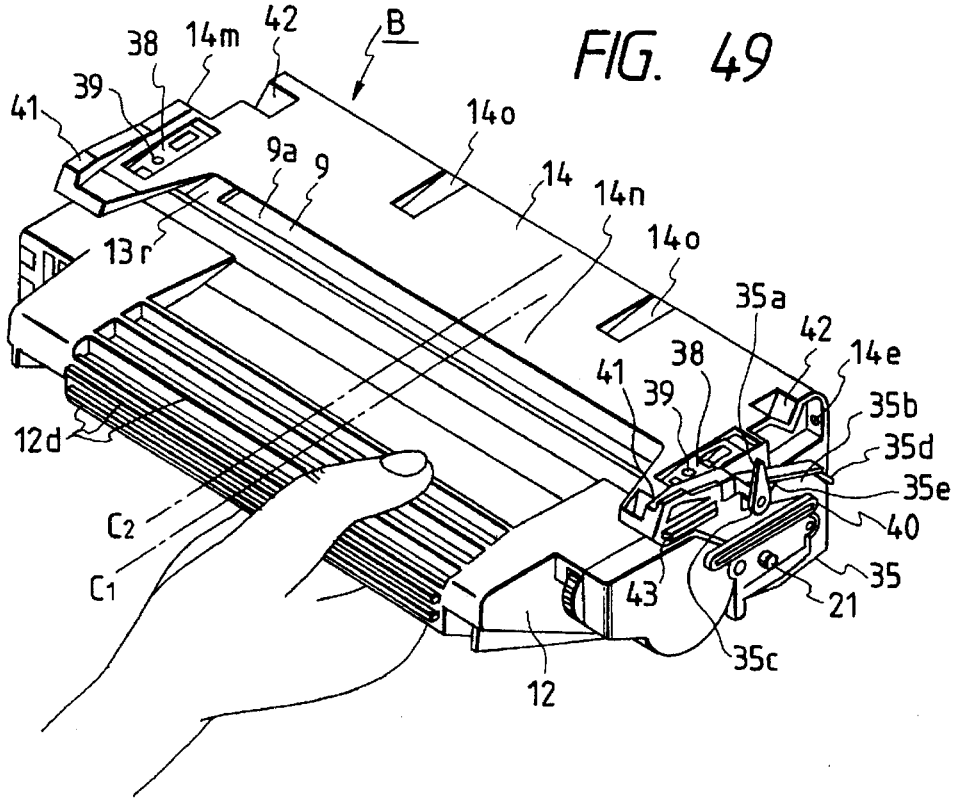
FIG. 49 is a perspective view showing a condition that the gripper portion of the cartridge is gripped by hand.

With this arrangement, when the cartridge B is mounted to the image forming apparatus A, as shown in FIG. 49, the operator grips the right side from the longitudinal center C2 of the cartridge B, i.e., a side where the link portion 35*a* of the drum shutter 35 is provided to insert the cartridge into the frame of the apparatus. To do so, in the longitudinal direction of the cartridge B, the side where the link portion 35*a* is provided is subjected to a force slightly greater than the other side. Due to the offset of force, the load for opening and closing the drum shutter 35 is cancelled, whereby the cartridge S can be smoothly inserted into the image forming apparatus A without any play, as a whole. Further, since the ribs 12*d* are disposed in parallel with the photosensitive drum 7 arranged in the longitudinal direction of the cartridge B, when the cartridge is inserted while gripping the ribs 12*d*, the longitudinal direction of the cartridge can easily be maintained perpendicular to the cartridge inserting direction, thereby easily eliminating any play at both longitudinal ends of the cartridge during the insertion of the cartridge.

Figure 50:
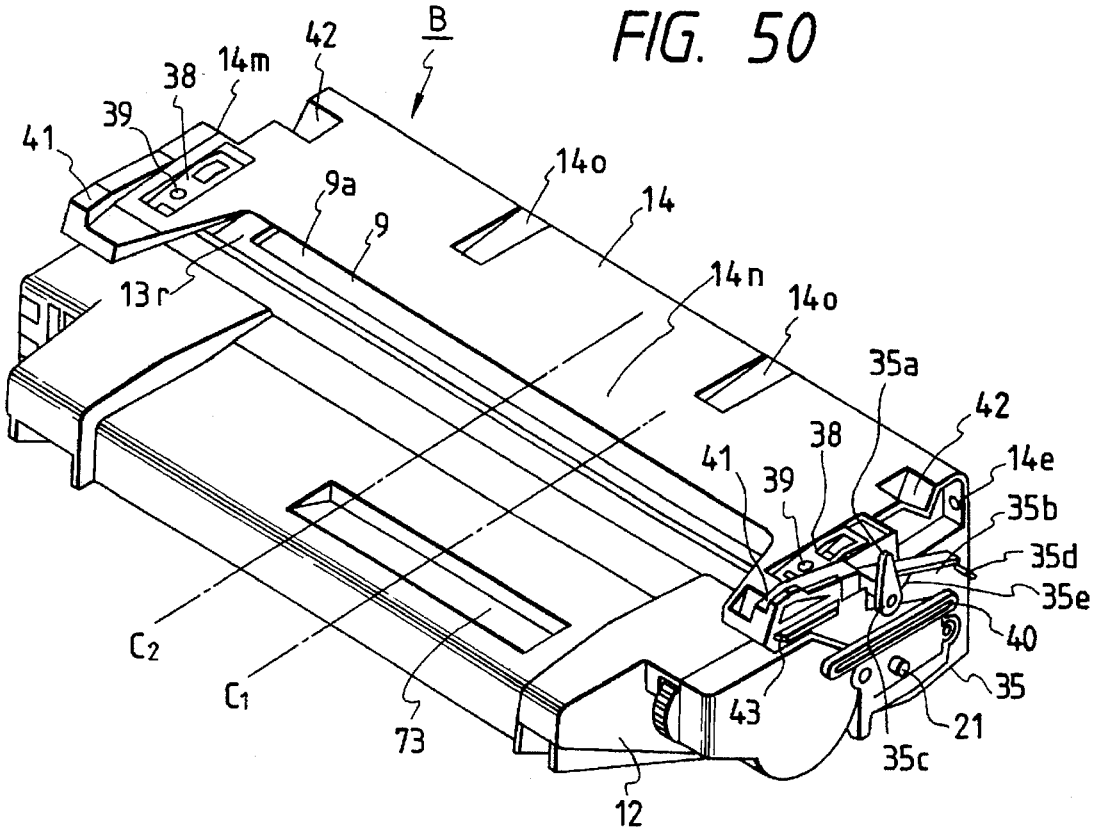
FIG. 50 is a perspective view showing a gripper portion in which a recess is formed.
Figure 51:
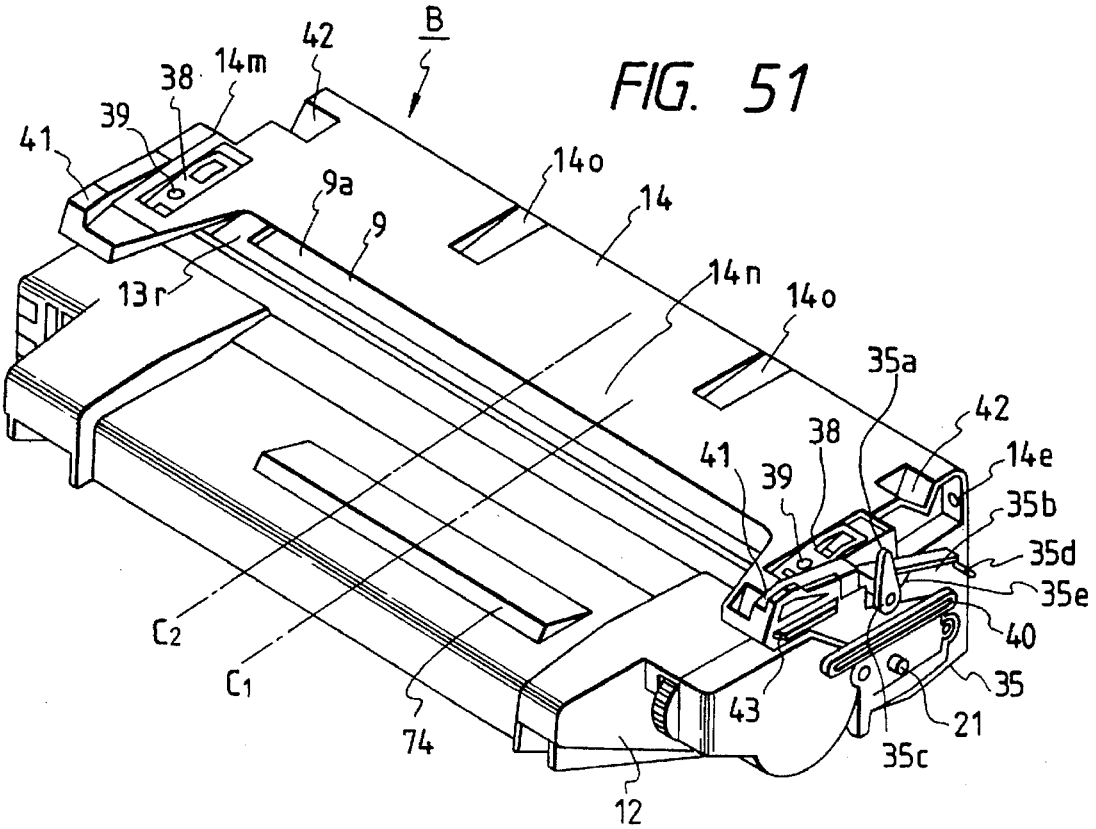
FIG. 51 is a perspective view showing a gripper portion on which a projection is formed.

Incidentally, although the gripper portion can be constituted by the ribs 12*d* as shown in FIG. 48, it may be constituted by a recess 73 formed in the frame, as shown in FIG. 50, or may be constituted by a projection or ridge 74 formed on the frame as shown in FIG. 51. That is to say, the gripper portion may have any configuration so long as the operator can easily grip it.

Further, in the illustrated embodiment, while an example that the gripper portion is arranged offset toward the side where the link portion 35*a* of the drum shutter 35 and the metal shaft 21 are provided was explained, the present invention is not limited to this example. For example, when the spring force of the spring 47*b* of the laser shutter 46 is strong and the load for resisting to the biasing force of the coil spring 35*e* is stronger than the load for resisting to the biasing force of the spring 47*b* and the load for deforming the contact member 51, the gripper portion is arranged offset toward a side where the projection 14*m* is provided. In this way, the gripper portion is arranged offset toward a side where the frame is subjected to the greater mounting resistance generated due to the abutment between the parts of the image forming apparatus and the frame when the process cartridge is mounted to the image forming apparatus.

(Explanation of Electric Contacts):

Next, the electric connection between various parts when the process cartridge B is mounted to the image forming apparatus will be explained.

Figure 52:
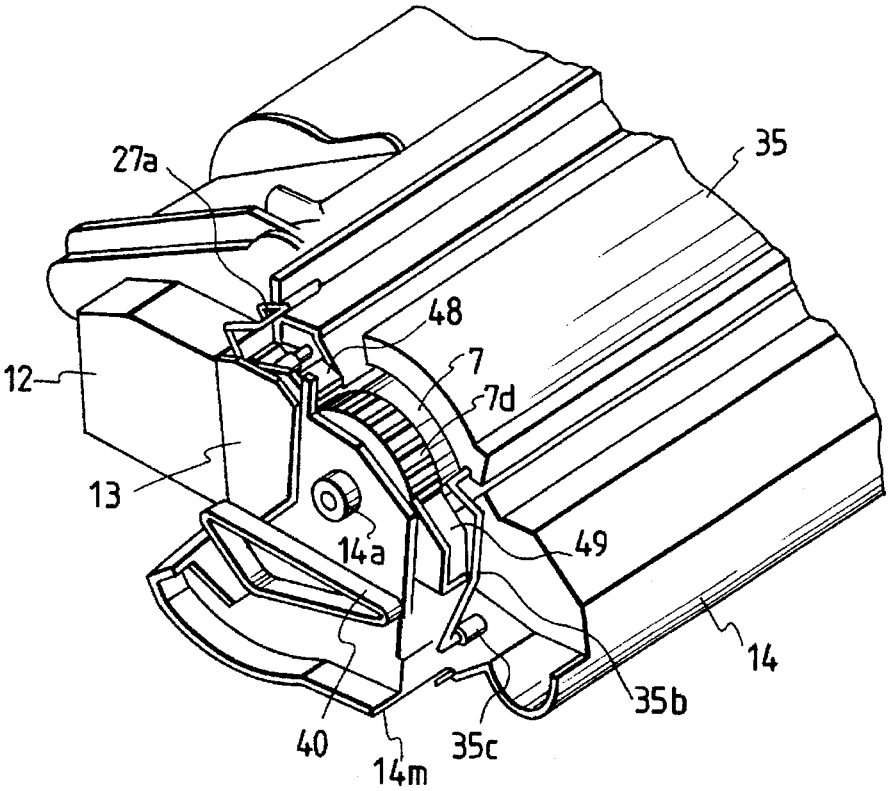
FIG. 52 is a partial perspective view showing the arrangement of various contacts provided on a process cartridge.

When the process cartridge B is mounted to the image forming apparatus A, various contact portions provided on the process cartridge B are contacted with various contact portions provided in the frame 15 of the image forming apparatus, thereby electrically connecting the process cartridge B to the image forming apparatus. That is to say, as shown in FIG. 52, the contact portion 27*a*, (made of stainless steel in the illustrated embodiment) as the conductive member provided on the end of the antenna line 27 for detecting the toner remaining amount, is exposed from the lower portion of the developing frame 13, and the developing bias contact portion 48, (made of stainless steel in the illustrated embodiment) as the conductive member for applying the developing bias to the developing sleeve 10*d*, is also exposed. Further, the charging bias contact portion 49 (made of stainless steel in the illustrated embodiment) as the conductive member for applying the charging bias to the charger roller 8 is exposed from the lower portion of the cleaning frame 14. More particularly, with respect to the photosensitive drum 7, the contact portion 27*a* of the antenna line 27 and the developing bias contact portion 48 are arranged at one side, and the charging bias contact portion 49 is arranged at the other side. Incidentally, the charging bias contact portion 49 is integrally formed with the contact member 26 (FIG. 10).

Figure 53:
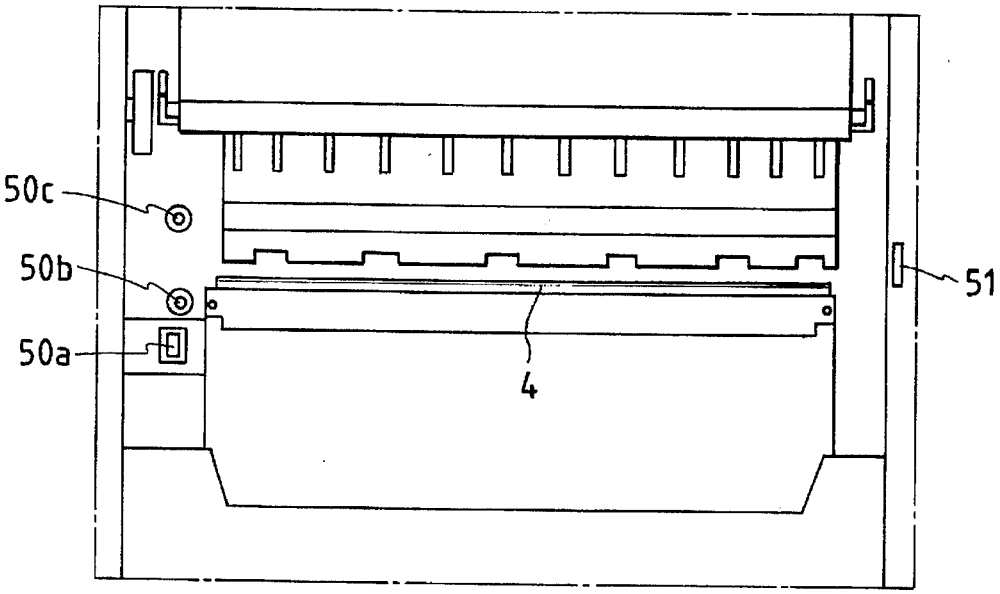
FIG. 53 is a plan view showing the arrangement of various contacts provided on an image forming apparatus.
Figure 54:
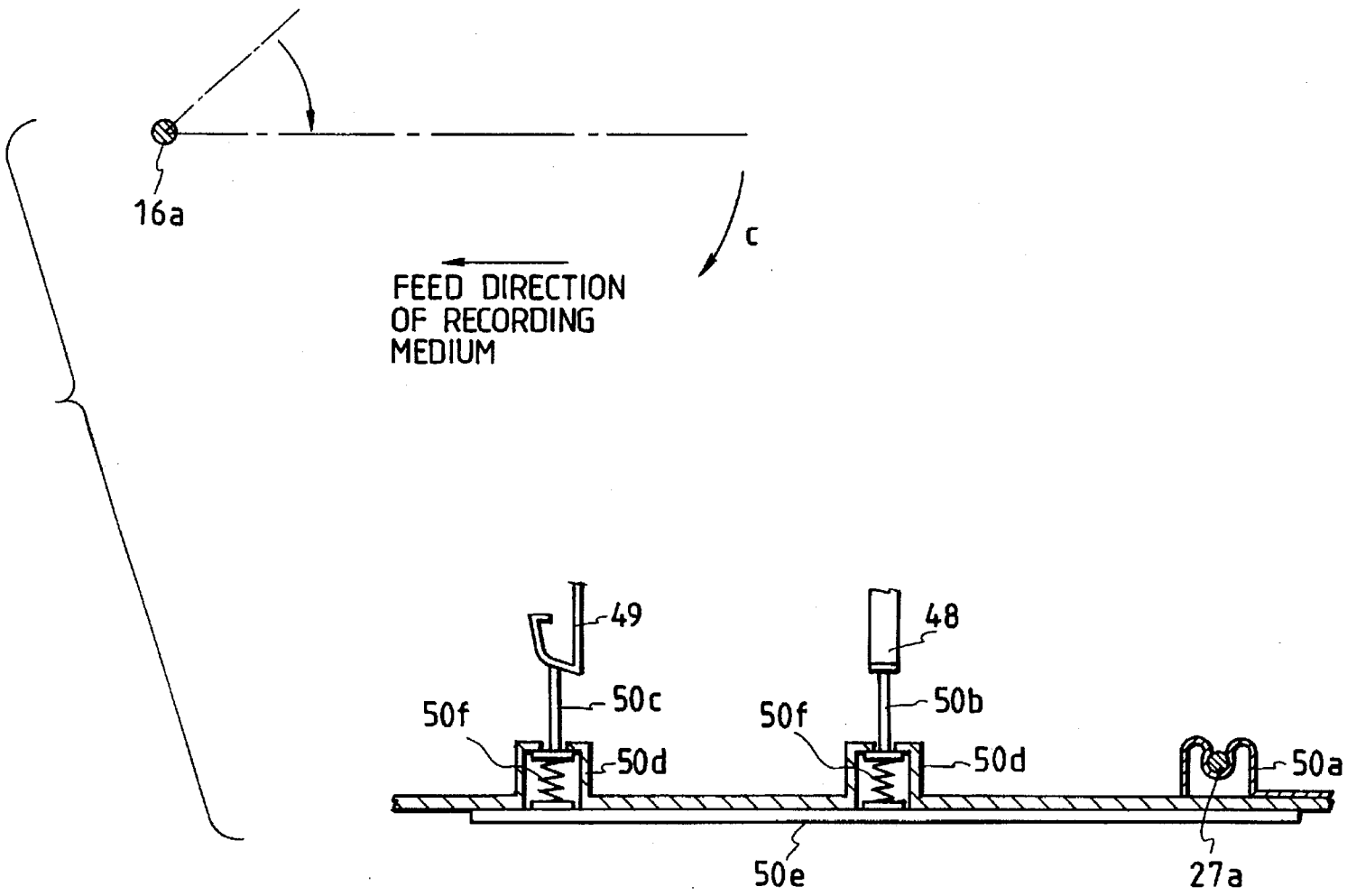
FIG. 54 is a sectional view showing a relation between the contacts and contact pins.

In correspondence to these contacts, as shown in FIG. 53, with respect to the transfer roller 4, an antenna line contact member 50, to which the contact portion 27*a* of the antenna line 27 is contacted when the process cartridge B is mounted, and a developing bias contact pin 50*b*, to which the developing bias contact portion 48 is contacted, are arranged at one side in the recording medium feeding direction, and a charging bias contact pin 50*c*, to which the charging bias contact portion 49 is contacted, is arranged at the other side. Incidentally, as shown in FIG. 54, the contact pins 50*b*, 50*c* are attached to respective holder covers 50*d*, not to slip out of the holder covers and can be protruded from the holder covers. The contact pins are biased upwardly by springs 50*f* and are electrically connected to the wiring pattern on an electric substrate 50*e* to which the holder covers 50*d* are attached via the springs 50*f*. Further, among the contact portions 48, 49 to which the contact pins 50*b*, 50*c* are abutted, the charging bias contact portion 49 is configured as an arcuated shape having straight portions and a curved portion connecting between the straight portions so that the curvature is formed at a side of the pivot hinge 16*a* of the opening/closing cover 16. Thus, when the opening/closing cover 16 is closed around the hinge 16*a* toward a direction shown by the arrow c after the process cartridge B is mounted, the charging bias contact portion 49 nearest the hinge 16*a* and having the minimum radius of rotation can be smoothly and effectively contacted with the contact pin 50*c*.

Further, the shaft 21 for supporting one end of the photosensitive drum 7 is made of metal, and the photosensitive drum 7 is earthed via the metal shaft 21. To this end, as shown in FIGS. 6 and 48, an earthing contact member 51 comprising a leaf spring earthed via a chassis of the frame 15 and the like is provided at the bearing portion 18*a* of the right guide member 17 on which the shaft 21 is disposed when the process cartridge B is mounted, and, in the condition that the cartridge is mounted, the shaft 21 is contacted with the earthing contact member 51.

Now, the arrangement of the electric contacts will be explained with reference to FIG. 22. As seen in FIG. 22, the contacts 48, 49 are arranged at the side of the photosensitive drum 7 opposite to the side where the helical gear 7*c* is provided, and at the other side (where the helical gear 7*c* is provided) of the photosensitive drum 7, the metal shaft 21 as the drum earthing contact is arranged. In a direction perpendicular to the longitudinal direction of the photosensitive drum 7, i.e., in the recording medium feeding direction, the developing bias contct member 48 is arranged at one side of the drum (side toward the developing means 10), and the charging bias contact member 49 is arranged at the other side (side toward the cleaning means 11). Incidentally, the metal shaft 21 as the drum earthing contact is protruded outwardly from the frame 14 and is positioned on a rotational centerline of the photosensitive drum 7.

Further, the developing bias contact member 48 and the charging bias contact member 49 are arranged along a line with respect to the longitudinal direction of the photosensitive drum 7 and are disposed on both sides of the gear flange (spur gear) 7*d* and the photosensitive drum 7. In addition, the contact members 48, 49 are positioned inwardly of the outer end surface of the gear flange 7*d* of the longitudinal direction of the photosensitive drum 7. With this arrangement, it is possible to reduce the longitudinal size of the process cartridge B, and, thus, make the process cartridge small-sized.

Further, as mentioned above, the charging bias contact member 49 is arcuated outwardly. That is to say, the contact member 49 has a straight portion which becomes a leading end when the process cartridge is mounted, and is arcuated from the straight portion. With this arrangement, when the process cartridge B is mounted to the image forming apparatus A, even if there arises a dispersion in the abutment angle between the charging bias contact member 49 and the charging bias contact pin 50*c* of the image forming apparatus, such dispersion can be absorbed, thereby abutting the charging bias contact member 49 against the charging bias contact pin 50*c* surely and effectively. Although the charging bias contact member 49 is positioned forwardly when the process cartridge B is mounted to the image forming apparatus A, the contact member 49 and the contact pin 50*c* are not damaged during the cartridge mounting operation.

Furthermore, the contact portion 27*a* of the antenna line 27, for detecting the amount of toner remaining in the toner reservoir 10*a* of the developing means 10 at the side of the image forming apparatus is disposed at the same side as the developing bias contact member 48 with respect to the longitudinal direction of the photosensitive drum 7, and is spaced apart from the photosensitive drum 7 more than the developing bias contact member 48 at one lateral side (toward the developing means 10) of the photosensitive drum 7.

By arranging the contacts as mentioned above, since the charging bias contact member 49 is spaced apart from the metal shaft 21 as the earthing contact, there is no risk of generating a floating capacity between the contacts, thereby stabilizing the charging voltage to avoid the charging discrepancy. That is to say, if the drum earthing contact is arranged near other contacts, the floating capacity will be generated between the wiring and contacts arranged around the drum earthing contact and such other contacts, with the result that the AC voltages used to the developing, charging and toner remaining amount detection tend to go wrong. Particularly, in the case of a charger roller that is contacted with the photosensitive drum 7 to charge the latter, since constant current control is effected, if the AC voltage is fluctuated due to the floating capacity, it is possible that the image will deteriorate. To the contrary, by arranging the contacts as in the illustrated embodiment, the floating capacity can be eliminated, thus maintaining the AC voltage stably or normally, thereby eliminating the charging discrepancy.

Further, since the developing bias contact member 48 and the charging bias contact member 49 are arranged on both sides with respect to the photosensitive drum 7, the electric interference between these contacts can be avoided.

In view of the above, in the present embodiment, upon assembling the process cartridge B, the metal shaft 21 is attached to the cleaning frame 14, which supports the photosensitive member 7 in the direction protruding outwardly from the drum 7 with respect to the axial direction of the drum 7, and the contact member for charge bias 49 is attached at the side opposite of the metal shaft 21 with respect to the axial direction of the drum. Furthermore, the toner developing frame member C, which supports developing means 10, is attached to the contact member for developing bias 48. This contact member 48 is located in the axial direction of the photosensitive drum 7 when the cleaning frame member 14 and the toner developing frame member C are connected to each other. The frame members 14 and C are connected to assemble the process cartridge B.

(Toner Remaining Amount Detection and Cartridge Mount Detection Circuits):

Next, the remaining amount of toner detection and the process cartridge mount detection in this apparatus will be explained. In this apparatus, as mentioned above, the remaining amount of toner in the process cartridge B is detected on the basis of a change in the electrostatic capacity between the antenna line 27 provided on the cartridge and the developing sleeve 10*d*. To this end, a circuit shown in FIG. 55 is provided.

Figure 55:
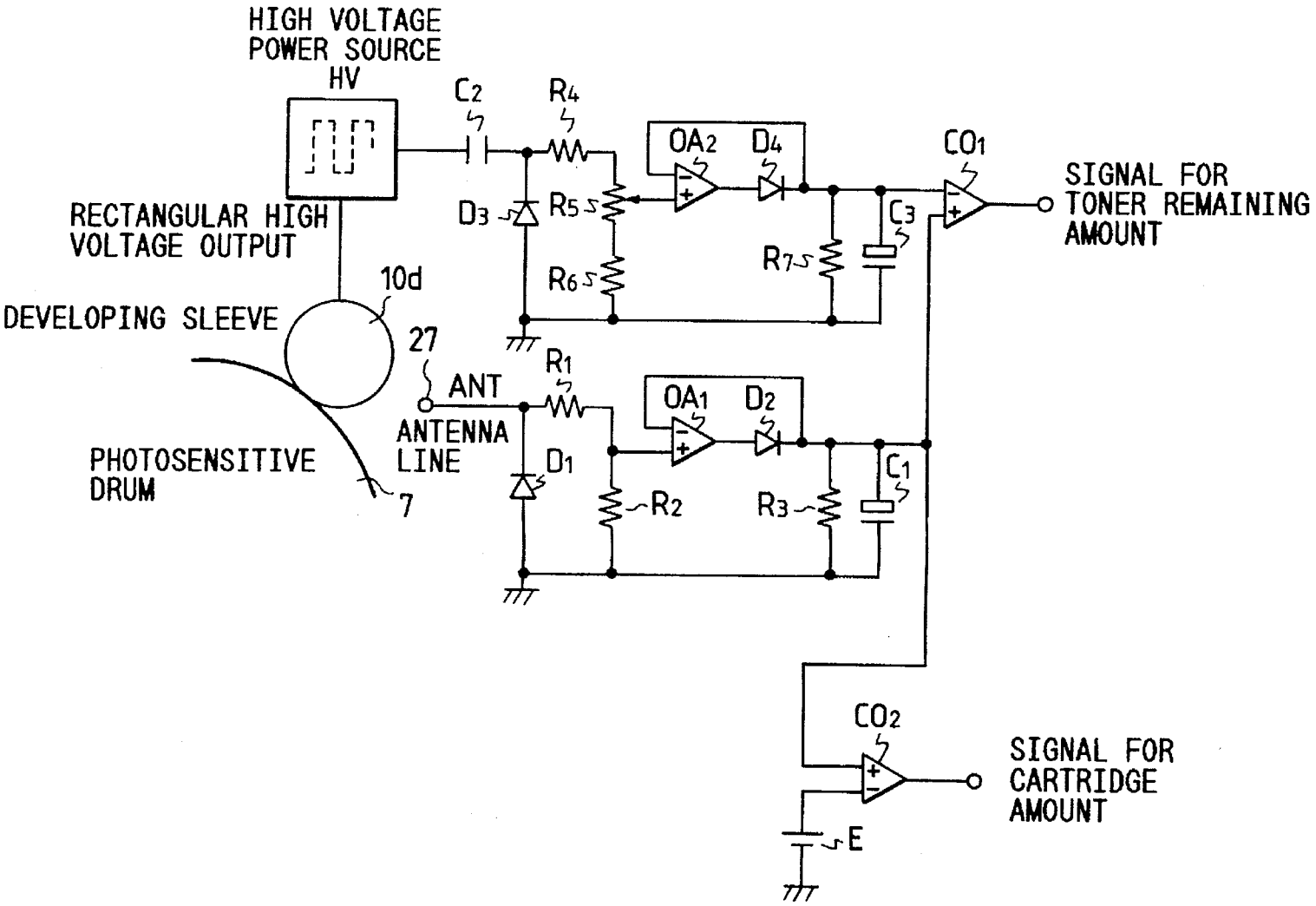
FIG. 55 is a detection circuit for detecting a toner remaining amount.

In the circuit shown in FIG. 55, the developing sleeve 10*d* and the antenna line 27 constitute equivalent capacitors. A high voltage power source HV applies a rectangular wave AC voltage (Vpp=about 1600 V) to the developing sleeve 10*d*. The high voltage from the high voltage power source HV has a rectangular building-up and a rectangular building-down, and is detected as a derivative wave form ANT by the electrostatic capacity between the developing sleeve 10*d* and the antenna line 27 and resistors R1, R2. Incidentally, diode D1 is a clamp diode having a minus output. The derivative wave form ANT is voltage-divided by the resistors R1, R2 and is. peak-detected by a first peak hold circuit comprising an operation amplifier OA1, a diode D2 and a capacitor C1, and is converted into a DC signal. Incidentally, a resistor R3 serves to discharge the capacitor C1.

The electrostatic capacity between the developing sleeve 10*d* and the antenna line 27 depends upon the amount of toner exsisting between the developing sleeve 10*d* and the antenna line 27. That is to say, when the toner exists between both conductors, since the dielectric constant between the conductors increases, the electrostatic capacity between the conductors is increased. Accordingly, as the amount of the toner is decreased, since the dielectric constant between the conductors is decreased and the electrostatic capacity is also decreased, the voltage detected by the first peak hold circuit is decreased as the amount of the toner is reduced.

On the other hand, the output from the high voltage power source HV is supplied to the developing sleeve 10*d* and is also supplied to a derivative circuit comprised of a reference capacitor C2, a resistor R4, a resistor R5 (volume resistor) and a resistor R6. Incidentally, a diode D3 is a clamp diode having the minus output. The derivative wave form detected through the volume resistor R5 is converted into a DC signal by a second peak hold circuit comprising an operation amplifier OA2, a diode D4, a capacitor C3 and a discharging resistor R7. The volume resistor R5 is adjusted so that the output from the second peak hold circuit becomes a desired reference value (about 2.7 V in the illustrated embodiment).

The output (potential of the capacitor C1→value corresponding to the toner remaining amount) of the first peak hold circuit and the output (potential of the capacitor C3→reference value) of the second peak hold circuit are compared by a comparator CO1, and is outputted as a signal representative of the toner remaining amount. Accordingly, when an adequate amount of toner remains between the developing sleeve 10*d* and the antenna line 27, the potential of the capacitor C1 is higher than the potential of the capacitor C3, and the output of the comparator CO1 becomes a high level signal. As the amount of toner between the developing sleeve 10*d* and the antenna line 27 is reduced, the potential of the capacitor C1 is decreased. When the potential of the capacitor C1 is lowered below the potential of the capacitor C3, the output of the comparator becomes a low level signal. Therefore, it is possible to detect the amount of toner remaining on the basis of the output of the comparator CO1.

Incidentally, in the illustrated embodiment, it is also detected whether the process cartridge B is mounted to the image forming apparatus A or not. That is to say, in the circuit shown in FIG. 55, when the potential of the capacitor C1 becomes smaller than a reference potential E (about 1 V in the illustrated embodiment), the output of a comparator CO2 becomes a low level signal, thereby judging that the process cartridge B is not mounted to the image forming apparatus A.

For example, when the power source is turned ON, the controller for controlling the apparatus outputs the rectangular wave form alternate current from the high voltage power source HV to the developing sleeve 10*d*. However, if the process cartridge B is not mounted to the image forming apparatus, since the photosensitive drum 7, developing sleeve 10*d* and antenna line 27 do not exist in the circuit of FIG. 55, the signal is not inputted to the operation amplifier OA1. Accordingly, in this case, the potential of the capacitor C1 becomes zero. Thus, by setting the reference potential E to the plus voltage having some margin regarding the zero level and to the potential lower than the potential of the capacitor C1 when the toner in the cartridge is empty, it is possible to detect the presence or absence of the process cartridge B.

Figure 56:
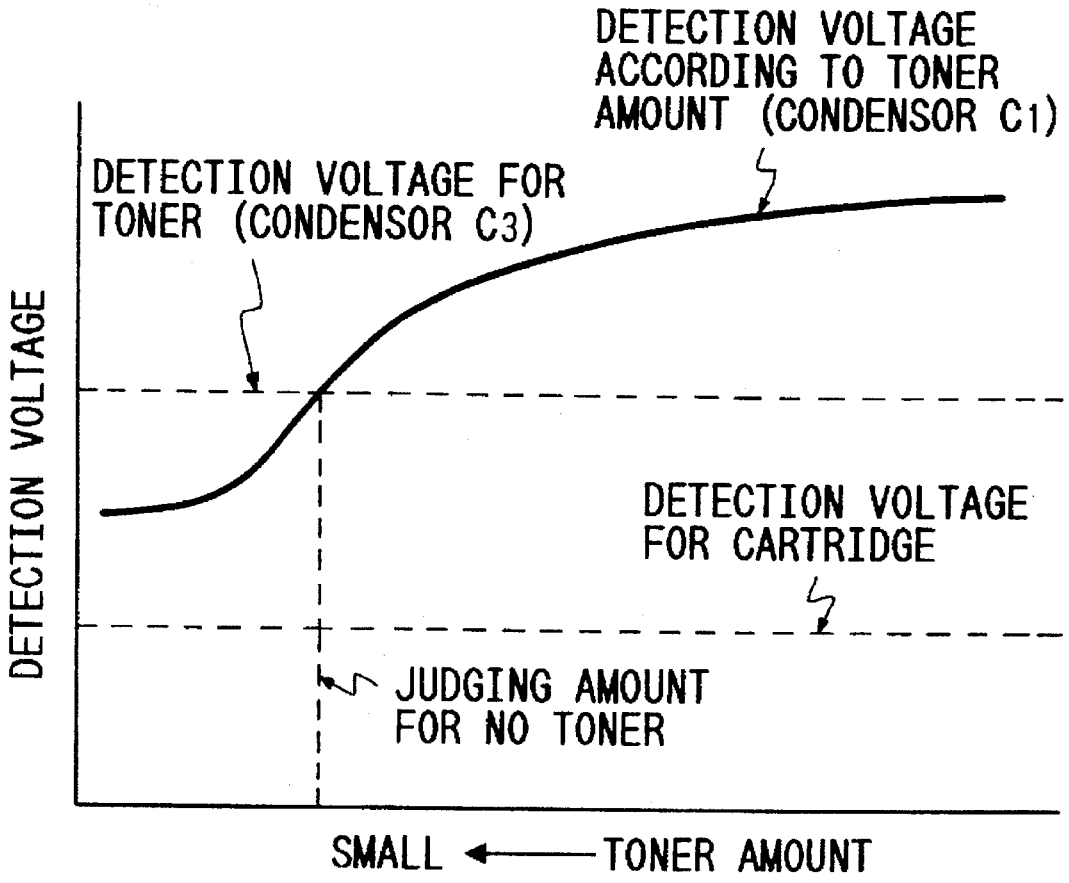
FIG. 56 is a graph showing a relation between a toner amount and a toner remaining amount detection voltage.

A voltage relation between the detection level of the presence of the toner remaining amount and the detection level of the presence of the cartridge mount is shown in FIG. 56. In FIG. 56, a detection reference voltage (potential of the capacitor C3) for the presence or absence of the toner remaining amount may be set to an alarm level for informing as to whether the toner amount is insufficient to perform recording. Incidentally, in the illustrated embodiment, the reference voltage is adjusted by adjusting the volume resistor R5 (at the manufacture thereof) to the electrostatic capacity (about 7.5 pF) corresponding to the case where the toner of about 20 grams exists between the developing sleeve 10*d* and the antenna line 27. Further, the detection reference voltage for the presence or absence of the cartridge mount may be obtained by voltage-dividing the voltage of the power source by resistor(s).

Figure 57:
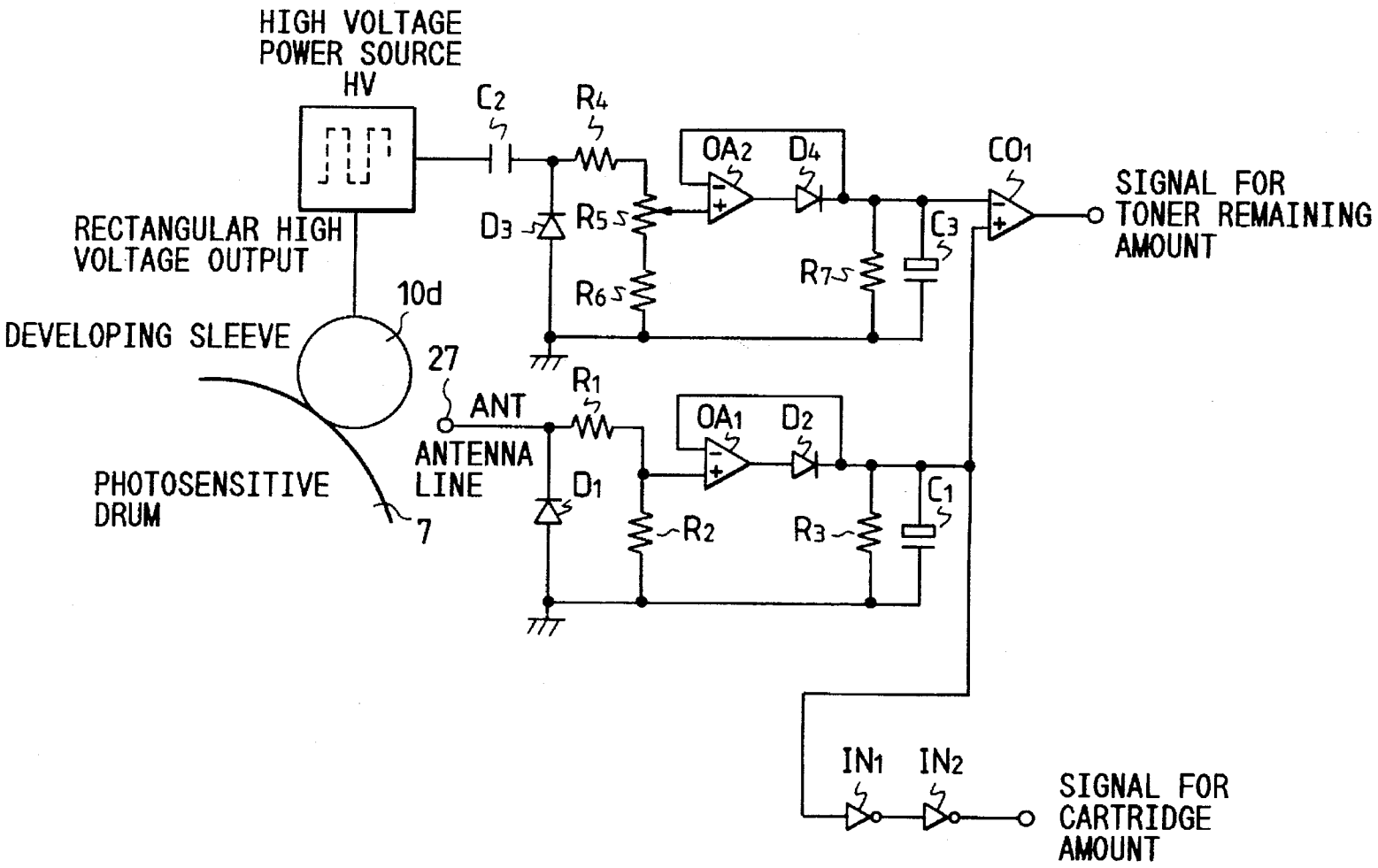
FIG. 57 is a circuit according to an embodiment wherein the cartridge mount is detected by an inverter.

Incidentally, in the circuit of FIG. 55, while the comparator CO2 was used to detect the presence or absence of the cartridge mount, in place of this comparator, as shown by a circuit in FIG. 57, inverters IN1, IN2 having the appropriate slice level may be used. Also in this case, it is necessary to adjust the detection voltage level from the antenna line 27 by the resistors R1, R2, R4, R5, R6 so that the outputs of the inverters IN1, IN2 do not become the low levels when there is no toner in the cartridge.

Figure 58:
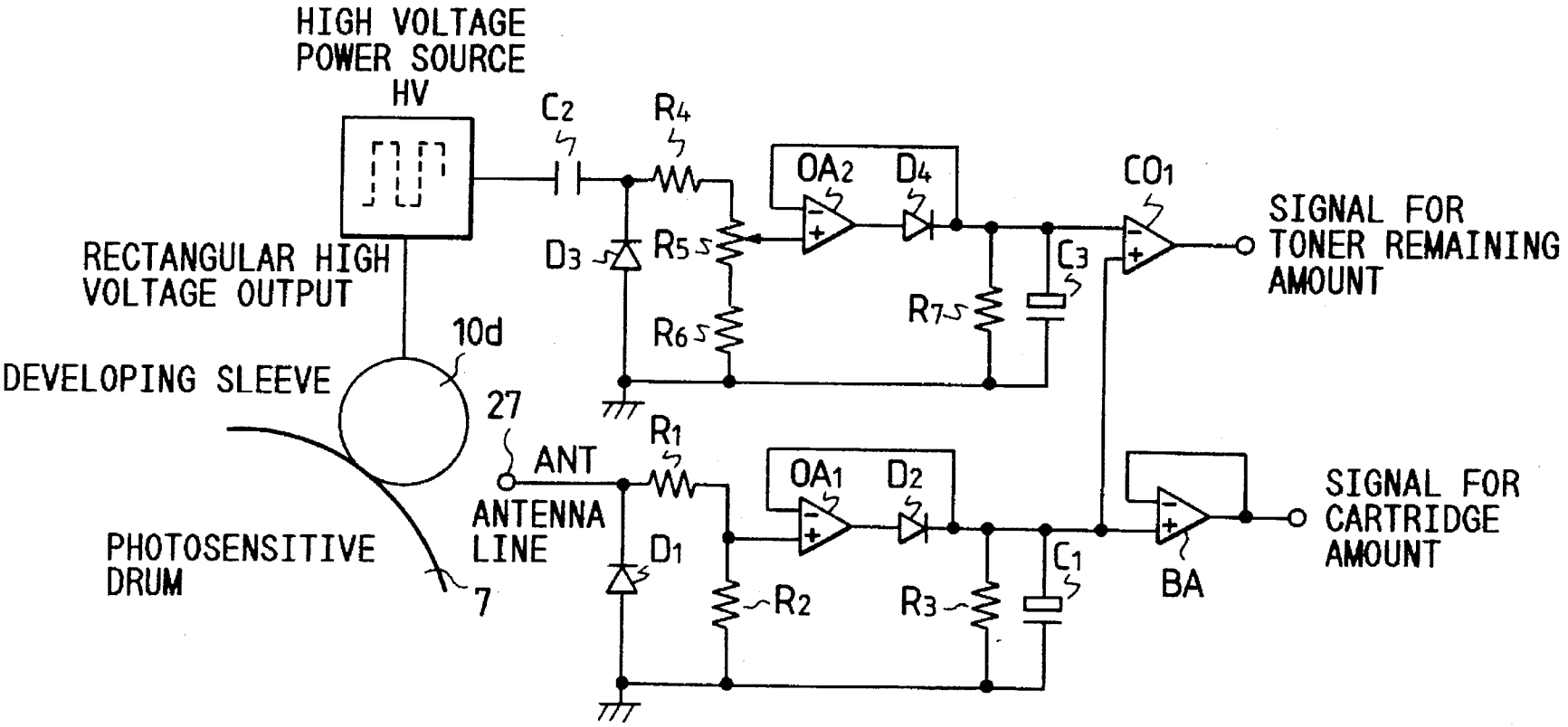
FIG. 58 is a circuit according to an embodiment wherein the cartridge mount is detected by a digital signal.

Further, regarding the detection of the presence or absence of the cartridge mount, as shown in FIG. 58, when the output of the capacitor C1 is sent to the controller via a buffer amplifier BA and the A/D conversion is effected, the detection becomes more reliable.

(Control Portion):

Next, the control system of the image forming apparatus A will be briefly described with reference to a function block diagram shown in FIG. 59.

Figure 59:
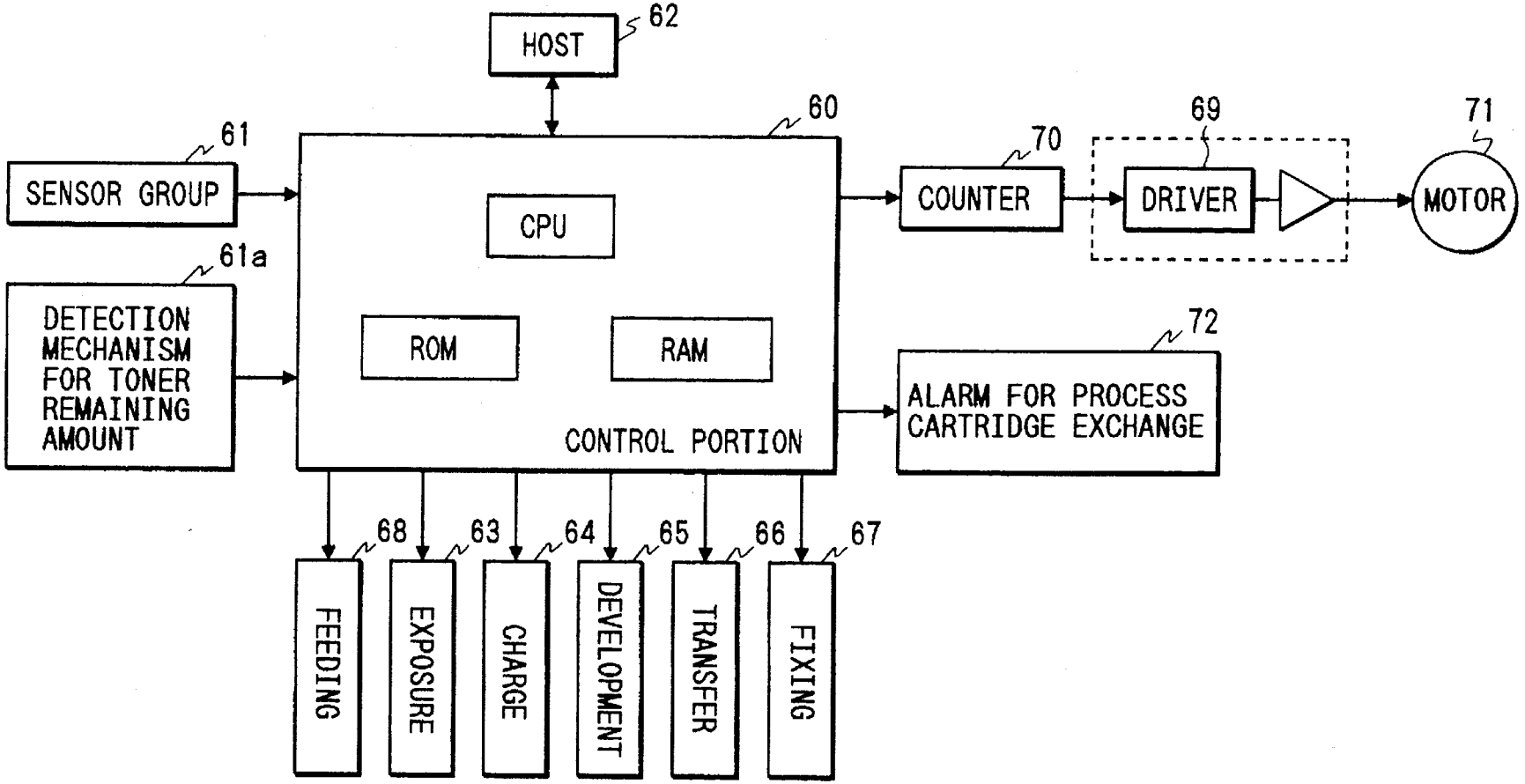
FIG. 59 is a function block diagram of a control means.

In FIG. 59, a control portion 60 for controlling the whole image forming apparatus comprises a CPU such as a microcomputer, a ROM for storing a control program for the CPU and various data, and a RAM used as a work area for the CPU and adapted to temporarily store various data.

The control portion 60 receives signals from a sensor group 61 including a sheet jam sensor and the like. Further, the control portion receives a signal from a toner remaining amount detection mechanism 61*a* for detecting the remaining amount of the toner in the cartridge on the basis of the change in the electrostatic capacity between the developing sleeve 10*d* and the antenna line 27. Further, the control portion receives an image signal from a host 62 such as a computer, a word processor or the like.

On the basis of such information, the control portion 60 controls various processes such as exposure 63, charge 64 (charger roller 8 and the like), development 65 (developing sleeve 10*d* and the like), transfer 66 (transfer roller 4 and the like) and fixing 67 (fixing roller 5*b* and the like), and the feeding 68 of the recording medium (register rollers 3*d*1, 3*d*2, discharge rollers 3*f*1, 3*f*2 and the like). Further, the control portion controls the drive of a main drive motor 71 via a counter 70 for counting the number of pulses to be applied from the control portion to a driver 69.

Further, in the illustrated embodiment, the control portion 60 receives a signal representative of no toner generated as a result of the toner remaining amount detection, and performs the alarm 72 for the process cartridge exchange (for example, turning lamp or buzzer ON).

(Image Forming Operation):

Next, the image forming operation effected after the process cartridge B is mounted to the image forming apparatus A will be explained.

When the recording medium 2 is set on the sheet supply tray 3*a*, shown in FIG. 1, and the setting of the recording medium is detected by a sensor (not shown) or when the cassette 3*h*, containing the recording medium 2, is set and the copy start key is depressed, the pick-up roller 3*b* or 3*i* starts to rotate, and the paired separation rollers 3*c*1, 3*c*2 and the paired register rollers 3*d*1, 3*d*2 are rotated to feed the recording medium 2 to the image forming station. In registration with the feeding timing of the paired register rollers 3*d*1, 3*d*2, the photosensitive drum 7 is rotated in the direction shown by the arrow in FIG. 1, and, by applying the charging bias to the charger roller 8, the surface of the photosensitive drum 7 is uniformly charged. Then, laser light, corresponding to the image signal, is illuminated from the optical system 1 through the exposure portion 9 onto the photosensitive drum 7, thereby forming a latent image on the drum in response to the light illumination.

At the same time when the latent image is formed, the developing means 10, of the process cartridge B, is driven to rotate the toner feed member 10*b*, thereby feeding out the toner in the toner reservoir 10*a* to the developing sleeve 10*d* where the toner layer is formed on the sleeve 10*d*. By applying a voltage having the same polarity and potential as the charging polarity of the photosensitive drum 7 to the developing sleeve 10*d*, the latent image on the photosensitive drum 7 is visualized as the toner image. The recording medium 2 is fed between the photosensitive drum 7 and the transfer roller 4, and, by applying the voltage having the polarity opposite to that of the toner to the transfer roller 4, the toner image on the photosensitive drum 7 is transferred onto the recording medium 2. After the transferring operation, the photosensitive drum 7 is further rotated in the direction shown by the arrow in FIG. 1; meanwhile, the residual toner remaining on the photosensitive drum 7 is scraped off by the cleaning blade 11*a*, and the scraped toner is collected into the waste toner reservoir 10*c*.

On the other hand, the recording medium 2, to which the toner image was transferred, is sent to the fixing means 5, where the toner image is fixed to the recording medium 2 with heat and pressure. Thereafter, the recording medium 2 is discharged onto the discharge portion 6 by the discharge rollers 3*e*, 3*f*1, 3*f*2. Incidentally, regarding the fixing means, in the illustrated embodiment, while the so-called heat fixing type was used, other fixing means such as pressure fixing type may be used.

(Recycle of Process Cartridge):

Next, the recycling of the process cartridge, according to the illustrated embodiment, will be explained. In the past, when the toner in the process cartridge was consumed or used up, the process cartridge was dumped. Thus, the reusable parts such as rollers were also dumped together with the process cartridge. However, recently, in consideration of the protection of the earth environment, various electric equipment and electronic equipments are not dumped as conventionally, but parts of such equipment have been recycled (regenerated or reused) from the view point of the saving of resources, the saving of energy and the reduction of dust.

Thus, in the process cartridge, according to the illustrated embodiment, since the parts such as the charging members, developing members or cleaning members have the long service lives, such parts can be still used after the toner in the cartridge is consumed. Therefore, recently, the cartridges that the toner was consumed have been collected and the reusable parts have been recycled.

Now, the procedure of the recycle of the process cartridge will be described. The procedure for the recycling of the process cartridge includes the following steps; that is, (1) collection, (2) sorting, (3) decomposition, (4) selection, (5) cleaning, (6) check and (7) re-assembling. These steps will be fully explained hereinbelow.

(1) Collection:

The used process cartridges are collected to a collection center with the aid of users and service men.

(2) Sorting:

The used process cartridges collected to the various collection centers are transported to a cartridge recycle factory. And, the collected process cartridges are sorted on the basis of the types.

(3) Decomposition:

The sorted process cartridges are decomposed to pick up parts.

(4) Selection:

The picked-up parts are checked to select or divide them into reusable parts and non-reusable parts which were damaged or the service lives of which have expired.

(5) Cleaning:

Only the parts which pass the selection are cleaned to be reused as new parts.

(6) Check:

After the cleaning, the parts are checked as to whether they have been restored to their functions sufficiently and can be reused.

(7) Re-assembling:

A new process cartridge is assembled by using the parts which pass the check.

In the recycle, the charger roller 8 and the developing sleeve 10*d* and the like are reused by reassembling them, and the frames 12, 13, and 14 are crushed to reuse as material. In this case, if the frames 12, 13, and 14 are formed from different materials, when these frames are crushed together, the different materials are mixed, thus deteriorating the mechanical feature of the material which is reused. Thus, each frame 12, 13, and 14 must be crushed separately or independently. However, since the toner frame is welded to the developing frame, these frames must be separated from each other by cutting, thereby making the recycle process troublesome. To the contrary, according to the illustrated embodiment, as mentioned above, since the toner frame 12, developing frame 13 and cleaning frame 14 are formed from the same material (polystyrene resin), even when these frames 12, 13, and 14 are crushed together to obtain pellets, the mechanical feature of the material is not worsened, thereby improving the recycle process.

Further, in the illustrated embodiment, since the polystyrene resin, which is material for the frames, is similar material to the component of the toner (both styrene group), even when the frames are crushed in a condition that the cleaning of the used cartridge is incomplete and the toner is adhered to the frames, the mechanical feature of the material is not deteriorated, unlike to the case where the different materials are mixed.

Figure 60:
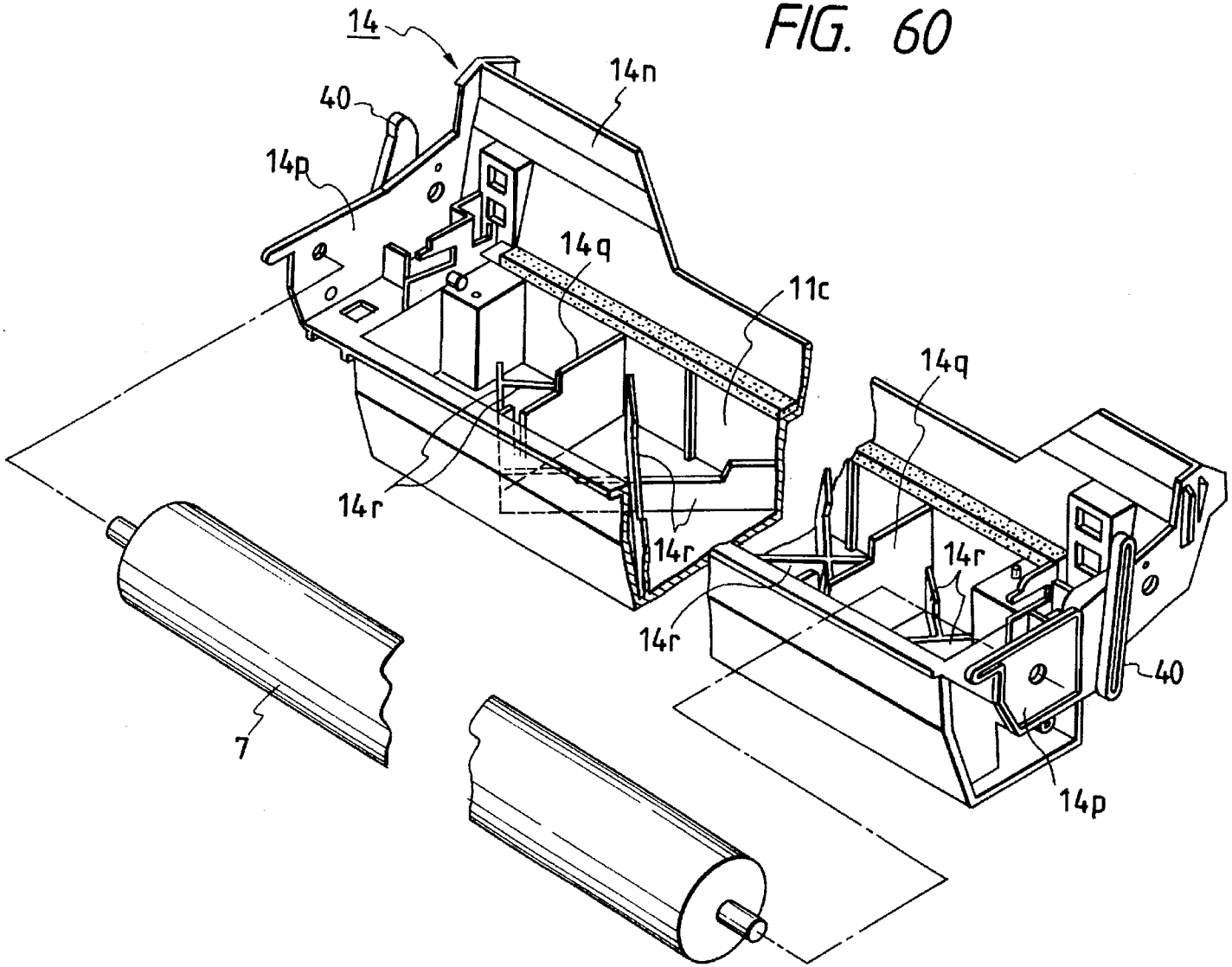
FIG. 60 is an exploded perspective view of a cleaning frame showing an inner construction thereof.

Incidentally, since the cleaning frame 14 can be separated from the toner developing frame C, it is not necessary to form the cleaning frame from the same material as that of the toner developing frame so long as these frames are crushed independently; however, the cleaning frame is preferably formed from the same material as that of the toner developing frame C when these frames are formed from the material similar to the material of the toner component. However, the cleaning frame 14 must have the mechanical strength sufficient to support the photosensitive drum 7 and the like. But, as in the illustrated embodiment, when the cleaning frame 14 is formed from polystyrene resin, which is material same as that of the toner developing frame C, the mechanical strength of the cleaning frame is weaker than that of a cleaning frame which is formed from polyphenylene oxide (PPO) or polyphenylene ether (PPE). Thus, as shown in FIG. 60, the cleaning frame 14, according to the illustrated embodiment, is provided with an upper wall portion **14*n* (FIGS. 4, 7 and 47–51) for covering an upper portion of the photosensitive drum 7 between both side walls 14*p* (of the frame 14) for supporting the rotary shaft of the photosensitive drum 7, thereby reinforcing the side walls 14*p***.

Further, partition walls **14*q* are provided in the waste toner reservoir 11*c* to divide the interior of the waste toner reservoir into a plurality of chambers, and reinforcing ribs 14*r* are formed on the walls of each chamber at that side, thereby reinforcing the cleaning frame. Incidentally, the partition walls 14*q* limit the inadvertent longitudinal movement of the toner contained in the waste toner reservoir 11*c*, thereby preventing the waste toner from leaking from the waste toner reservoir 11*c*. By reinforcing the cleaning frame 14 as mentioned above, even when the cleaning frame 14** is formed from the same material (polystyrene resin) as that of the toner developing frame C, sufficient mechanical strength can be obtained.

[Other Embodiments]

Next, other embodiments of various parts of the aforementioned process cartridge and image forming apparatus will be explained.

Figure 61:
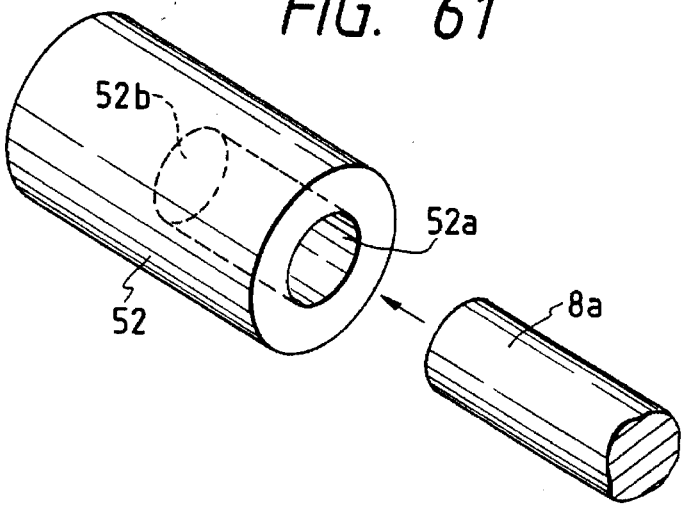
FIGS. 61 and 62 are views showing a bearing for a charger roller according to another embodiment.
Figure 62:
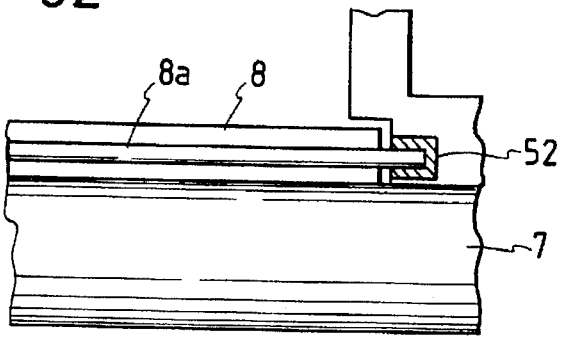

(Charger Means):

In the above-mentioned embodiment, while an example that the axial shifting movement of the charger roller 8 is regulated by abutting one end of the roller shaft **8*a* against the abutment portion 24*a* of the bearing 24 was explained, as another embodiment, as shown in FIGS. 61 and 62, one end of the roller shaft 8*a* may be supported by a bearing 52 having a cylindrical bore 52*a*. In this arrangement, when the roller shaft 8*a* is biased toward a direction shown by the arrow in FIG. 61, an end face of the roller shaft 8*a* is abutted against a bottom 52*b* of the bore 52, thereby positioning the roller shaft. Accordingly, this arrangement can achieve the same advantage as that of the previous embodiment. Incidentally, the bearing 52 is preferably formed from material such as polyacetal having the good sliding feature to the metal, similar to the bearing 24** in the previous embodiment.

Figure 63:
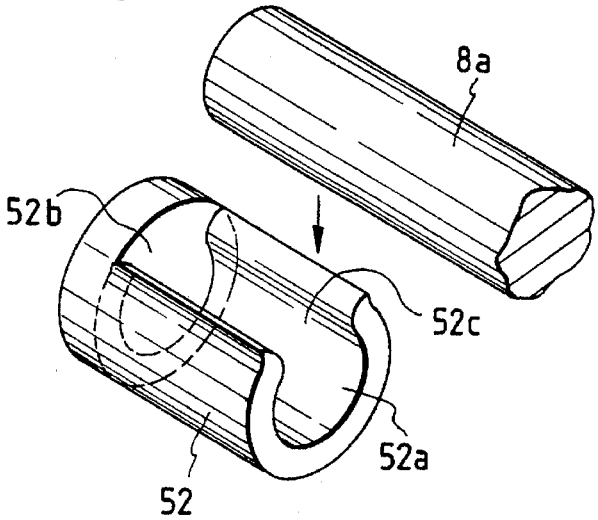
FIG. 63 is a perspective view of a bearing for a charger roller according to a further embodiment.

Further, as shown in FIG. 63, a side notch **52*c* may be formed in the bearing 52, and the roller shaft 8*a* may be forcibly inserted into the bearing while deforming the notch 52*c* elastically. With this arrangement, the assembling ability of the charger roller 8 is improved. Further, when the notch 52*c* is oriented to direct downwardly as the process cartridge B is mounted, even if a small amount of cutting debris remains in the cylindrical bore 52*a*, since such cutting debris drops through the notch 52*c* and is removed from the bore 52*a*, it is possible to stably rotate the roller shaft 8*a* in the bore 52*a***.

Further, in the aforementioned embodiments, while an example that one end of the roller shaft **8*a* is supported by the bearing 24 or bearing 52 was explained, the rotary shaft of the developing sleeve 10*d* and the like may be supported by the bearing 24 or 52**.

Figure 64:
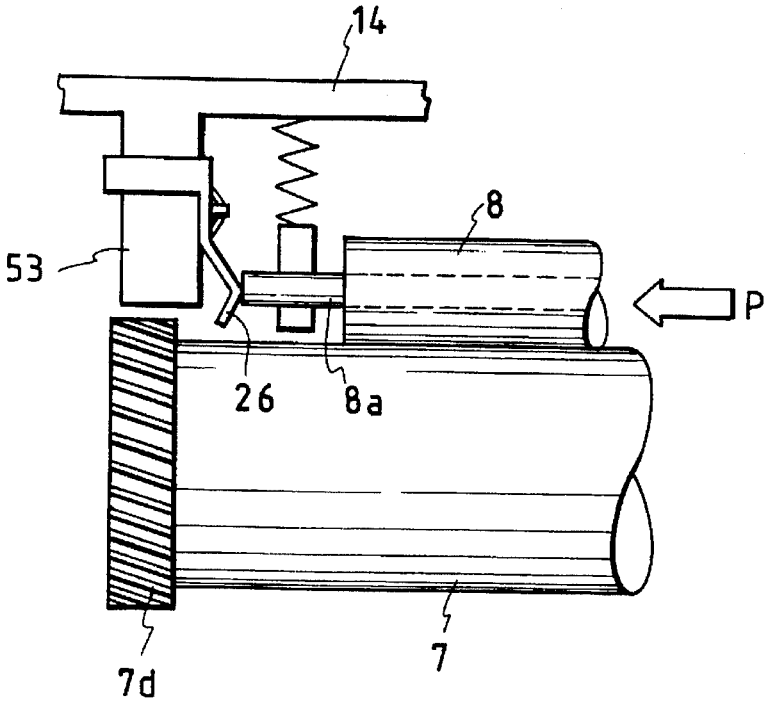
FIG. 64 is a view showing a mechanism for preventing the deformation of a contact member, according to another embodiment.

Furthermore, in the first embodiment, while the regulating member **14*b* was provided for preventing the plastic deformation of the contact member 26 when the roller shaft 8*a* was shifted, as another embodiment, as shown in FIG. 64, a rib 53, as a regulating member, may be provided on the cleaning frame 14 and the contact member 26 may be secured to the rib 53 by heat caulking and the like. With this arrangement, even when the changer roller 8 is subjected to a force P shown by the arrow in FIG. 64, the contact member 26 is abutted against the rib 53, thereby preventing further deformation of the contact member. Thus, in use, even if the cartridge B is dropped to generate the force P during the transportation of the cartridge, it is possible to prevent the damage of the contact member 26**.

Figure 65:
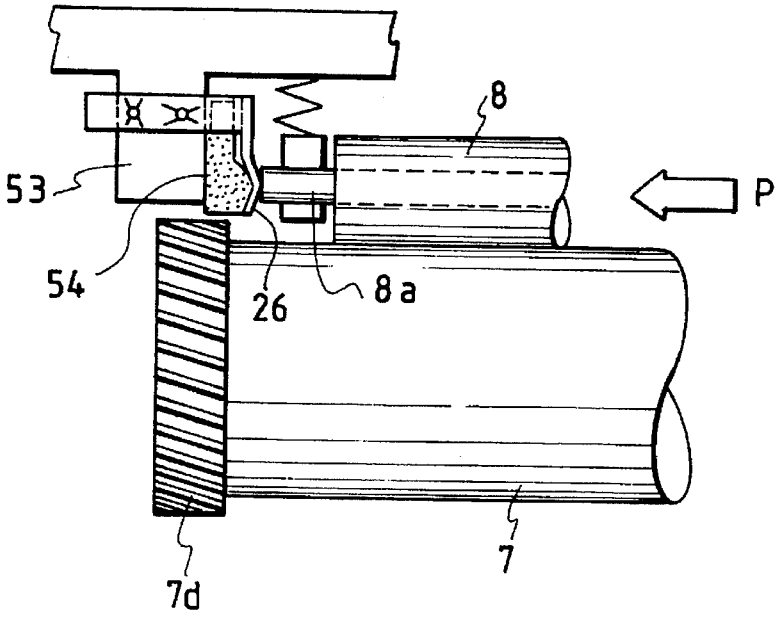
FIG. 65 is a view showing a mechanism for preventing the deformation of a contact member, according to a further embodiment.

Further, as shown in FIG. 65, a buffer 54 made of rubber or the like may be adhered to a side surface of the rib 53 by a both-sided adhesive tape so that the buffer is interposed between the rib 53 and the contact member 26. With this arrangement, even when the charger roller 8 is subjected to a force P shown by the arrow, the plastic deformation of the contact member 26 can be prevented by the buffer 54. Further, if the end portion of the contact member 26 is not contacted with an end face of the rotating roller shaft **8*a* in parallel, the contact member 26 will be eccentrically contacted with the end face of the roller shaft 8*a*, thus causing vibration and/or noise. However, in this embodiment, since the buffer 54** is provided, the vibration can be suppressed, thereby preventing the generation of the noise.

Figure 66:
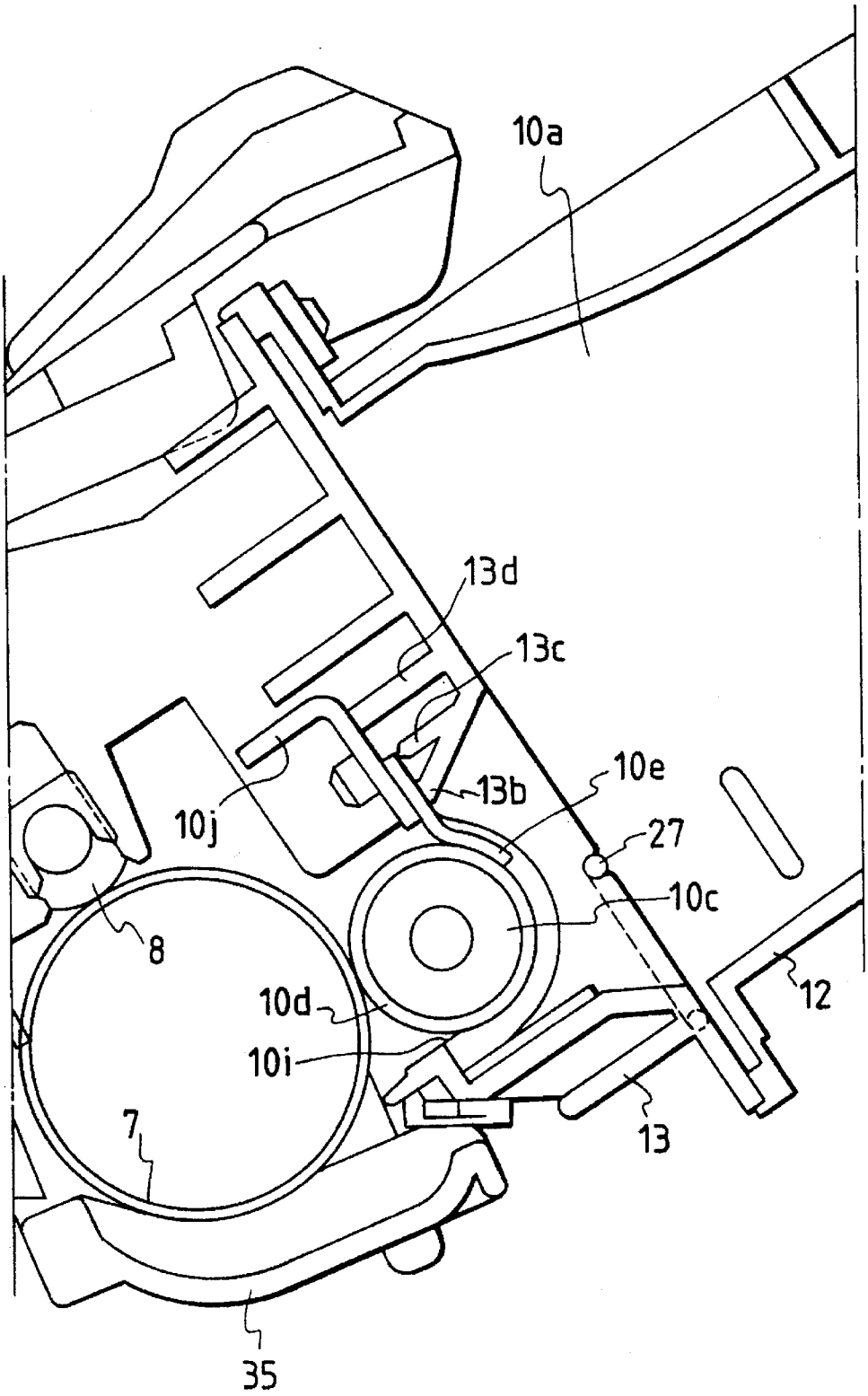
FIG. 66 is a view showing an embodiment wherein a second rib on a developing frame is sharpened.

(Developing Means):

In the aforementioned first embodiment, while the three ribs **13*b*, 13*c*, and 13*d* were formed on the developing frame 13 and the sharp wedged end of the second rib 13*c* was penetrated into the developing blade 10*e* as shown in FIG. 15, the end of the second rib may not necessarily be wedged, and, as for example, shown in FIG. 66, the edge of the second rib 13*c* may be sharpened as an arrow shape, and the tip end of the rib 13*c* may be strongly urged against the developing blade 10*e***.

Figure 67A:
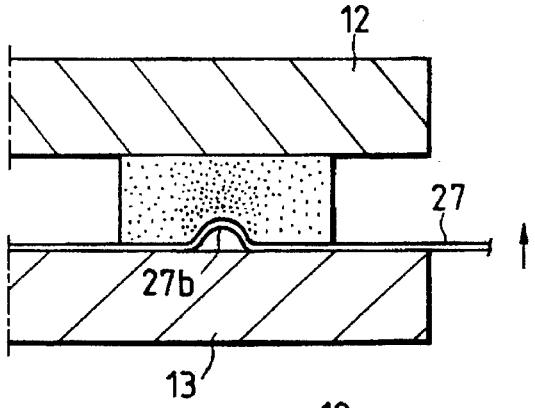
FIG. 67A is an explanatory view showing a condition that an antenna wire is bent to a semi-circular shape.
Figure 67B:
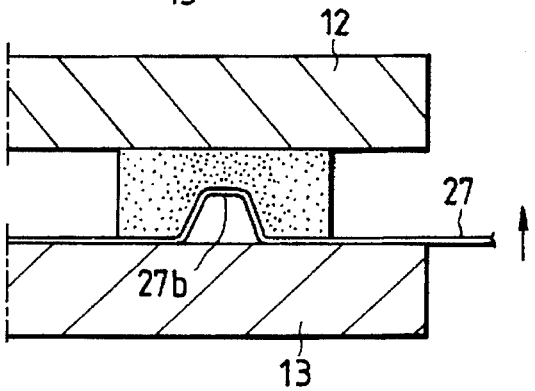
FIG. 67B is an explanatory view showing a condition that the antenna wire is bent to a trapezoidal shape.

Further, in the first embodiment, as shown in FIG. 18, the bent portion **27*b* was formed in the antenna line 27 so that the antenna line 27 did not float from the recessed portion 13*e*, of the developing frame 13, when a shock is applied to the exposed portion of the antenna line 27. However, the configuration of the bent portion 27*b* is not limited to that shown in FIG. 18, but may be semi-circular as shown in FIG. 67A or trapezoidal as shown in FIG. 67**B.

Figure 68:
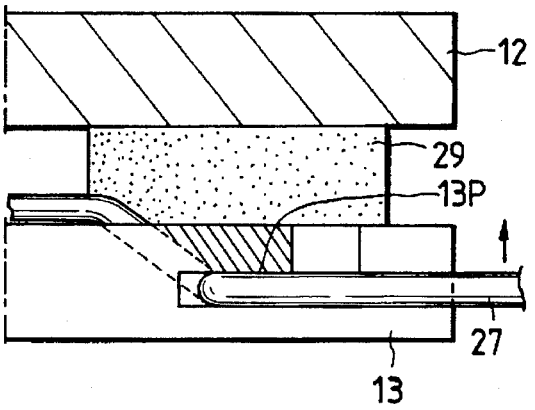
FIG. 68 is a view showing an embodiment wherein a cut-out is formed in a developer frame and the floating of an antenna wire is prevented by inserting the antenna wire into the cut-out.

Further, in order to prevent the floating of the antenna line 27, other than the provision of the bent portion 27*b*, as shown in FIG. 68, a cut-out 13*p* may be formed in the developing frame 13 and the antenna line 27 may be passed through the cut-out 13*p*. With this arrangement, even when the antenna line 27 is subjected to an external force, shown by the arrow in FIG. 68, the antenna line 27 does not float from the developing frame 13, thereby preventing the generation of a clearance or gap between the developing frame 13 and the toner leak preventing seals 29.

Figure 69:
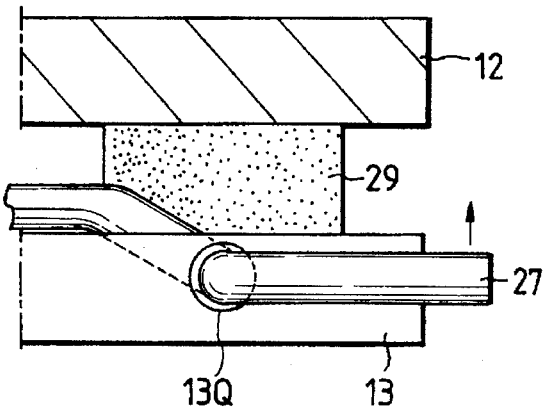
FIG. 69 is a view showing an embodiment wherein a round hole is formed in a developer frame and the floating of an antenna wire is prevented by inserting the antenna wire into the round hole.

Further, in place of the cut-out 13*p*, as shown in FIG. 69, a round bore 13*q* having a diameter which permits the passage of the antenna line 27 may be formed in the developing frame 13 and the antenna line 27 may be passed through the cylindrical bore 13*q*. Also with this arrangement, similar to the cut-out 13*p*, even when the antenna line 27 is subjected to an external force, shown by the arrow in FIG. 69, the antenna line 27 does not float from the developing frame 13.

Further, in the first embodiment, while the positioning of the developing sleeve 10*d* in the rotational direction thereof was not explained, such positioning may be effected by abutting one end of the rotary shaft of the developing sleeve against a bearing member, similar to the charger roller 8, and the bearing member may be cylindrical, as shown in FIGS. 61 to 63. In addition, when not only the developing sleeve 10*d* but also non-magnetic toner are used, the toner layer is formed on the developing sleeve 10*d* by a coating roller. In this case, the coating roller may be positioned by abutting one end of a roller shaft of the coating roller against a bearing member having the same construction as mentioned above.

(Cleaning Means):

In the aforementioned embodiment, as shown in FIGS. 12, 13A and 13B, while an example that the blow sheet 10*i* is overlapped with the toner leak preventing seals 10*h* was explained, the arrangement shown in FIGS. 12, 13A and 13B may be taken into consideration on the basis of the relation between the cleaning means (cleaning blade 11*a*, dip sheet 11*b*, toner leak preventing seals 11*e*) and the photosensitive drum 7. That is to say, the dip sheet 11*b* may be overlapped with the toner leak preventing seals 11*e* outward of both longitudinal ends of the cleaning blade 11*a*.

(Others):

The process cartridge, according to the present invention, can be suitably applied to form not only a mono-color image as mentioned above, but also a plural color image (for example, two-color image, three-color image or full-color image) by providing a plurality of developing means 10.

Further, as a developing method, a conventional two-component magnetic brush developing method, cascade developing method, touch-down developing method or cloud developing method may be used.

Further, regarding the charger means, in the first embodiment, while a so-called contact charging type was used, a conventional charging arrangement, wherein three walls formed from tungsten wires are enclosed by a metal shield such as aluminium and positive or negative ions generated by applying high voltage to the tungsten wires are transferred onto the photosensitive drum 7 thereby to uniformly charge the surface of the photosensitive drum 7, may be used.

Incidentally, the charger means may be of blade (charger blade) type, pad type, block type, rod type or wire type, other than the aforementioned roller type.

Further, the cleaning means for cleaning the residual toner remaining on an image bearing member such as the photosensitive drum 7 may be constituted by a blade, a fur brush and/or a magnet brush.

Further, regarding the image bearing member, as a photosensitive body, for example, organic semiconductor (OPC), amorphous silicone (A-Si), selenium (Se), zinc oxide (ZnO), or cadmium sulfide (CdS) can be used, and the shape of the image bearing member is not limited to the drum, but may be a belt.

Furthermore, the process cartridge B includes an electrophotographic photosensitive body as an image bearing member, and at least one process means. Accordingly, the process cartridge may integrally incorporate therein an image bearing member and a charger means as a unit, which can be removably mounted to an image forming apparatus, or may integrally incorporated therein an image bearing member and a developing means as a unit, which can be removably mounted to an image forming apparatus, or may integrally incorporate therein an image bearing member and a cleaning means as a unit, which can be removably mounted to an image forming apparatus, or may integrally incorporate therein an image bearing member and two or more process means as a unit, which can be removably mounted to an image forming apparatus, as well as the above-mentioned one.

That is to say, the process cartridge integrally incorporates therein an electrophotographic photosensitive body, and a charger means, a developing means or a cleaning means as a unit, which can be removably mounted to an image forming apparatus, or integrally incorporates therein an electrophotographic photosensitive body, and at least one of a charger means, a developing means and a cleaning means as a unit, which can be removably mounted to an image forming apparatus, or integrally incorporates therein an electrophotographic photosensitive body, and at least a developing means as a unit, which can be removably mounted to an image forming apparatus.

Further, in the aforementioned embodiments, while the laser beam printer was explained as the image forming apparatus, the present invention is not limited to the laser beam printer, but may be applied to other image forming apparatuses such as an LED printer, an electrophotographic copying machine, a facsimile system or a word processor.

As mentioned above, according to the present invention, since the frames constituting the housing of the process cartridge are formed from the same material, the welding between the frames can be effected positively and strongly.

Further, since the frames are formed from material similar to that of the toner, in the recycle, even when the frames having the toner adhered thereto are crushed, the mechanical feature of the material is not deteriorated, unlike to the case where different materials are mixed. Accordingly, in the recycle, it is not required for separating the frames independently, and the cleaning operation can be facilitated.

Furthermore, since the frames are formed from material having the charging feature similar to that of the developer, even when the developer is rubbed against the frames during the image forming operation, the abnormal charging does not occur, thus obtaining an image with high quality.

As mentioned above, according to the present invention, since the first electric contact for electrically earthing the image bearing member and the second electric contact for applying the AC voltage to the charger means are arranged on both longitudinal ends of the image bearing member, respectively, it is not possible for any stray capacity to be generated between the AC wiring of the charger means and the earthing electric contact (first electric contact).

Further, since two electric contacts for applying the AC voltage to the charger means and the developing means, respectively, are arranged on both sides of the image bearing member in the direction perpendicular to the longitudinal direction of the image bearing member, it is possible to keep the long distance between the contacts, thereby preventing the interference between the charging electric contact and the developing electric contact, and, thus, preventing the deterioration of the charging ability. Incidentally, in this case, it is more preferable to electrically earth the image bearing member.

As mentioned above, according to the present invention, the electrical connection between the process cartridge and the image forming apparatus can be achieved surely and effectively.

What is claimed is:

1. A process cartridge removably mountable to an image forming apparatus, said process cartridge comprising:

an electrophotographic photosensitive drum;

charger means for charging said electrophotographic photosensitive drum;

a first contact for electrically earthing said electrophotographic photosensitive drum; and a second contact for applying an AC voltage to said charger means;

wherein said first and second contacts are respectively arranged near opposite ends of said electrophotographic photosensitive drum in an axial direction thereof.

2. A process cartridge according to claim 1, wherein said charger means is contacted with said electrophotographic photosensitive drum.

3. A process cartridge according to claim 1, wherein said charger means comprises a charger roller contacting with said electrophotographic photosensitive drum.

4. A process cartridge according to claim 1, further comprising developing means for developing a latent image formed on said electrophotographic photosensitive drum.

5. A process cartridge according to claim 4, further comprising a third contact for applying a voltage to said developing means, said third conductive member being arranged near the same end of said electrophotographic photosensitive drum as said second contact in the axial direction thereof.

6. A process cartridge according to claim 4, further comprising a fourth contact for detecting a remaining amount of developer in said developing means, said fourth contact being arranged near the same end of said electrophotographic photosensitive drum as said second contact in the axial direction thereof.

7. A process cartridge according to claim 1, further comprising a process cartridge frame for supporting said electrophotographic photosensitive drum and said charger means, wherein said first contact protrudes from said process cartridge frame in a longitudinal direction of said electrophotographic photosensitive drum.

8. A process cartridge according to claim 1, further comprising a spur gear fixed at an axial end of said electrophotographic photosensitive drum where said second contact is disposed, wherein said second contact is disposed at a position straddling said electrophotographic photosensitive drum and the spur gear in the axial direction of said electrophotographic photosensitive drum.

9. A process cartridge according to claim 1, wherein said second contact applies an AC voltage superposed with a DC voltage to said charger means.

10. A process cartridge according to claim 1, wherein said process cartridge is configured to be mounted to or removed from a main body of the image forming apparatus in a direction orthogonal to the axial direction of said electrophotographic photosensitive drum.

11. An image forming apparatus to which a process cartridge including an electrophotographic photosensitive drum and charger means for charging the electrophotographic photosensitive drum is removably mounted, said image forming apparatus comprising:

a first contact for electrically earthing the electrophotographic photosensitive drum; and a second contact for applying an AC voltage to the charger means, wherein said first and second contacts are respectively arranged at positions on said image forming apparatus corresponding to opposite ends of the electrophotographic photosensitive drum, in an axial direction thereof, of the process cartridge mounted to said image forming apparatus.

12. An image forming apparatus according to claim 11, wherein the charger means is contacted with the electrophotographic photosensitive drum.

13. An image forming apparatus according to claim 11, further comprising exposure means for illuminating light to the electrophotographic photosensitive drum.

14. An image forming apparatus according to claim 11, wherein when the process cartridge is mounted onto a main body of said image forming apparatus, said first contact is disposed at a side surface of the process cartridge and said second contact is disposed at a lower surface of the process cartridge.

15. An image forming apparatus according to claim 11, wherein said second contact applies an AC voltage superposed with a DC voltage to the charger means.

16. An image forming apparatus according to claim 11, wherein said image forming apparatus is configured so that the process cartridge is mounted to or removed from a main body of said image forming apparatus in a direction orthogonal to the axial direction of the electrophotographic photosensitive drum.

17. A process cartridge removably mountable onto a main body of an image forming apparatus, said process cartridge comprising:

an electrophotographic photosensitive drum;

charger means for charging said electrophotographic photosensitive drum;

developing means for developing a latent image formed on said electrophotographic photosensitive drum;

a charging bias contact for applying an AC voltage to said charger means;

a developing bias contact for applying an AC voltage to said developing means, said charging bias contact and said developing bias contact being respectively arranged adjacent opposite sides of said electrophotographic photosensitive drum in a direction perpendicular to a longitudinal direction thereof, and adjacent one end portion of said electrophotographic photosensitive drum in the longitudinal direction thereof; and an earthing contact arranged at another end portion of said electrophotographic photosensitive drum in the longitudinal direction thereof.

18. A process cartridge according to claim 17, wherein said electrophotographic photosensitive drum comprises a conductive sleeve having a photosensitive body therearound.

19. A process cartridge according to claim 17, wherein when said process cartridge is mounted onto a main body of the image forming apparatus, said charging bias contact and said developing bias contact are disposed at a lower surface of said process cartridge.

20. A process cartridge removably mountable to an image forming apparatus, said process cartridge comprising:

an electrophotographic photosensitive drum;

a developing bias contact for applying a developing bias to a developing means;

a charging bias contact for applying a charging bias to a charger means, said developing bias contact and said charging bias contact being arranged adjacent one longitudinal end of said electrophotographic photosensitive drum in such a manner that they are disposed inwardly of an outer end of a gear provided on said one longitudinal end of said electrophotographic photosensitive drum; and an earthing contact arranged adjacent another longitudinal end of said electrophotographic photosensitive drum opposite said one longitudinal end for earthing said electrophotographic photosensitive drum.

21. A process cartridge according to claim 20, wherein said developing bias contact and said charging bias contact are respectively arranged adjacent opposite sides of said electrophotographic photosensitive drum in a direction perpendicular to a longitudinal direction thereof.

22. A process cartridge according to claim 20, further comprising a drum shaft that supports one end of said electrophotographic photosensitive drum, wherein said earthing contact is provided at an end surface of a portion of said drum shaft, which protrudes outwardly toward the image forming apparatus in an axial direction of said electrophotographic photosensitive drum.

23. A process cartridge according to claim 20, wherein a helical gear is provided on said another longitudinal end of said electrophotographic photosensitive drum adjacent which said earthing contact is provided, and said helical gear receives a driving force for rotating said electrophotographic photosensitive drum from the image forming apparatus.

24. A process cartridge according to claim 20, wherein said gear is a spur gear which transmits a driving force for rotating a transfer roller in the image forming apparatus.

25. A process cartridge according to claim 20, wherein said developing bias contact is arranged at a position straddling said spur gear and said electrophotographic photosensitive drum in a longitudinal direction of said electrophotographic photosensitive drum.

26. A process cartridge according to claim 20, wherein said charging bias contact is arranged at a position straddling said spur gear and said electrophotographic photosensitive drum in a longitudinal direction of said electrophotographic photosensitive drum.

27. A process cartridge according to claim 20, wherein a toner remaining amount detection contact for detecting a remaining amount of toner to be used in a developing operation is arranged adjacent said one longitudinal end of said electrophotographic photosensitive drum that said developing bias contact is arranged and at a position spaced apart from said electrophotographic photosensitive drum more than a position that said developing bias contact is spaced apart from said electrophotographic photosensitive drum.

28. A process cartridge according to claim 20, wherein said process cartridge is configured to be mounted to or removed from a main body of the image forming apparatus in a direction orthogonal to an axial direction of said electrophotographic photosensitive drum.

29. A process cartridge according to claim 20, wherein said process cartridge integrally incorporates said electrophotographic photosensitive drum, and at least one of said charger means, said developing means and cleaning means as process means, as a unit which can be removably mounted to said image forming apparatus.

30. A process cartridge according to claim 20, wherein said process cartridge integrally incorporates said electrophotographic photosensitive drum, and at least said developing means as process means, as a unit which can be removably mounted to the image forming apparatus cleaning means as process means, as an unit which can be removably mounted to said image forming apparatus.

31. A process cartridge according to claim 24, wherein said charging bias contact has an arcuated shape.

32. A process cartridge according to claim 20, wherein said charging bias contact includes a straight portion which becomes a leading end when said process cartridge is inserted into the image forming apparatus, and an arcuated shape that is arcuated from said straight portion.

33. A process cartridge removably mountable to an image forming apparatus having a spring-biased developing bias contact pin, a spring-biased charging bias contact pin, an antenna line contact member, and a leaf spring earthing contact member, said process cartridge comprising:

an electrophotographic photosensitive drum;

a charging roller contacting said electrophotographic photosensitive drum;

a developing device disposed adjacent said electrophotographic photosensitive drum;

a developing bias contact that applies a developing bias from the spring-bias developing bias contact pin to said developing device when said process cartridge is mounted in the image forming apparatus;

a charging bias contact that applies a charging bias from the spring-biased charging bias contact pin to said charging roller when said process cartridge is mounted in the image forming apparatus, said developing bias contact and said charging bias contact being arranged adjacent one longitudinal end of said electrophotographic photosensitive drum in such a manner that they are disposed inwardly, in a longitudinal direction of said electrophotographic photosensitive drum, of an outer end of a spur gear provided on said one longitudinal end of said electrophotographic photosensitive drum;

a toner remaining amount detection contact that contacts the antenna line contact member when said process cartridge is mounted in the image forming apparatus and detects a remaining amount of toner to be used in a developing operation, said toner remaining amount detection contact being arranged adjacent said one longitudinal end of said electrophotographic photosensitive drum and at a position spaced apart from said electrophotographic photosensitive drum more than a position that said developing bias contact is spaced apart from said electrophotographic photosensitive drum; and an earthing contact that contacts the leaf spring earthing contact member when said process cartridge is mounted in the image forming apparatus and earths said electrophotographic photosensitive drum, said earthing contact being arranged adjacent another longitudinal end of said electrophotographic photosensitive drum opposite said one longitudinal end, wherein said charging bias contact, said developing bias contact, and said toner remaining amount detection contact are arranged substantially along a line extending in a direction perpendicular to the longitudinal direction of said electrophotographic photosensitive drum, and wherein said charging bias contact is disposed adjacent one side of said electrophotographic photosensitive drum, and said developing bias contact and said toner remaining amount detection contact are disposed adjacent another side of said electrophotographic photosensitive drum that is opposite said one side in a direction perpendicular to the longitudinal direction of said electrophotographic photosensitive drum.

34. An image forming apparatus for forming an image on a recording medium, said image forming apparatus comprising:

mounting means capable of removably mounting a process cartridge including an electrophotographic photosensitive drum, a developing bias contact for applying a developing bias to a developing means, a charging bias contact for applying a charging bias to a charger means, the developing bias contact and the charging bias contact being arranged adjacent one longitudinal end of the electrophotographic photosensitive drum in such a manner that they are disposed inwardly of an outer end of a gear provided on the one longitudinal end of the electrophotographic photosensitive drum, and an earthing contact being arranged adjacent another longitudinal end of the electrophotographic photosensitive drum opposite the one longitudinal end for earthing the electrophotographic photosensitive drum;

a developing bias terminal which can be abutted against the developing bias contact of the process cartridge;

a charging bias terminal which can be abutted against the charging bias member contact of the process cartridge; and an earthing terminal which can be abutted against the earthing contact of the process cartridge.

35. An image forming apparatus according to claim 34, wherein said image forming apparatus is an electrophotographic copying machine.

36. An image forming apparatus according to claim 34, wherein said image forming apparatus is a laser beam printer.

37. An image forming apparatus according to claim 34, wherein said image forming apparatus is a facsimile machine.

38. An image forming apparatus according to claim 34, wherein the process cartridge further includes a drum shaft for supporting one end of the electrophotographic photosensitive drum, and wherein the earthing contact is provided at an end surface of a portion of the drum shaft that protrudes outwardly toward said image forming apparatus in an axial direction of the electrophotographic photosensitive drum.

39. An image forming apparatus according to claim 34, wherein said image forming apparatus is configured so that the process cartridge is mounted to or removed from a main body of said image forming apparatus in a direction orthogonal to an axial direction of the electrophotographic photosensitive drum.

40. A process cartridge removably mountable to an image forming apparatus, said process cartridge comprising:

an electrophotographic photosensitive drum;

a developing bias contact for applying a developing bias to a developing means, and a charging bias contact for applying a charging bias to a charger means, said developing bias contact and said charging bias contact being arranged adjacent one longitudinal end of said electrophotographic photosensitive drum, said developing bias contact and said charging bias contact being respectively disposed at opposite sides of said electrophotographic photosensitive drum in a direction orthogonal to a longitudinal direction thereof; and an earthing contact arranged to protrude outwardly adjacent another longitudinal end of said electrophotographic photosensitive drum opposite said one longitudinal end for earthing said electrophotographic photosensitive drum.

41. A process cartridge according to claim 40, wherein both of said developing bias contact and said charging bias contact are disposed inwardly of an outer end of a gear provided on said one longitudinal end of said electrophotographic photosensitive drum.

42. A process cartridge according to claim 40, further comprising a drum shaft that supports one end of said electrophotographic photosensitive drum, wherein said earthing contact is provided at an end surface of a portion of said drum shaft, which protrudes outwardly toward the image forming apparatus in an axial direction of said electrophotographic photosensitive drum.

43. A process cartridge according to claim 40, further comprising a helical gear provided on said another longitudinal end of said electrophotographic photosensitive drum adjacent which said earthing contact is provided, for receiving a driving force for rotating said electrophotographic photosensitive drum from the image forming apparatus.

44. A process cartridge according to claim 41, wherein said gear is a spur gear which transmits a driving force for rotating a transfer roller in the image forming apparatus.

45. A process cartridge according to claim 41, wherein said developing bias contact is arranged at a position straddling said gear and said electrophotographic photosensitive drum in the longitudinal direction thereof.

46. A process cartridge according to claim 40, wherein a toner remaining amount detection contact for detecting a remaining amount of toner to be used in a developing operation is arranged adjacent said one longitudinal end of said electrophotographic photosensitive drum that said developing bias contact is arranged, and at a position spaced apart from said electrophotographic photosensitive drum more than a position that said developing bias contact is spaced apart from said electrophotographic photosensitive drum.

47. A process cartridge according to claim 40, wherein said process cartridge integrally incorporates said electrophotographic photosensitive drum, and said charger means, said developing means or cleaning means as a process means, as a unit which can be removably mounted to the image forming apparatus.

48. A process cartridge according to claim 40, wherein said process cartridge integrally incorporates said electrophotographic photosensitive drum, and at least one of said charger means, said developing means and cleaning means as a process means, as a unit which can be removably mounted to the image forming apparatus.

49. A process cartridge according to claim 40, wherein said process cartridge integrally incorporates said electrophotographic photosensitive drum, and at least said developing means as process means, as a unit which can be removably mounted to the image forming apparatus.

50. A process cartridge according to one of claims 17, 21, or 40, wherein said charging bias contact applies an AC voltage superposed with a DC voltage to said charger means.

51. A process cartridge according to one of claims 17, 21, or 40, wherein said developing bias contact applies an AC voltage superposed with a DC voltage to said developing means.

52. A process cartridge according to claim 44, wherein said developing bias contact is arranged at a position straddling said gear and said electrophotographic photosensitive drum in the longitudinal direction thereof.

53. A process cartridge according to one of claims 41, 44, 45, or 52, wherein said charging bias contact is arranged at a position straddling said gear and said electrophotographic photosensitive drum in the longitudinal direction thereof.

54. A process cartridge according to claim 40, wherein said process cartridge is configured to be mounted to or removed from a main body of the image forming apparatus in a direction orthogonal to an axial direction of said electrophotographic photosensitive drum.

55. A process cartridge according to claim 43, further comprising a drum shaft that supports one end of said electrophotographic photosensitive drum, wherein said earthing contact is provided at an end surface of a portion of said drum shaft, which protrudes outwardly toward the image forming apparatus in an axial direction of said electrophotographic photosensitive drum.

56. An image forming apparatus for forming an image on a recording medium, said image forming apparatus comprising:

mounting means capable of removably mounting a process cartridge including an electrophotographic photosensitive drum, a developing bias contact for applying a developing bias to a developing means, a charging bias contact for applying a charging bias to a charger means, the developing bias contact and the charging bias contact being arranged adjacent one longitudinal end of the electrophotographic photosensitive drum, the developing bias contact and the charging bias contact being disposed adjacent opposite sides of the electrophotographic photosensitive drum in a direction orthogonal to an axial direction thereof, and an earthing contact arranged to protrude outwardly adjacent another longitudinal end of said electrophotographic photosensitive drum opposite the one longitudinal end for earthing the electrophotographic photosensitive drum;

a developing bias contact of said image forming apparatus which can be abutted against the developing bias contact of the process cartridge;

a charging bias contact of said image forming apparatus which can be abutted against the charging bias contact of the process cartridge; and an earthing contact of said image forming apparatus which can be abutted against the earthing contact of the process cartridge.

57. An image forming apparatus according to claim 56, wherein said image forming apparatus is an electrophotographic copying machine.

58. An image forming apparatus according to claim 56, wherein said image forming apparatus is a laser beam printer.

59. An image forming apparatus according to claim 56, wherein said image forming apparatus is a facsimile machine.

60. An image forming apparatus according to claim 56, wherein said image forming apparatus is configured so that the process cartridge is mounted to or removed from a main body of said image forming apparatus in a direction orthogonal to the axial direction of the electrophotographic photosensitive drum.

61. A method for assembling a process cartridge removably mountable to an image forming apparatus, said method comprising the steps of:

attaching an earthing contact to a first frame for supporting an electrophotographic photosensitive drum adjacent one longitudinal end of the electrophotographic photosensitive drum in such a manner that the earthing contact protrudes outwardly, in the axial direction from the electrophotographic photosensitive drum;

attaching a charging bias contact to the first frame adjacent another longitudinal end of the electrophotographic photosensitive drum opposite the one longitudinal end;

attaching a developing bias contact to a second frame for supporting a developing means for developing a latent image formed on the electrophotographic photosensitive drum at the same longitudinal end of the electrophotographic photosensitive drum as the charging bias contact, when the first and second frames are interconnected; and thereafter, interconnecting the first and second frames to each other.

62. A method according to claim 61, wherein the earthing contact protrudes outwardly of an end face of a helical gear provided on the electrophotographic photosensitive drum.

63. A method according to claim 61, wherein the process cartridge includes a drum shaft that supports one end of the electrophotographic photosensitive drum, and wherein the earthing contact is provided at an end surface of a portion of the drum shaft, which protrudes outwardly from the first frame in an axial direction of the electrophotographic photosensitive drum.

64. A method according to claim 61, wherein the second frame is constituted by interconnecting a developing frame for supporting a developing roller as the developing means and a developer containing frame for containing developer to be used in the developing means.

65. A method according to claim 61, wherein the first frame supports a charger roller for charging the electrophotographic photosensitive drum.

66. A method according to claim 61, wherein the first frame supports a cleaning means for cleaning a peripheral surface of the electrophotographic photosensitive drum.

67. A method for assembling a process cartridge removably mountable to an image forming apparatus, said method comprising the step of:

connecting a first frame which supports an electrophotographic photosensitive drum and to which an earthing contact is attached adjacent one longitudinal end of the electrophotographic photosensitive drum, so as to protrude outwardly from the first frame in an axial direction of the electrophotographic photosensitive drum and a charging bias contact contact is attached adjacent another longitudinal end of the electrophotographic photosensitive drum opposite the one longitudinal end; and a second frame which supports a developing means for developing a latent image formed on the electrophotographic photosensitive drum and to which a developing bias contact is attached at the same longitudinal end of the electrophotographic photosensitive drum as the charging bias contact when the first and second frames are interconnected to each other, thereby assembling the process cartridge.

68. A method according to claim 67, wherein the earthing contact protrudes outwardly of an end face of a helical gear provided on the electrophotographic photosensitive drum.

69. A method according to claim 67, wherein the process cartridge includes a drum shaft that supports one end of the electrophotographic photosensitive drum, and wherein the earthing contact is provided at an end surface of a portion of the drum shaft, which protrudes outwardly from the first frame in an axial direction of the electrophotographic photosensitive drum.

70. A method according to claim 67, wherein the second frame is constituted by interconnecting a developing frame for supporting a developing roller as the developing means and a developer containing frame for containing developer to be used in the developing means.

71. A method according to claim 67, wherein the first frame supports a charger roller for charging the electrophotographic photosensitive drum.

72. A method according to claim 67, wherein the first frame supports a cleaning means for cleaning a peripheral surface of the electrophotographic photosensitive drum.

73. A process cartridge, removably mountable onto a main body of an image forming apparatus, said process cartridge comprising:

an electrophotographic photosensitive drum;

a charge member for charging said electrophotographic photosensitive drum;

a developing roller for developing a latent image formed on said electrophotographic photosensitive drum;

a developing bias contact provided adjacent one side of said electrophotographic photosensitive drum in a direction orthogonal to an axial direction of said electrophotographic photosensitive drum, for applying a developing bias to said developing roller;

a charge bias contact provided at another side of said electrophotographic photosensitive drum opposite said one side in the direction orthogonal to the axial direction of said electrophotographic photosensitive drum, for applying a charge bias to said charge member;

said developing bias contact and said charge bias contact being arranged adjacent one end of said electrophotographic photosensitive drum in the axial direction of said electrophotographic photosensitive drum; and an earth contact provided projecting in the axial direction of said electrophotographic photosensitive drum for earthing said electrophotographic photosensitive drum, wherein both of said developing bias contact and said charge bias contact are arranged inside an outer end of a spur gear disposed at said one end of said electrophotographic photosensitive drum.

74. A process cartridge, removably mountable onto a main body of an image forming apparatus, said process cartridge comprising:

an electrophotographic photosensitive drum;

a charge member for charging said electrophotographic photosensitive drum;

a developing roller for developing a latent image formed on said electrophotographic photosensitive drum;

a developing bias contact provided adjacent one side of said electrophotographic photosensitive drum in a direction orthogonal to an axial direction of said electrophotographic photosensitive drum, for applying a developing bias to said developing roller;

a charge bias contact provided at another side of said electrophotographic photosensitive drum opposite said one side in the direction orthogonal to the axial direction of said electrophotographic photosensitive drum, for applying a charge bias to said charge member;

said developing bias contact and said charge bias contact being arranged adjacent one longitudinal end of said electrophotographic photosensitive drum; and an earth contact provided projecting outwardly toward the image forming apparatus in the axial direction of said electrophotographic photosensitive drum for earthing said electrophotographic photosensitive drum, wherein a spur gear, arranged at said one longitudinal end of said electrophotographic photosensitive drum, transmits a rotating drive force to a transfer roller provided at the main body.

75. A process cartridge according to claim 73 or 74, wherein said developing bias contact and said charge bias contact are arranged so as to straddle said spur gear and said electrophotographic photosensitive drum in the axial direction thereof.

76. A process cartridge according to claim 75, wherein said charge bias contact has a bow-like shape.

77. A process cartridge according to claim 75, wherein an exposed portion of an antenna is provided adjacent said one longitudinal end of said electrophotographic photosensitive drum that said developing bias contact and said charge bias contact are provided for detecting a residual amount of toner to be used for developing, said exposed portion being exposed from a frame of said process cartridge.

78. A process cartridge according to claim 75 wherein said earth contact is arranged coaxially with said electrophotographic photosensitive drum.

79. A process cartridge, removably mountable onto a main body of an image forming apparatus, said process cartridge comprising:

an electrophotographic photosensitive drum;

a charge member for charging said electrophotographic photosensitive drum;

a developing roller for developing a latent image formed on said electrophotographic photosensitive drum;

a developing bias contact provided adjacent one side of said electrophotographic photosensitive drum in a direction orthogonal to an axial direction of said electrophotographic photosensitive drum, for applying a developing bias to said developing roller;

a charge bias contact provided adjacent another side of said electrophotographic photosensitive drum in the direction orthogonal to the axial direction of said electrophotographic photosensitive drum, opposite said one side, for applying a charge bias to said charge member;

said developing bias contact and said charge bias contact being arranged adjacent one longitudinal end of said electrophotographic photosensitive drum; and an earth contact provided adjacent another longitudinal end of said electrophotographic photosensitive drum opposite said one longitudinal end and projecting outwardly toward the image forming apparatus in the axial direction of said electrophotographic photosensitive drum for earthing said electrophotographic photosensitive drum, wherein said earth contact is arranged coaxially with said electrophotographic photosensitive drum, and wherein at said another longitudinal end of said electrophotographic photosensitive drum where said earth contact is arranged, a first helical gear is provided for receiving a drive force for rotating said electrophotographic photosensitive drum from the main body.

80. A process cartridge according to claim 79, wherein both of said developing bias contact and said charge bias contact are arranged inside an outer end of a spur gear disposed at said one longitudinal end of said electrophotographic photosensitive drum.

81. A process cartridge according to claim 79, wherein a spur gear disposed at said one longitudinal end of said electrophotographic photosensitive drum transmits a rotating drive force to a transfer roller provided at the main body.

82. A process cartridge according to claim 79, wherein said developing bias contact and said charge bias contact are arranged so as to straddle said electrophotographic photosensitive drum and a spur gear provided at said one longitudinal end of said electrophotographic photosensitive drum.

83. A process cartridge according to claim 79, wherein said charge bias contact has a bow-like shape.

84. A process cartridge according to claim 79, wherein an exposed portion of an antenna is provided adjacent said one longitudinal end of said electrophotographic photosensitive drum that said developing bias contact and said charge bias contact are arranged and at a position more remote than said developing bias contact from said electrophotographic photosensitive drum, for detecting a residual amount of toner to be used for developing, the exposed portion being exposed from a frame of said process cartridge.

85. A process cartridge according to claim 79, further comprising a cleaning member for removing residual toner from said electrophotographic photosensitive drum.

86. A process cartridge according to claim 79, wherein said charge member comprises a charge roller.

87. A process cartridge according to claim 79, wherein said developing roller comprises a second helical gear for transmitting a drive force for rotating said developing roller and said first helical gear is meshed with said second helical gear.

88. A process cartridge removably mountable onto a main body of an image forming apparatus, said process cartridge comprising:

an electrophotographic photosensitive drum;

a charge member for charging said electrophotographic photosensitive drum;

a developing roller for developing a latent image formed on said electrophotographic photosensitive drum;

a developing bias contact provided adjacent one side of said electrophotographic photosensitive drum in a direction orthogonal to an axial direction of said electrophotographic photosensitive drum, for applying a developing bias to said developing roller;

a charge bias contact provided adjacent another side of said electrophotographic photosensitive drum opposite said one side in the direction orthogonal to the axial direction of said electrophotographic photosensitive drum, for applying a charge bias to said charge member;

said developing bias contact and said charge bias contact being arranged adjacent one longitudinal end of said electrophotographic photosensitive drum; and an earth contact provided adjacent another longitudinal end of said electrophotographic photosensitive drum opposite said one longitudinal end and projecting outwardly toward the image forming apparatus in the axial direction of said electrophotographic photosensitive drum for earthing said electrophotographic photosensitive drum, wherein said earth contact is arranged coaxially with said electrophotographic photosensitive drum, wherein said developing bias contact and said charge bias contact are arranged so as to straddle said electrophotographic photosensitive drum and a spur gear provided at said one longitudinal end of said electrophotographic photosensitive drum for transmitting a drive force to a transfer roller provided in the image forming apparatus, and wherein at said another longitudinal end of said electrophotographic photosensitive drum where said earth contact is arranged, a first helical gear is provided for receiving a drive force for rotating said electrophotographic photosensitive drum from the main body.

89. A process cartridge according to claim 88, wherein said developing roller comprises a second helical gear for transmitting a drive force for rotating said developing roller and said first helical gear is meshed with said second helical gear.

90. An image forming apparatus for forming an image on a recording medium, said image forming apparatus comprising:

mounting means capable of removably mounting a process cartridge including an electrophotographic photosensitive drum for carrying a latent image thereon, a developing bias contact for applying a developing bias to a developing device, a charging bias contact for applying a charging bias to a charging roller, the developing bias contact and the charging bias contact being arranged adjacent one longitudinal end of the electrophotographic photosensitive drum in such a manner that they are disposed inwardly, in a longitudinal direction of the electrophotographic photosensitive drum, of an outer end of a spur gear provided on the one longitudinal end of the electrophotographic photosensitive drum, a toner remaining amount detection contact, for detecting a remaining amount of toner to be used in a developing operation, arranged adjacent the one longitudinal end of the electrophotographic photosensitive drum and at a position spaced apart from-the electrophotographic photosensitive drum more than a position that the developing bias contact is spaced apart from the electrophotographic photosensitive drum, and an earthing contact arranged adjacent another longitudinal end of the electrophotographic photosensitive drum opposite the one longitudinal end for earthing the electrophotographic photosensitive drum, wherein the charging bias contact, the developing bias contact, and the toner remaining amount detection contact are arranged substantially along a line extending in a direction perpendicular to the longitudinal direction of the electrophotographic photosensitive drum, and wherein the charging bias contact is disposed adjacent one side of the electrophotographic photosensitive drum, and the developing bias contact and the toner remaining amount detection contact are disposed adjacent another side of the electrophotographic photosensitive drum that is opposite the one side in a direction perpendicular to the longitudinal direction of the electrophotographic photosensitive drum;

a developing bias terminal that can be abutted against the developing bias contact of the process cartridge;

a charging bias terminal that can be abutted against the charging bias contact of the process cartridge; and an earthing terminal that can be abutted against the earthing contact of the process cartridge.

91. An image forming apparatus for forming an image on a recording medium, said image forming apparatus comprising:

mounting means capable of removably mounting a process cartridge including an electrophotographic photosensitive drum for carrying a latent image thereon, a developing bias contact for applying a developing bias to a developing device, a charging bias contact for applying a charging bias to a charging roller, the developing bias contact and the charging bias contact being arranged adjacent one longitudinal end of the electrophotographic photosensitive drum in such a manner that they are disposed inwardly, in a longitudinal direction of the electrophotographic photosensitive drum, of an outer end of a spur gear provided on the one longitudinal end of the electrophotographic photosensitive drum, a toner remaining amount detection contact, for detecting a remaining amount of toner to be used in a developing operation, arranged adjacent the one longitudinal end of the electrophotographic photosensitive drum and at a position spaced apart from the electrophotographic photosensitive drum more than a position that the developing bias contact is spaced apart from the electrophotographic photosensitive drum, and an earthing contact arranged adjacent another longitudinal end of the electrophotographic photosensitive drum opposite the one longitudinal end for earthing the electrophotographic photosensitive drum, wherein the charging bias contact is disposed adjacent one side of the electrophotographic photosensitive drum, and the developing bias contact and the toner remaining amount detection contact are disposed adjacent another side of the electrophotographic photosensitive drum that is opposite the one side in a direction perpendicular to the longitudinal direction of the electrophotographic photosensitive drum, and wherein when the process cartridge is mounted on a main body of said image forming apparatus, the charging bias contact, the developing bias contact, and the toner remaining amount detection contact are disposed on a lower surface of the process cartridge and the earthing contact is disposed on a side surface of the process cartridge;

a developing bias terminal that can be abutted against the developing bias contact of the process cartridge;

a charging bias terminal that can be abutted against the charging bias contact of the process cartridge; and an earthing terminal that can be abutted against the earthing contact of the process cartridge.

92. A process cartridge according to claim 88, wherein both of said developing bias contact and said charge bias contact are arranged inside an outer edge of the spur gear in the axial direction of said electrophotographic photosensitive drum.

93. A process cartridge according to claim 88, wherein the spur gear transmits a rotating drive force to a transfer roller provided at the main body.

94. A process cartridge according to claim 88, wherein said charge bias contact has a bow-like shape.

95. A process cartridge according to claim 88, wherein an exposed portion of an antenna is provided adjacent said one longitudinal end of said electrophotographic photosensitive drum that said developing bias contact and said charge bias contact are arranged and at a position more remote than said developing bias contact from said electrophotographic photosensitive drum, for detecting a residual amount of toner to be used for developing, the exposed portion being exposed from a frame of said process cartridge.

96. A process cartridge according to claim 88, further comprising a cleaning member for removing residual toner from said electrophotographic photosensitive drum.

97. A process cartridge according to claim 88, wherein said charge members comprises is a charge roller.

98. A process cartridge removably mounted onto a main body of an image forming apparatus including a charge bias output terminal for applying a charge bias to a charge member of said process cartridge, a developing bias output terminal for applying a developing bias to a developing roller of said process cartridge, and an earth terminal member for earthing said electrophotographic photosensitive drum of said process cartridge, said process cartridge comprising:

an electrophotographic photosensitive drum;

a developing bias contact for applying a developing bias to said developing roller, and a charging bias contact for applying a charging bias to said charge member, said developing bias contact and said charging bias contact being arranged adjacent a same longitudinal end of said electrophotographic photosensitive drum, said developing bias contact and said charging bias conductive contact being respectively disposed adjacent opposite sides of said electrophotographic photosensitive drum in a direction orthogonal to an axial direction of said electrophotographic photosensitive drum; and an earthing contact arranged adjacent an opposite longitudinal end of said electrophotographic photosensitive drum and protruding outwardly toward the image forming apparatus, for earthing said electrophotographic photosensitive drum, wherein the charge bias output terminal and said charging bias contact are connected, the developing bias output terminal and said developing bias contact are connected, and said earth terminal member and said earthing contact are connected in a state where said process cartridge is mounted onto the main body, for applying the charge bias from the main body to said charge member, for applying the developing bias to said developing roller, and for earthing said electrophotographic photosensitive drum to the main body, respectively.

99. A process cartridge according to claim 98, wherein the charge bias is obtained by superposing direct voltage and an alternating voltage.

100. A process cartridge according to claim 98, wherein the developing bias is obtained by superposing a direct current and an alternating voltage.

101. A process cartridge according to claim 98, wherein the earth terminal member is a plate spring.

102. A process cartridge according to claim 98, wherein said process cartridge is removably mounted onto the main body in a direction orthogonal to the axial direction of said electrophotographic photosensitive drum.

103. A process cartridge according to claim 98, wherein said charging bias contact applies an AC voltage superposed with a DC voltage to said charge member.

104. A process cartridge according to claim 98, wherein said developing bias contact applies an AC voltage superposed with a DC voltage to said developing roller.

105. A process cartridge removably mounted onto a main body of an image forming apparatus including a charge bias output terminal for applying a charge bias to a charge member of said process cartridge, a developing bias output terminal for applying a developing bias to a developing roller of said process cartridge, and an earth terminal member for earthing an electrophotographic photosensitive drum of said process cartridge, said process cartridge comprising:

a first frame comprising an electrophotographic photosensitive drum, a charge member including a charge roller for charging said electrophotographic photosensitive drum, a cleaning blade for removing residual toner on said electrophotographic photosensitive drum, a charge bias contact provided adjacent one side of said electrophotographic photosensitive drum in a direction orthogonal to an axial direction of said electrophotographic photosensitive drum and adjacent one longitudinal end of said electrophotographic photosensitive drum for applying the charge bias to said charge roller, an earth contact provided adjacent another longitudinal end of said electrophotographic photosensitive drum opposite said one longitudinal end and projected outwardly from said first frame in the axial direction of said electrophotographic photosensitive drum for earthing said electrophotographic photosensitive drum;

a second frame comprising a developing roller for developing a latent image formed on said electrophotographic photosensitive drum, a toner containing portion for containing toner to be used by said developing roller, a developing bias contact provided adjacent another side of said electrophotographic photosensitive drum opposite said one side in the direction orthogonal to the axial direction of said electrophotographic photosensitive drum for applying a developing bias to said developing roller, said developing bias contact being arranged adjacent said one longitudinal end of said electrophotographic photosensitive drum that said charge bias contact is arranged, said second frame being rockable relative to said first frame, wherein the charge bias output terminal and said charge bias output terminal and developing bias output terminal and said developing bias contact are connected, and the earth terminal member and said earth contact are connected in a state where said process cartridge is mounted onto the main body for applying the charge bias from the main body to said charge member, for applying the developing bias to said developing roller, and for earthing said electrophotographic photosensitive drum to the main body, respectively.

106. A process cartridge according to claim 105, wherein the charge bias is obtained by superposing direct voltage and an alternating voltage.

107. A process cartridge according to claim 105, wherein the developing bias is obtained by superposing a direct current and an alternating current.

108. A process cartridge according to claim 105, wherein the earth terminal member is a plate spring.

109. A process cartridge according to claim 105, wherein said process cartridge is removably mounted onto the main body in a direction orthogonal to the axial direction of said electrophotographic photosensitive drum.

110. A process cartridge according to one of claims 73, 79, 88, or 105, wherein when said process cartridge is mounted onto the main body of the image forming apparatus, said earth contact is disposed at a side surface of said process cartridge and said charge bias contact and said developing bias contact are disposed at a lower surface of said process cartridge.

111. A process cartridge according to one of claims 73, 79, 88, or 105, wherein said charge bias contact applies an AC voltage superposed with a DC voltage to said charge member.

112. A process cartridge according to one of claims 73, 79, 93, or 105, wherein said developing bias contact applies an AC voltage superposed with a DC voltage to said developing roller.

113. An image forming apparatus onto which a process cartridge is removably mounted for forming an image onto a recording medium, said image forming apparatus comprising:

an electrophotographic photosensitive drum;

a developing bias contact for applying a developing bias to a developing roller;

a charging bias contact for applying a charging bias to a charge member;

said developing bias contact and said charging bias contact being arranged adjacent a same longitudinal end of said electrophotographic photosensitive drum, said developing bias contact and said charging bias contact being disposed, respectively, at opposite sides of said electrophotographic photosensitive drum in a direction orthogonal to an axial direction of said electrophotographic photosensitive drum;

an earthing contact, arranged to protrude outwardly from said electrophotographic photosensitive drum and adjacent another longitudinal end of said electrophotographic photosensitive drum opposite said same longitudinal end, for earthing said electrophotographic photosensitive drum;

a developing bias output terminal for applying the developing bias to said developing bias contact;

a charge bias output terminal for applying the charging bias to said charging bias contact; and an earth terminal member for contacting said earthing contact and for earthing said electrophotographic photosensitive drum.

114. An assembling method of a process cartridge removably mounted onto a main body of an image forming apparatus, said method comprising the steps of:

attaching, to a first frame supporting an electrophotographic photosensitive drum and a charge member for charging the electrophotographic photosensitive drum, an earth contact adjacent one longitudinal end of the electrophotographic photosensitive drum to be protruded outwardly from the first frame in an axial direction of the electrophotographic photosensitive drum for earthing the electrophotographic photosensitive drum relative to the main body, while attaching a charge bias contact adjacent another longitudinal end of the electrophotographic photosensitive drum, opposite the one longitudinal end, for receiving a voltage to be applied to the charge member from the main body;

attaching, to a second frame supporting developing roller for developing a latent image formed on the electrophotographic photosensitive drum, a developing bias contact to be adjacent the same longitudinal end of the electrophotographic photosensitive drum as the charge bias contact when the first frame and the second frame are connected with each other, for receiving a voltage to be applied to the developing roller from the main body; and thereafter connecting the first frame and the second frame with each other to thereby constitute the process cartridge.

115. An assembling method according to claim 114, wherein the first frame and the second frame are connected with each other rockably.

116. An assembling method of a process cartridge removably mounted onto a main body of an image forming apparatus, said method comprising the steps of:

preparing a first frame to which an earth contact for earthing an electrophotographic photosensitive drum relative to the main body is attached adjacent one longitudinal end of the electrophotographic photosensitive drum so as to be protruded outwardly from the first frame in an axial direction of the electrophotographic photosensitive drum, and to which a charge bias contact for receiving a voltage to be applied to a charge member from the main body is attached at another longitudinal end of the electrophotographic photosensitive drum opposite the one longitudinal end;

preparing a second frame to which a developing bias contact for receiving a voltage to be applied to a developing roller is attached adjacent the same longitudinal end of the electrophotographic photosensitive drum as the charge bias contact when the second frame is connected to the first frame, and which supports the developing roller for developing a latent image formed on the electrophotographic photosensitive drum; and thereafter connecting the first frame and the second frame with each other to constitute the process cartridge.

117. An assembling method according to claim 114 or 116, wherein a resilient cleaning blade for removing residual toner stuck to the electrophotographic photosensitive drum is attached to the first frame before the electrophotographic photosensitive drum is attached to the first frame.

118. An assembling method according to claim 114 or 116, wherein the charge member comprises a charge roller for charging the electrophotographic photosensitive drum, the charge roller being attached to the first frame before the electrophotographic photosensitive drum is attached to the first frame.

119. An assembling method according to claim 115 or 116, wherein the earth contact is attached to the first frame so as to be protruded outwardly from an end of a helical gear attached to the electrophotographic photosensitive drum.

120. An assembling method according to claim 114 or 116, wherein the second frame is obtained by connecting a developing frame supporting the developing roller and a toner frame having a toner containing portion for containing the toner to be used by the developing roller.

121. An image forming apparatus onto which a process cartridge is removably mounted for forming an image on a recording medium, said image forming apparatus comprising:

mount means for removably mounting the process cartridge, which includes a cartridge frame, an electrophotographic photosensitive drum, a charger member for charging the electrophotographic photosensitive drum, a developing roller for developing a latent image formed on the electrophotographic photosensitive drum, a charging bias contact for applying an AC voltage to the charger member and a developing bias contact for applying an AC voltage to the developing roller, wherein the charging bias contact and the developing bias contact are respectively arranged adjacent opposite sides of the electrophotographic photosensitive drum in a direction perpendicular to a longitudinal direction thereof; and convey means for conveying the recording medium.

122. An image forming apparatus according to claim 121, wherein each AC voltage is obtained by superimposing a direct current component over an alternate current component.

123. An image forming apparatus according to claim 121, wherein the charging bias contact applies an AC voltage superposed with a DC voltage to the charger member.

124. An image forming apparatus according to claim 121, wherein the developing bias contact applies an AC voltage superposed with a DC voltage to the developing roller.

125. An image forming apparatus according to claim 121, wherein the electrophotographic photosensitive drum comprises a conductive sleeve having a photosensitive body therearound.

126. An image forming apparatus according to claim 121, further comprising an earthing contact for electrically earthing the electrophotographic photosensitive drum.

127. An image forming apparatus according to claim 121, further comprising an exposure device for illuminating light to the electrophotographic photosensitive drum.

128. An image forming apparatus according to claim 121, wherein said image forming apparatus is configured so that the process cartridge is mounted to or removed from a main body of said image forming apparatus in a direction orthogonal to an axial direction of the electrophotographic photosensitive drum.

129. A process cartridge removably mountable to an image forming apparatus, said process cartridge comprising:

an electrophotographic photosensitive drum for carrying a latent image thereon;

a charging roller contacting said electrophotographic photosensitive drum for charging said electrophotographic photosensitive drum;

a developing device for developing the latent image formed on said electrophotographic photosensitive drum;

a developing bias contact for applying a developing bias to said developing device;

a charging bias contact for applying a charging bias to said charging roller, said developing bias contact and said charging bias contact being arranged adjacent one longitudinal end of said electrophotographic photosensitive drum in such a manner that they are disposed inwardly, in a longitudinal direction of said electrophotographic photosensitive drum, of an outer end of a spur gear provided on said one longitudinal end of said electrophotographic photosensitive drum;

a toner remaining amount detection contact, for detecting a remaining amount of toner to be used in a developing operation, arranged adjacent said one longitudinal end of said electrophotographic photosensitive drum and at a position spaced apart from said electrophotographic photosensitive drum more than a position that said developing bias contact is spaced apart from said electrophotographic photosensitive drum; and an earthing contact arranged adjacent another longitudinal end of said electrophotographic photosensitive drum opposite said one longitudinal end for earthing said electrophotographic photosensitive drum, wherein said charging bias contact, said developing bias contact, and said toner remaining amount detection contact are arranged substantially along a line extending in a direction perpendicular to the longitudinal direction of said electrophotographic photosensitive drum, and wherein said charging bias contact is disposed adjacent one side of said electrophotographic photosensitive drum, and said developing bias contact and said toner remaining amount detection contact are disposed adjacent another side of said electrophotographic photosensitive drum that is opposite said one side in a direction perpendicular to the longitudinal direction of said electrophotographic photosensitive drum.

130. A process cartridge removably mountable to an image forming apparatus, said process cartridge comprising:

an electrophotographic photosensitive drum for carrying a latent image thereon;

a charging roller contacting said electrophotographic photosensitive drum for charging said electrophotographic photosensitive drum;

a developing device for developing the latent image formed on said electrophotographic photosensitive drum;

a developing bias contact for applying a developing bias to said developing device;

a charging bias contact for applying a charging bias to said charging roller, said developing bias contact and said charging bias contact being arranged adjacent one longitudinal end of said electrophotographic photosensitive drum in such a manner that they are disposed inwardly, in a longitudinal direction of said electrophotographic photosensitive drum, of an outer end of a spur gear provided on said one longitudinal end of said electrophotographic photosensitive drum;

a toner remaining amount detection contact, for detecting a remaining amount of toner to be used in a developing operation, arranged adjacent said one longitudinal end of said electrophotographic photosensitive drum and at a position spaced apart from said electrophotographic photosensitive drum more than a position that said developing bias contact is spaced apart from said electrophotographic photosensitive drum; and an earthing contact arranged adjacent another longitudinal end of said electrophotographic photosensitive drum opposite said one longitudinal end for earthing said electrophotographic photosensitive drum, wherein said charging bias contact is disposed adjacent one side of said electrophotographic photosensitive drum, and said developing bias contact and said toner remaining amount detection contact are disposed adjacent another side of said electrophotographic photosensitive drum that is opposite said one side in a direction perpendicular to the longitudinal direction of said electrophotographic photosensitive drum, and wherein when said process cartridge is mounted on a main body of the image forming apparatus, said charging bias contact, said developing bias contact, and said toner remaining amount detection contact are disposed on a lower surface of said process cartridge and said earthing contact is disposed on a side surface of said process cartridge.

131. A process cartridge according to one of claims 20, 40, 98, or 129, wherein when said process cartridge is mounted on a main body of the image forming apparatus, said earthing contact is disposed at a side surface of said process cartridge and said charging bias contact and said developing bias contact are disposed at a lower surface of said process cartridge.

132. A process cartridge according to claim 129 or 130, wherein said charging bias contact applies an AC voltage superposed with a DC voltage to said charging roller.

133. A process cartridge according to claim 120, or 130, wherein said developing bias contact applies an AC voltage superposed with a DC voltage to said developing device.

134. A process cartridge removably mountable onto a main body of an image forming apparatus, said process cartridge comprising:

an electrophotographic photosensitive drum;

a charging roller that contacts said electrophotographic photosensitive drum;

a developing device disposed adjacent to said electrophotographic photosensitive drum;

a developing bias contact that receives a developing bias from the main body of the image forming apparatus and supplies the developing bias to said developing device when said process cartridge is mounted onto the main body of the image forming apparatus;

a charging bias contact that receives a charging bias from the main body of the image forming apparatus and supplies the charging bias to said charging roller when said process cartridge is mounted onto the main body of the image forming apparatus, said developing bias contact and said charging bias contact being arranged adjacent one longitudinal end of said electrophotographic photosensitive drum in such a manner that they are disposed inwardly, in a longitudinal direction of said electrophotographic photosensitive drum, of an outer end of a spur gear provided on said one longitudinal end of said electrophotographic photosensitive drum;

a toner remaining amount detection contact that detects a remaining amount of toner to be used in a developing operation arranged adjacent said one longitudinal end of said electrophotographic photosensitive drum and at a position spaced apart from said electrophotographic photosensitive drum more than a position that said developing bias contact is spaced apart from said electrophotographic photosensitive drum; and an earthing contact, arranged adjacent another longitudinal end of said electrophotographic photosensitive drum opposite said one longitudinal end, that earths said electrophotographic photosensitive drum, wherein said charging bias contact, said developing bias contact, and said toner remaining amount detection contact are arranged substantially along a line extending in a direction perpendicular to the longitudinal direction of said electrophotographic photosensitive drum, and wherein said charging bias contact is disposed adjacent one side of said electrophotographic photosensitive drum, and said developing bias contact and said toner remaining amount detection contact are disposed adjacent another side of said electrophotographic photosensitive drum that is opposite said one side in a direction perpendicular to the longitudinal direction of said electrophotographic photosensitive drum.

135. A process cartridge removably mountable to an image forming apparatus, said process cartridge comprising:

an electrophotographic photosensitive drum;

a charging roller contacting said electrophotographic photosensitive drum;

a developing device disposed adjacent to said electrophotographic photosensitive drum;

a developing bias contact that receives a developing bias from the main body of the image forming apparatus and supplies the developing bias to said developing device when said process cartridge is mounted onto the main body of the image forming apparatus;

a charging bias contact that receives a charging bias from the main body of the image forming apparatus and supplies the charging bias to said charging roller when said process cartridge is mounted onto the main body of the image forming apparatus, said developing bias contact and said charging bias contact being arranged adjacent one longitudinal end of said electrophotographic photosensitive drum in such a manner that they are disposed inwardly, in a longitudinal direction of said electrophotographic photosensitive drum, of an outer end of a gear provided on said one longitudinal end of said electrophotographic photosensitive drum;

a toner remaining amount detection contact that detects a remaining amount of toner to be used in a developing operation arranged adjacent said one longitudinal end of said electrophotographic photosensitive drum and at a position spaced apart from said electrophotographic photosensitive drum more than a position that said developing bias contact is spaced apart from said electrophotographic photosensitive drum; and an earthing contact, arranged adjacent another longitudinal end of said electrophotographic photosensitive drum opposite said one longitudinal end, that earths said electrophotographic photosensitive drum, wherein said charging bias contact, said developing bias contact, and said toner remaining amount detection contact are arranged substantially along a line extending in a direction perpendicular to the longitudinal direction of said electrophotographic photosensitive drum, and wherein said charging bias contact is disposed adjacent one side of said electrophotographic photosensitive drum, and said developing bias contact and said toner remaining amount detection contact are disposed adjacent another side of said electrophotographic photosensitive drum that is opposite said one side in a direction perpendicular to the longitudinal direction of said electrophotographic photosensitive drum.

* * * * *

UNITED STATES PATENT AND TRADEMARK OFFICE

CERTIFICATE OF CORRECTION

PATENT NO. : 5,652,647

DATED : July 29, 1997

INVENTOR(S) : MASAHIKO YASHIRO, ET AL.

It is certified that error appears in the above-identified patent and that said Letters Patent is hereby corrected as shown below:

COLUMN 1:

Line 26, "at" should read --to--;
Line 27, "to" should read --at--; and
Line 47, "photo-sensitive" should read --photosensitive--.

COLUMN 8:

Line 52, "aluminium" should read --aluminum--.

COLUMN 9:

Line 41, "aluminium" should read --aluminum--, and "seramics" should read --ceramics--.

COLUMN 11:

Line 18, "and DC" should read --and a DC--.

COLUMN 15:

Line 37, "so" should be deleted;
Line 61, "27," should read --27--; and
Line 65, "directing" should read --direction--.

COLUMN 16:

Line 36, "operantor's" should read --operator's--;
Line 57, "flower" should read --lower--; and
Line 62, "dense" should read --density--.

UNITED STATES PATENT AND TRADEMARK OFFICE

CERTIFICATE OF CORRECTION

PATENT NO. : 5,652,647

DATED : July 29, 1997

INVENTOR(S) : MASAHIKO YASHIRO, ET AL.

It is certified that error appears in the above-indentified patent and that said Letters Patent is hereby corrected as shown below:

COLUMN 19:

Line 13, "an" should read --a--; and
Line 37, "an" should read --the--, and "the" (second occurrence) should read --an--.

COLUMN 20:

Line 11, "is" should read --are--; and
Line 34, "respect" should read --respect to--.

COLUMN 22:

Line 64, "6f" should read --of--.

COLUMN 25:

Line 31, "thrust" should read --(thrust--; and
Line 55, "member, 18" should read --member 18,--.

COLUMN 26:

Line 38, "an" should read --a--.

COLUMN 27:

Line 41, "anti-clockwise" should read --counter-clockwise--.

UNITED STATES PATENT AND TRADEMARK OFFICE

CERTIFICATE OF CORRECTION

PATENT NO. : 5,652,647 Page 3 of 6

DATED : July 29, 1997

INVENTOR(S) : MASAHIKO YASHIRO, ET AL.

It is certified that error appears in the above-indentified patent and that said Letters Patent is hereby corrected as shown below:

COLUMN 29:

Line 17, "lgiht" should read --light--.

COLUMN 30:

Line 18, "cartridge S" should read --cartridge B--;
Line 40, "to" should be deleted; and
Line 41, "to" should be deleted.

COLUMN 31:

Line 22, "50d," should read --50d so as--; and
Line 40, "of" should read --from--.

COLUMN 32:

Line 45, "to" should read --for--; and
Line 49, "effected" should read --affected--.

COLUMN 33:

Line 28, "is." should read --is--.

COLUMN 36:

Line 8, "(Recycle" should read --(Recycling--;
Line 23, "the" should be deleted;
Line 26, "that" should read --in which--;
Line 28, "recycle" should read --recycling--;
Line 30, "steps; that is," should read --steps:--; and
Line 47, "were" should read --are--.

UNITED STATES PATENT AND TRADEMARK OFFICE

CERTIFICATE OF CORRECTION

PATENT NO. : 5,652,647

DATED : July 29, 1997

INVENTOR(S) : MASAHIKO YASHIRO, ET AL.

It is certified that error appears in the above-identified patent and that said Letters Patent is hereby corrected as shown below:

COLUMN 37:

Line 9, "recycle" should read --recycling--;
Line 12, "group)," should read --groups),--; and
Line 30, "same" should read --the same--.

COLUMN 40:

Line 16, "incorporated" should read --incorporate--.

COLUMN 43:

Line 43, "claim 20," should read --claim 24,--; and
Line 48, "claim 20," should read --claim 24,--.

COLUMN 44:

Line 11, "an" should read --a--; and
Line 13, "claim 24," should read --claim 20,--.

COLUMN 45:

Line 34, "member" should be deleted.

COLUMN 46:

Line 61, "claims 17, 21" should read --claims 17, 20--; and
Line 64, "claims 17, 21" should read --claims 17, 20--.

UNITED STATES PATENT AND TRADEMARK OFFICE

CERTIFICATE OF CORRECTION

PATENT NO. : 5,652,647

DATED : July 29, 1997

INVENTOR(S) : MASAHIKO YASHIRO, ET AL.

It is certified that error appears in the above-identified patent and that said Letters Patent is hereby corrected as shown below:

COLUMN 48:

Line 50, "contact contact" should read --contact--.

COLUMN 52:

Line 32, "from-the" should read --from the--.

COLUMN 54:

Line 16, "conductive" should be deleted; and
Line 39, "by" should read --by a--.

COLUMN 55:

Line 28, "output terminal and" should read --contact are connected, the--.

COLUMN 57:

Line 27, "claim 115" should read --claim 114--.

UNITED STATES PATENT AND TRADEMARK OFFICE

CERTIFICATE OF CORRECTION

PATENT NO. : 5,652,647 Page 6 of 6

DATED : July 29, 1997

INVENTOR(S) : MASAHIKO YASHIRO, ET AL.

It is certified that error appears in the above-identified patent and that said Letters Patent is hereby corrected as shown below:

COLUMN 59:

Line 53, "claim 120," should read --claim 129--.

Signed and Sealed this

Twenty-eighth Day of April, 1998

Bruce Lehman

*Attest:*

BRUCE LEHMAN

*Attesting Officer*

*Commissioner of Patents and Trademarks*